US011819122B2

(12) United States Patent
Tarpey

(10) Patent No.: US 11,819,122 B2
(45) Date of Patent: Nov. 21, 2023

(54) LOAD DISTRIBUTING DECK INSERT

(71) Applicant: James Tarpey, Stony Brook, NY (US)

(72) Inventor: James Tarpey, Stony Brook, NY (US)

( * ) Notice: Subject to any disclaimer, the term of this patent is extended or adjusted under 35 U.S.C. 154(b) by 0 days.

(21) Appl. No.: 17/119,935

(22) Filed: Dec. 11, 2020

(65) Prior Publication Data

US 2021/0177165 A1 Jun. 17, 2021

Related U.S. Application Data

(60) Provisional application No. 63/082,879, filed on Sep. 24, 2020, provisional application No. 62/948,185, filed on Dec. 13, 2019.

(51) Int. Cl.

| | |
|---|---|
| ***A47G 7/04*** | (2006.01) |
| ***E04H 12/22*** | (2006.01) |
| ***A47B 3/04*** | (2006.01) |
| ***A47B 37/04*** | (2006.01) |

(52) U.S. Cl.

CPC ..... *A47B 37/04* (2013.01); *A47G 7/041* (2013.01); *E04H 12/2269* (2013.01)

(58) Field of Classification Search

CPC ..... E04F 15/04; E04F 15/02044; E04F 15/02183; E04F 21/0092; E04F 21/22; E04F 21/1838; E04B 1/2612; E04B 1/2608; E04B 5/12; E04B 1/003; E04B 1/0038; E04B 2001/2415; E04B 2001/405; E04B 1/2604; E04C 2003/026; A47G 7/041; A47B 37/04; E04G 21/1891; B65D 19/385; B63B 17/02; E04H 6/025; E04H 12/2269; A45B 2023/0025; A45B 2023/0012

USPC ..... 108/149, 150; 248/231.9

See application file for complete search history.

(56) References Cited

U.S. PATENT DOCUMENTS

| | | | | |
|---|---|---|---|---|
| 1,665,400 | A * | 4/1928 | Bittner | E04G 21/18 33/501 |
| 1,775,465 | A * | 9/1930 | Kirkpatrick | E04F 21/22 254/114 |
| 1,848,085 | A * | 3/1932 | Eisenschmidt | F16B 7/0493 D8/380 |
| 2,116,737 | A * | 5/1938 | Urbain | E04F 15/04 52/592.1 |
| 2,495,711 | A * | 1/1950 | Fletcher | B65D 19/385 108/53.5 |
| 2,567,586 | A * | 9/1951 | Werder | E04G 21/1891 33/562 |

(Continued)

FOREIGN PATENT DOCUMENTS

| | | | |
|---|---|---|---|
| CA | 2345160 | A1 * | 10/2002 |
| DE | 102010000535 | A1 * | 8/2011 |

(Continued)

OTHER PUBLICATIONS

International Search Report and Written Opinion dated Mar. 23, 2021, directed to International Application No. PCT/US20/64641; 14 pages.

*Primary Examiner* — Taylor Morris
(74) *Attorney, Agent, or Firm* — Michele V. Frank; Venable LLP

(57) ABSTRACT

A load distributing deck insert for supporting an object above the surface of a deck. The load distributing deck insert may include a body, a saddle, and a load receiving section. The load distributing deck insert may avoid contacting an upper surface of the adjacent deck boards.

25 Claims, 51 Drawing Sheets

(56) References Cited

U.S. PATENT DOCUMENTS 2,587,150 A * 2/1952 Hansen ..... D06F 57/125 248/58
2,659,980 A * 11/1953 Dunn ..... B25H 7/02 33/563
2,744,334 A * 5/1956 Jondole ..... E04G 21/26 33/613
2,924,339 A * 2/1960 Skubic ..... B65D 19/385 108/53.5
2,926,793 A * 3/1960 Sparks ..... B65D 19/385 108/53.5
2,994,500 A * 8/1961 Fraser ..... B65D 19/385 108/53.5
3,017,151 A * 1/1962 Townson, Jr. ..... B65D 19/385 108/53.5
3,091,195 A * 5/1963 Kenyon ..... B65D 19/06 108/53.5
3,095,837 A * 7/1963 Skubic ..... B65D 19/385 108/53.5
3,201,874 A * 8/1965 Christy ..... E04C 3/02 33/613
3,257,974 A * 6/1966 McMasters ..... B65D 19/385 108/53.5
3,422,585 A * 1/1969 Dismukes ..... E02D 27/32 52/127.3
3,500,770 A * 3/1970 Skubic ..... B65D 19/385 108/53.5
3,553,919 A * 1/1971 Omholt ..... E04F 15/04 52/480
3,577,694 A * 5/1971 Omholt ..... E04F 15/04 52/509
3,619,963 A * 11/1971 Omholt ..... E04F 15/04 52/480
3,855,944 A * 12/1974 Skubic ..... B65D 19/385 108/53.5
3,879,889 A 4/1975 Schmid
4,039,132 A * 8/1977 Fournier ..... A47G 7/041 248/150
4,081,940 A * 4/1978 Hughes ..... E04B 1/2604 52/712
4,106,258 A * 8/1978 Lindsay ..... E04B 5/10 52/693
4,223,505 A * 9/1980 Krebel ..... E04F 13/0823 52/489.2
4,229,919 A * 10/1980 Hughes ..... A47C 11/00 52/741.1
4,246,736 A 1/1981 Kovar et al.
4,285,542 A * 8/1981 Boisvert ..... A47C 15/002 297/217.7
4,313,688 A * 2/1982 Daniels ..... E04B 5/12 52/715
4,421,442 A * 12/1983 Lindblad ..... B23B 47/288 408/108
4,525,971 A * 7/1985 Kern ..... E04B 9/122 52/506.06
4,527,375 A * 7/1985 Braginetz ..... E04B 1/2612 52/712
4,582,287 A * 4/1986 DeLeary ..... A47B 37/04 248/519
4,592,186 A * 6/1986 Braginetz ..... E04B 1/2604 403/396
4,833,823 A 5/1989 Edwards, III
4,918,880 A * 4/1990 Carney ..... A47C 11/00 297/217.7
4,925,141 A * 5/1990 Classen ..... E04B 1/2612 248/217.2
4,930,225 A * 6/1990 Phillips ..... B25H 7/00 33/526
4,958,814 A * 9/1990 Johnson ..... E04G 21/1891 248/216.1
4,965,980 A * 10/1990 Leavens ..... E04B 1/2608 52/105
5,058,352 A * 10/1991 Loiselle ..... E04C 3/02 52/404.2
5,111,632 A 5/1992 Turner
5,188,331 A * 2/1993 Baines ..... A45B 11/00 248/354.4
5,190,266 A * 3/1993 Barrera ..... B27H 1/00 254/17
5,197,251 A * 3/1993 Krysak ..... E04B 1/76 182/222
5,209,013 A 5/1993 Sellers
5,224,307 A * 7/1993 Lukos ..... F16B 7/0446 52/86
5,307,603 A * 5/1994 Chiodo ..... E04B 1/2608 52/297
5,309,670 A 5/1994 Bates
5,321,909 A 6/1994 Loran
5,333,423 A 8/1994 Propst
5,367,783 A * 11/1994 Nygren ..... E04G 21/1891 33/478
5,435,610 A * 7/1995 Roberts ..... E04F 21/22 254/11
5,447,289 A * 9/1995 Callahan ..... B25C 11/00 254/131
5,490,334 A * 2/1996 Payne ..... E04G 21/1891 33/613
5,582,380 A 12/1996 Hagen
5,611,179 A * 3/1997 Leek ..... E04B 1/2608 52/715
5,628,119 A * 5/1997 Bingham ..... E04G 21/1891 33/613
5,768,850 A * 6/1998 Chen ..... E04F 15/02044 52/480
5,775,353 A * 7/1998 Johnson ..... B63B 17/02 135/96
5,787,676 A * 8/1998 Scharf ..... E04F 21/22 52/745.05
5,826,858 A * 10/1998 Gordon ..... E04F 21/22 254/17
5,884,411 A * 3/1999 Raber ..... E04G 21/1891 33/613
5,895,017 A * 4/1999 McMillan, Jr. ..... B63B 29/06 248/188.1
5,997,209 A * 12/1999 Sachs ..... E04F 15/04 403/388
6,070,336 A * 6/2000 Rodgers ..... G01C 9/28 33/370
6,131,359 A * 10/2000 Duff ..... E04B 5/12 52/696
6,151,853 A * 11/2000 Fukunaga ..... E01C 5/00 52/264
6,256,958 B1 * 7/2001 Matthews ..... E04B 5/10 52/274
6,293,028 B1 * 9/2001 Sylvia ..... E04G 21/1891 33/416
6,298,999 B1 * 10/2001 Bellman ..... A47F 7/04 108/55.1
6,321,499 B1 * 11/2001 Chuang ..... E04F 15/022 52/263
6,381,908 B1 * 5/2002 Fisher ..... E04G 21/1891 269/43
6,488,438 B1 * 12/2002 Tebo ..... F16B 15/00 403/294
6,494,015 B1 * 12/2002 Critchlow ..... B25H 7/00 269/1
6,508,010 B2 * 1/2003 Hanson ..... E04F 21/0092 33/526
6,510,621 B2 * 1/2003 Camara ..... E04B 5/12 33/645
6,539,641 B2 * 4/2003 Belliveau ..... E04F 21/0092 33/526
6,647,638 B1 * 11/2003 Doyal ..... E04B 5/12 33/613
6,837,019 B2 * 1/2005 Collie ..... E04B 7/045 52/489.1
6,895,684 B1 * 5/2005 Firth ..... E04G 21/1891 33/562

(56) References Cited

U.S. PATENT DOCUMENTS 6,931,813 B2 * 8/2005 Collie ..... E04B 7/063 52/713
7,156,357 B1 * 1/2007 Kocur ..... E04H 12/2215 248/231.9
7,207,150 B2 * 4/2007 Leek ..... E04B 5/12 33/526
7,240,683 B2 * 7/2007 Zutich ..... A45B 23/00 135/124
7,257,930 B2 * 8/2007 Aldykiewicz, Jr. ..... E04F 15/04 52/712
7,310,914 B1 * 12/2007 Moore ..... E04B 1/3483 52/289
7,398,620 B1 * 7/2008 Jones ..... E04B 7/045 52/643
7,398,623 B2 * 7/2008 Martel ..... F16B 15/0038 52/489.1
7,503,146 B2 * 3/2009 Thomas ..... E04F 15/02183 52/177
7,575,215 B1 * 8/2009 Clark ..... A01K 97/10 248/222.11
7,665,253 B1 * 2/2010 Thompson ..... E04B 1/2604 52/153
7,673,425 B2 * 3/2010 Thomas ..... E04D 13/0445 52/177
7,681,324 B2 * 3/2010 Hooks ..... E04G 21/1891 33/613
7,748,187 B2 * 7/2010 Sensenig ..... E04F 15/02 52/800.1
7,886,494 B1 * 2/2011 Schott ..... E04F 15/04 52/489.1
7,971,410 B2 * 7/2011 Jerke ..... E04B 7/045 52/702
8,061,088 B2 * 11/2011 Walker ..... E04B 7/045 52/92.2
8,082,712 B1 * 12/2011 Butler ..... E04F 17/00 52/302.1
8,161,690 B1 * 4/2012 Borne ..... E04B 5/12 52/71
8,191,335 B2 * 6/2012 Davis ..... E04G 21/1891 52/749.1
8,302,362 B2 * 11/2012 Rischmueller ..... E01D 19/125 52/650.3
8,307,564 B1 * 11/2012 Heaton ..... G01B 3/566 33/527
8,307,603 B1 11/2012 Mitchell et al.
8,381,435 B2 2/2013 Rand et al.
8,661,739 B2 * 3/2014 Keenan ..... A47B 96/00 52/27
8,672,600 B2 * 3/2014 Reznar ..... E04F 15/04 411/457
8,708,099 B2 * 4/2014 Fortin ..... E04G 21/3276 182/3
8,769,899 B2 * 7/2014 Barry ..... E04F 15/02452 52/480
8,793,889 B2 * 8/2014 Hovren ..... B25B 23/08 33/526
8,839,588 B2 * 9/2014 Philbin ..... E04B 1/38 52/715
8,966,856 B2 * 3/2015 Groenesteyn ..... E04C 5/18 52/657
9,003,738 B1 * 4/2015 Evans, Jr. ..... E04B 1/40 52/702
9,004,457 B2 * 4/2015 Carl ..... E04F 11/1865 256/67
9,097,005 B2 * 8/2015 Cave ..... E04B 5/43
9,127,466 B2 * 9/2015 Hinkle ..... E04F 21/20
9,151,063 B2 * 10/2015 McManus ..... E04F 15/02005
9,206,602 B2 * 12/2015 Cave ..... E04F 15/02044
9,216,847 B2 * 12/2015 Belinda ..... B23B 47/287
9,334,674 B1 * 5/2016 Churnick ..... E04H 17/261
9,340,986 B2 * 5/2016 Hamilton ..... E04F 21/0092
9,435,130 B2 * 9/2016 Briganti ..... B25H 7/04
9,493,962 B2 * 11/2016 Eddy ..... E04H 12/2261
9,534,377 B2 * 1/2017 Lee ..... E04C 3/29
9,732,522 B2 * 8/2017 Brandt ..... E04B 1/40
9,982,426 B2 * 5/2018 Desautels ..... E04C 3/36
10,029,820 B2 * 7/2018 Van Doorn ..... B65D 19/385
10,041,261 B2 * 8/2018 Shank ..... E04F 21/165
10,329,766 B1 * 6/2019 Kollinger ..... E04C 3/02
10,501,930 B1 * 12/2019 Hyett ..... E04B 1/40
10,759,043 B2 * 9/2020 Denton ..... B25H 7/045
10,822,809 B1 * 11/2020 Linnane ..... E04B 1/003
10,895,080 B1 * 1/2021 MacKenzie ..... E04F 13/0826
10,947,745 B2 * 3/2021 Mizelle ..... B66F 15/00
10,961,720 B1 * 3/2021 Chen ..... E04F 15/0247
10,988,947 B2 * 4/2021 Sheppard ..... G01C 9/28
11,000,044 B1 * 5/2021 Williamson ..... A22C 25/025
11,047,137 B1 * 6/2021 Roche ..... E04F 15/02177
2001/0025465 A1 * 10/2001 Osfolk ..... E02B 3/068 52/650.3
2001/0029706 A1 * 10/2001 Risser ..... E04B 1/003 52/11
2002/0144421 A1 10/2002 Hanson et al.
2003/0136050 A1 7/2003 Smead
2003/0159399 A1 * 8/2003 Werren ..... E04F 21/0092 52/749.1
2003/0221391 A1 * 12/2003 Bolton ..... B25B 23/00 52/741.1
2004/0003509 A1 * 1/2004 Peterson ..... E04G 21/1891 33/645
2004/0069913 A1 * 4/2004 Martens ..... B25H 1/06 248/161
2004/0139666 A1 * 7/2004 Kraft ..... B44F 11/00 52/182
2004/0189064 A1 * 9/2004 Gross ..... A47C 4/02 297/217.7
2005/0102928 A1 * 5/2005 Oidtman ..... E01F 13/024 52/169.9
2005/0155315 A1 * 7/2005 Davis ..... E04B 7/045 52/712
2005/0258722 A1 * 11/2005 Sullivan ..... E04G 23/027 312/245
2006/0080909 A1 * 4/2006 Harding ..... E04F 19/062 52/177
2006/0156640 A1 * 7/2006 Thomas ..... E04F 15/02183 52/58
2006/0185932 A1 * 8/2006 Graney ..... A47C 11/00 182/45
2006/0265984 A1 * 11/2006 Thomason ..... A47B 7/00 52/300
2006/0277832 A1 * 12/2006 Balser ..... A47B 88/40 52/29
2007/0028550 A1 * 2/2007 Clapper ..... E04G 3/26 52/650.3
2008/0022629 A1 * 1/2008 Behnecke ..... E04F 21/1883 52/750
2008/0053031 A1 * 3/2008 Sandoz ..... E04C 2/386 52/649.1
2008/0190069 A1 * 8/2008 Van Fleet ..... E04F 15/02183 52/712
2009/0000523 A1 * 1/2009 Ciardelli ..... A47B 37/04 108/42
2009/0056235 A1 * 3/2009 Morsching ..... E04D 13/15 52/741.1
2009/0090279 A1 * 4/2009 Wainland ..... F16B 5/0216 108/42
2009/0090280 A1 * 4/2009 Mills ..... B65D 19/385 29/428
2009/0293378 A1 * 12/2009 Benson ..... E04F 15/02183 52/126.6
2009/0301024 A1 * 12/2009 Rischmueller ..... E01D 19/125 52/745.19
2010/0064609 A1 * 3/2010 Busby ..... E04F 15/02183 52/283
2010/0133216 A1 * 6/2010 Lanza-Brache ..... E04G 23/0266 211/86.01
2011/0079700 A1 * 4/2011 Hilderbrand ..... A47C 7/002 248/499

(56) References Cited

U.S. PATENT DOCUMENTS

2011/0214389 A1* 9/2011 Paton ..... E04G 21/16 52/749.1
2011/0252730 A1* 10/2011 Rosan ..... E04F 15/02038 52/302.1
2012/0085065 A1* 4/2012 Gelormino ..... E04F 15/02044 52/745.21
2013/0014465 A1* 1/2013 Kilgore ..... E04F 15/02183 52/650.3
2013/0025228 A1* 1/2013 Kilgore ..... E04F 15/04 52/578
2013/0031846 A1* 2/2013 Shaw ..... E04F 15/04 52/97
2013/0048806 A1 2/2013 Fandel et al.
2013/0062481 A1* 3/2013 Petrakis ..... A47B 37/04 248/205.1
2013/0091788 A1* 4/2013 Lee ..... E04F 15/02161 52/177
2013/0174498 A1* 7/2013 Hovren ..... E04G 21/1891 52/105
2013/0219824 A1* 8/2013 Philbin ..... F16B 1/00 52/745.21
2013/0306633 A1 11/2013 Belinda et al.
2013/0340377 A1* 12/2013 Shadwell ..... E04F 15/02044 52/698
2014/0017423 A1* 1/2014 Veazey ..... E04H 12/2269 428/34.1
2014/0084123 A1* 3/2014 Fields ..... A47B 47/00 248/318
2014/0318065 A1* 10/2014 Torres-Pinzon ..... E04F 15/02044 52/403.1
2014/0332745 A1* 11/2014 Marconi ..... E04F 11/1859 256/68
2014/0339487 A1* 11/2014 Robinson ..... E04H 17/22 256/65.14
2015/0000570 A1* 1/2015 Day ..... B65D 19/44 108/55.1
2015/0030798 A1* 1/2015 Ben-Ezri ..... E04F 15/02194 428/64.1
2015/0107184 A1* 4/2015 Nichols, Jr. ..... E04G 21/3276 52/710
2015/0368911 A1* 12/2015 Kuijper ..... E04F 15/02044 52/483.1
2016/0018206 A1* 1/2016 Hollis ..... G01C 9/34 33/354
2016/0068302 A1* 3/2016 Clark ..... B65D 19/0085 108/57.32
2016/0348378 A1* 12/2016 Stahl ..... E04F 15/02183
2017/0138039 A1* 5/2017 Doupe ..... E04B 1/2612
2017/0349324 A1* 12/2017 Golanowski ..... B65D 7/065
2018/0058086 A1* 3/2018 Hubbard ..... E04B 1/98
2018/0171643 A1* 6/2018 Wilbs ..... E04F 15/02183
2018/0224061 A1* 8/2018 Szmyr ..... E04H 12/2269
2019/0128066 A1* 5/2019 Tombragel ..... E06C 7/46
2019/0234040 A1* 8/2019 Surges ..... E02D 27/52
2019/0234081 A1* 8/2019 Huang ..... E04F 15/105
2019/0344427 A1* 11/2019 Solberg ..... B25H 7/02
2019/0360202 A1* 11/2019 Burt ..... E04B 1/003
2020/0018064 A1* 1/2020 Kelly ..... E04B 5/046
2020/0048963 A1* 2/2020 Stevens, Jr. ..... E06C 7/46
2020/0109567 A1* 4/2020 Burt ..... E04F 11/1041
2020/0181910 A1* 6/2020 McManus ..... E04D 13/12
2020/0181919 A1* 6/2020 Erickson ..... E04F 11/002
2020/0308855 A1* 10/2020 Dicaire ..... B25C 7/00
2020/0340252 A1* 10/2020 Carlson ..... E04B 5/02
2020/0340256 A1* 10/2020 Lee ..... E04F 15/04
2020/0391408 A1* 12/2020 Albano ..... E04G 17/001
2021/0054636 A1* 2/2021 Gillis ..... E04F 21/22
2021/0088180 A1* 3/2021 Thompson ..... E04F 15/00
2021/0102384 A1* 4/2021 Haas ..... E04F 21/22

FOREIGN PATENT DOCUMENTS

FR 2754438 A1 * 4/1998
JP 4272788 B2 6/2009
WO WO-2011112142 A1 * 9/2011
WO 2018158307 A1 9/2018
WO WO-2021119509 A1 * 6/2021

* cited by examiner

LOAD DISTRIBUTING DECK INSERT

CROSS-REFERENCE TO RELATED APPLICATIONS

This application claims priority to U.S. Provisional Application No. 62/948,185 filed Dec. 13, 2019, and U.S. Provisional Application No. 63/082,879, filed Sep. 24, 2020, the contents of which are incorporated by reference in their entireties.

TECHNICAL FIELD

The present disclosure is directed to the area and field of decks. More specifically, the present disclosure relates to load supporting devices that elevate and/or support loads above the top surface of a deck or similar surfaces.

BACKGROUND

Decks are ubiquitous, especially as backyard decks in homes. Decks are also provided in commercial applications. They are the ideal outdoor space for entertaining guests. When the weather is nice, they are the perfect outdoor area to host a family dinner, a neighborhood gathering, or a barbecue. Decks give their owners the opportunity to enjoy the sunshine in a living room type setting.

Home buyers and business (e.g., service and retail-oriented businesses) love decks. Consumers love seeing beautifully appointed, family-oriented outdoor spaces attached to homes. Decks help them picture themselves living in and using a home's outside space. Decks positively impact their owners' quality of life. As a result, decks increase the value of a home.

A deck is essentially an outdoor floor supported by a frame, posts, and footings seemed in the ground. Typically, it is assembled in stages and is built from the ground up. The deck may comprise decking boards that are typically 5/4" wood or composite wood. The decking boards are laid across and attached to a structural grid made of joists. The joists are horizontal framing members fastened to the frame to support the decking boards. The typical recommended standard for spacing decking boards is the size of a "16d" nail or roughly 3/16" to allow for proper drainage of water through the deck surface and to account for expansion of the deck boards themselves.

Decks must be kept clean. Not only because a clean deck is a beautiful deck, but because a clean deck lasts longer. If rot and grime set in, especially around places where various objects are placed on the deck, the deck will begin to deteriorate until it breaks downs and becomes a structural hazard. Flat pots, planters, barbeques, deck furniture and so on are often placed on decks for long periods of time. Dirt, dead leaves, moss, and grime will accumulate around their footprints to permanently stain and rot the deck and cause the deck to eventually fall apart. Especially when insufficient air circulation is available between objects and the deck. Even when decks are covered.

It takes a lot of work to keep a deck clean and prevent dirt and grime from accumulating. The cleaning process begins by lifting and removing all objects off the deck. Everything from flat pots and planters to barbeques and furniture must come off the deck. Thereafter, the cleaning process continues by scrubbing the deck with a mild cleaner or washing it with a power washer. But even a good scrubbing or power washing is oftentimes not enough to remove the stains that have been formed on the deck over time, resulting in a deck that is marred, disfigured, displeasing and disappointing.

Current solutions for elevating or supporting deck accessories are inadequate. Current solutions may be difficult to use on deck surfaces because of the manner of attachment, may destabilize the deck surface, may be incompatible with either small or large objects placed on decks, may compromise the deck because a concentrated load is applied to a single specific point. More importantly, the prior art still allows for the touching or contacting of the upper surface of the deck, because current solutions are either placed on or directly contact the deck floor boards. Therefore, current solutions do not eliminate deck staining, deterioration, and/or degradation.

For these reasons there exists a great need to address the staining, possible disfigurement, and degradation of decks caused by objects placed upon them. There exists a need to be able to position any size object on a deck without limitation or loss of stability, while at the same time preventing the accumulation of debris and grime and mold and mildew on the deck, at the object' s footprint. There is a need for a deck inserting device that will be secure, stable and versatile to use with any object desired to be placed on a deck, while supporting the object above the top surface of the deck floor boards. Thus, a need exists for a manner to support deck accessories while preventing the accumulation of dirt and grime, the formation of mildew, mold, and/or fungus on substrata and/or on the deck surfaces and decking boards.

BRIEF SUMMARY

According to an embodiment, a load distributing deck insert may include a body; a saddle at a lower end of the body, the saddle comprising a first end and a second end opposite the first end; and a load receiving section at an upper end of the body, wherein a lower surface of the first end of the saddle is configured to rest on an upper surface of a first joist and a lower surface of the second end of the saddle is configured to rest on an upper surface of a second, wherein the body and the saddle are configured to be installed in a space between adjacent deck boards, wherein the body, the saddle, and the load receiving section are arranged such that the body, the saddle, and the load receiving section avoid contacting an upper surface of the adjacent deck boards, and wherein the load receiving section is configured to support an object above the upper surface of the adjacent deck boards.

According to an embodiment, the saddle further includes a curved middle section connecting the first end to the second end.

According to an embodiment, the load distributing deck insert includes second saddle at a lower end of a second body, the second saddle comprising a third end and a fourth end opposite the third end, wherein an upper surface of the body and the second body are connected to a lower surface of the load receiving section.

According to an embodiment, the saddle includes a first curved middle section connecting the first end to the second end and a second curved middle section connecting the third end to the fourth end.

According to an embodiment, the saddle includes a first curved middle section connecting the first end to the second end and the second saddle comprising a second curved middle section connecting the third end to the fourth end.

According to an embodiment, the first end and the third end are configured to rest on the upper surface of the first joist and the second end and the fourth end are configured to rest on the upper surface of the second joist.

According to an embodiment, the second body and second saddle are configured to be placed between one of the adjacent deck boards and a third deck board adjacent to the one of the adjacent deck boards.

According to an embodiment, the load receiving section is a planar member.

According to an embodiment, the load receiving section comprises an opening configured to receive an object.

According to an embodiment, a load distributing deck insert may include a body; a saddle at a lower end of the body, the saddle comprising a first end and a second end opposite the first end; and a load receiving section at an upper end of the body, wherein the saddle is configured to secure to one or more joists, wherein the body and the saddle are configured to be installed in a space between adjacent deck boards, wherein the body, the saddle, and the load receiving section are arranged such that the body, the saddle, and the load receiving section avoid contacting an upper surface of the adjacent deck boards, and wherein the load receiving section is configured to support an object above the upper surface of the adjacent deck boards.

According to an embodiment, the first end comprises a first leg and the second end comprises a second leg, the first leg and the second leg configured to extend around opposing sides of the one or more joists.

According to an embodiment, the first leg and the second leg are vertically extending downward from the body and wherein the first leg and the second leg are configured to frictionally engage the first joist.

According to an embodiment, the load distributing deck insert may include a second body and a second saddle, the second saddle including a third leg and a fourth leg, the third leg and the fourth leg extending vertically downward from the second body.

According to an embodiment, the body and the second body are located on opposing sides of the load receiving section and are coupled to a lower surface of the load receiving section.

According to an embodiment, the saddle and the second saddle are configured to extend over two joists.

According to an embodiment, the load receiving section comprises a cylindrical tube configured to hold a pole.

According to an embodiment, the saddle comprises an arch.

According to an embodiment, the saddle comprises an arch having at least one tooth protruding therefrom.

According to an embodiment, the saddle is offset from the load receiving section.

According to an embodiment, the load distributing deck further includes at least one sliding member coupled between the load receiving section and the body.

According to an embodiment, a load distributing deck insert may include a first body; a first saddle at a lower end of the first body, the first saddle comprising a first end connected to a second end opposite the first end with a curved middle portion; a second body; a second saddle at a lower end of the second body, the second saddle comprising a third end connected to a fourth end opposite the third end with a curved middle portion; and a planar load receiving section connected at an upper end of the first body and the second body, wherein a lower surface of the first end of the first saddle and a lower surface of the third end of the second saddle are configured to rest on an upper surface of a first joist and a lower surface of the second end of the first saddle and a lower end of the fourth end of the second saddle are configured to rest on an upper surface of a second joist, wherein the first body and the first saddle are configured to be installed in a space between a first deck board and a second deck board and the second body and the second saddle are configured to be installed in a space between the second deck board and a third deck board, and wherein the load distributing deck insert is configured to avoid contacting an upper surface of the first deck board, an upper surface of the second deck board, and an upper surface of the third deck board.

These and other objects, advantages, features, and characteristics of the disclosure will be apparent from the following description of the preferred embodiments, considered along with the accompanying drawings.

BRIEF DESCRIPTION OF THE DRAWINGS

It is believed that the present invention will be better understood from the following detailed description taken in conjunction with the accompanying drawings, in which the numerals represent identical elements and wherein.

DETAILED DESCRIPTION

Figure 1:
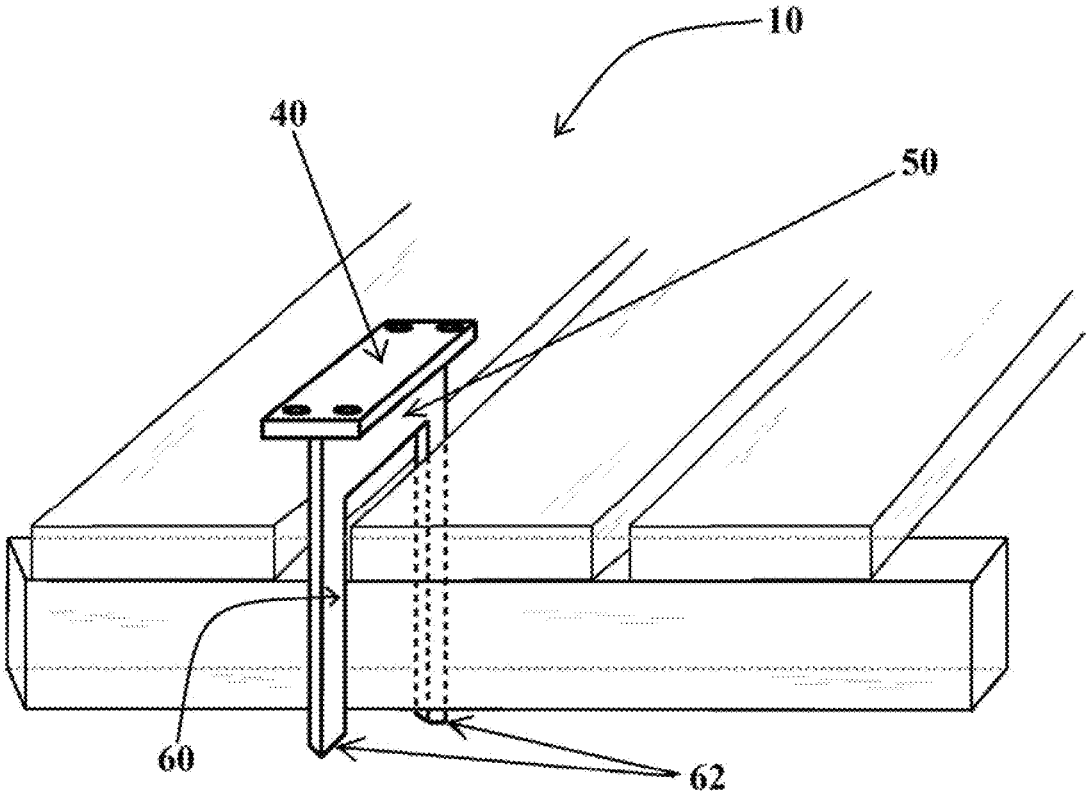
FIG. 1 is a is three-dimensional perspective of a load distributing deck insert with a sectioned deck, according to an embodiment of the disclosure.

Various embodiments of the invention are discussed in detail below. While specific embodiments are discussed, this is done for illustration purposes only. A person skilled in the relevant art will recognize that other components and configurations may be used without departing from the spirit and scope of the invention.

Referring to FIGS. 1-30, an embodiment of a deck insert 10 is shown. The deck insert 10 may be a load distributing deck insert 10. The deck insert 10 may be capable of saddling a joist 30 of a deck. That is, the body of the deck insert 10 may extend over the joist 30. The deck insert 10 may be placed in between the deck boards 20 to form a secure, stable, strong, and versatile receiving platform or receptacle (e.g., load receiving section 40), for the placement of any object (not depicted) desired to be placed on a deck, above the surface of the deck. This allows use of the object without contacting the deck's upper surface. It allows air to circulate around and under the object that may otherwise cause stains or damage. Thus, the deck insert 10 allows aeration. The deck insert 10 may touch the side surfaces of the deck boards 20. However, the deck insert 10 may be arranged to avoid contact of the deck insert 10 with the top surface of the deck boards 20. In other words, the deck insert 10 may not touch the upper or top surface of the deck boards 20 (e.g., the surface exposed to the consumer) or may minimally touch (e.g., at an interior corner only) the upper or top surface of the deck boards 20.

In the exemplary load distributing deck insert shown in FIGS. 1-6, the deck insert 10 comprises a top load receiving section 40, a bottom saddle section 60 and a center body section 50 disposed therebetween. All three sections are collinearly arranged along the load distributing deck insect's longitudinal y-axis. The load distributing deck insert 10 may be made of any material that may provide strength and support. The load distributing deck insert 10 material may be, for example, but not limited to, metal, a strong metal such as heavy gauge aluminum or steel, plastic, polymer, a hardened plastic, wood, composite, other materials, or combinations thereof. The thickness of the load distributing deck insert 10 may be such that the load distributing deck insert 10 does not exceed the width of a gap between two deck floorboards 20. This may allow the deck insert 10 to be inserted into at least one gap between the deck boards 20.

Figure 4:
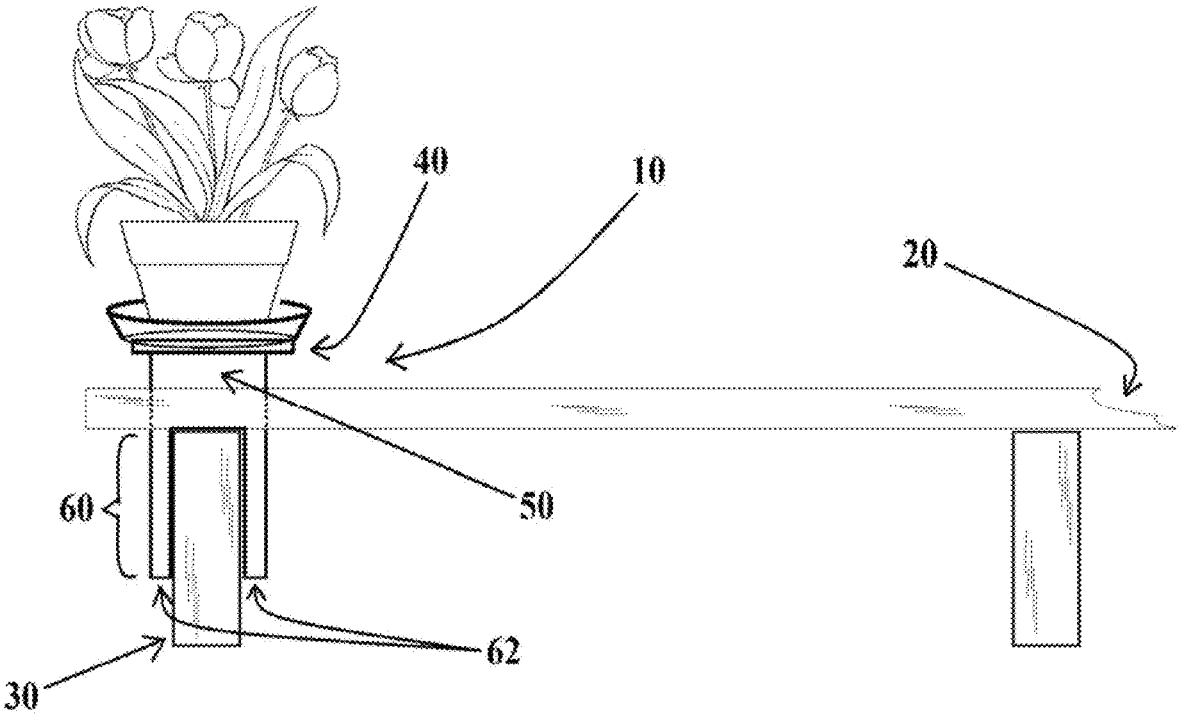
FIG. 4 is a front view of a load distributing deck insert having a loaded force applied upon it and saddled on a joist of a sectioned deck, according to an embodiment of the disclosure.
Figure 5:
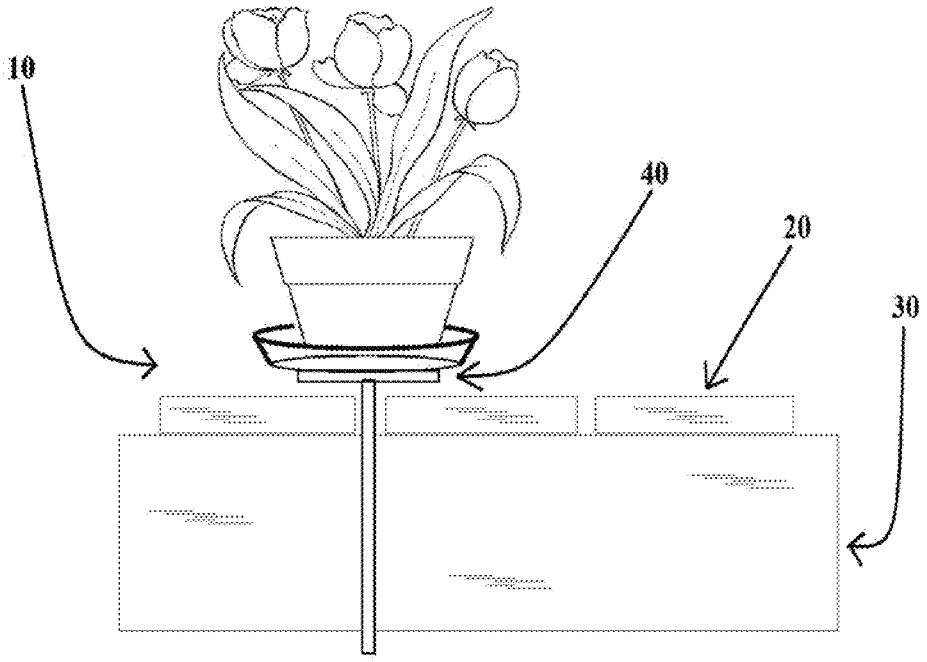
FIG. 5 is a side view of the load distributing deck insert having a loaded force applied upon it and saddled on a joist of a deck of FIG. 4, according to an embodiment of the disclosure.
Figure 6:
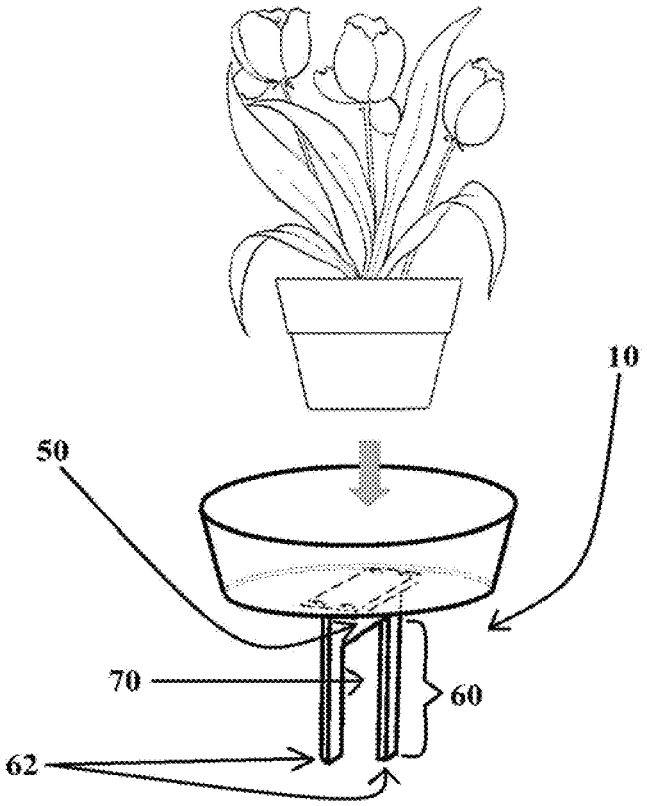
FIG. 6 is a three-dimensional perspective view of a load distributing deck insert having a loaded force applied upon the insert, according to an embodiment of the disclosure.
Figure 7:
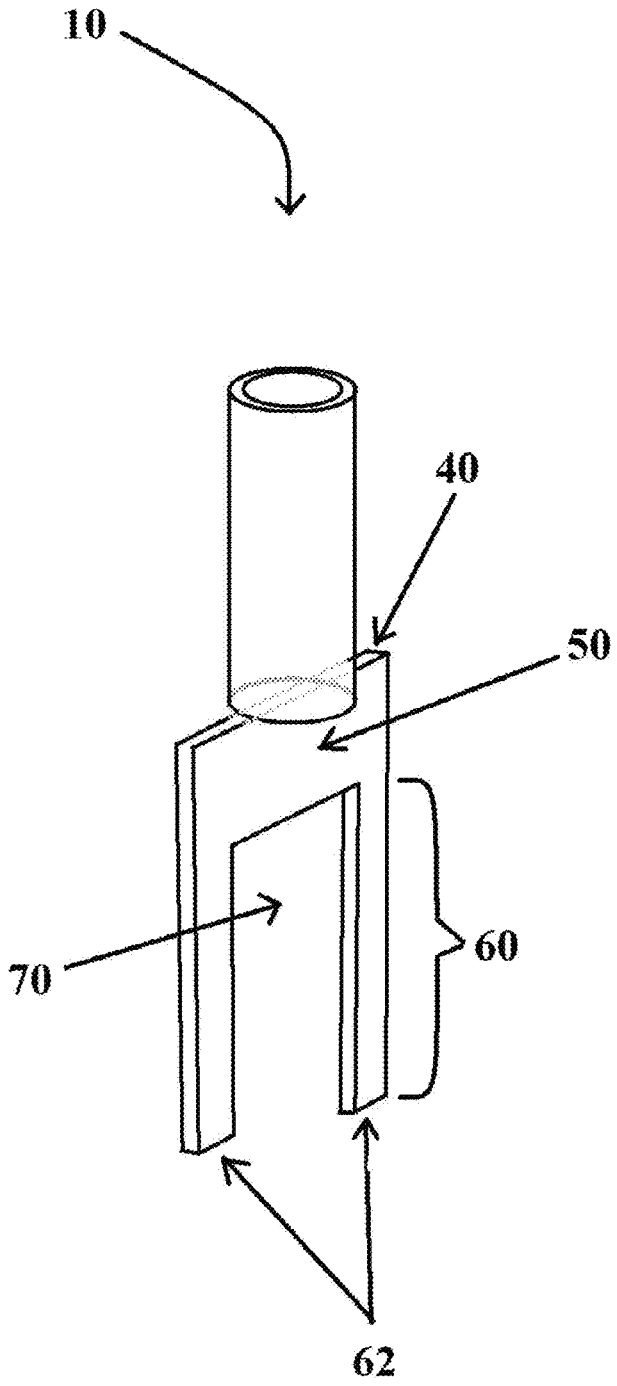
FIG. 7 is a three-dimensional perspective of a load distributing deck insert, according to an embodiment of the disclosure.
Figure 8:
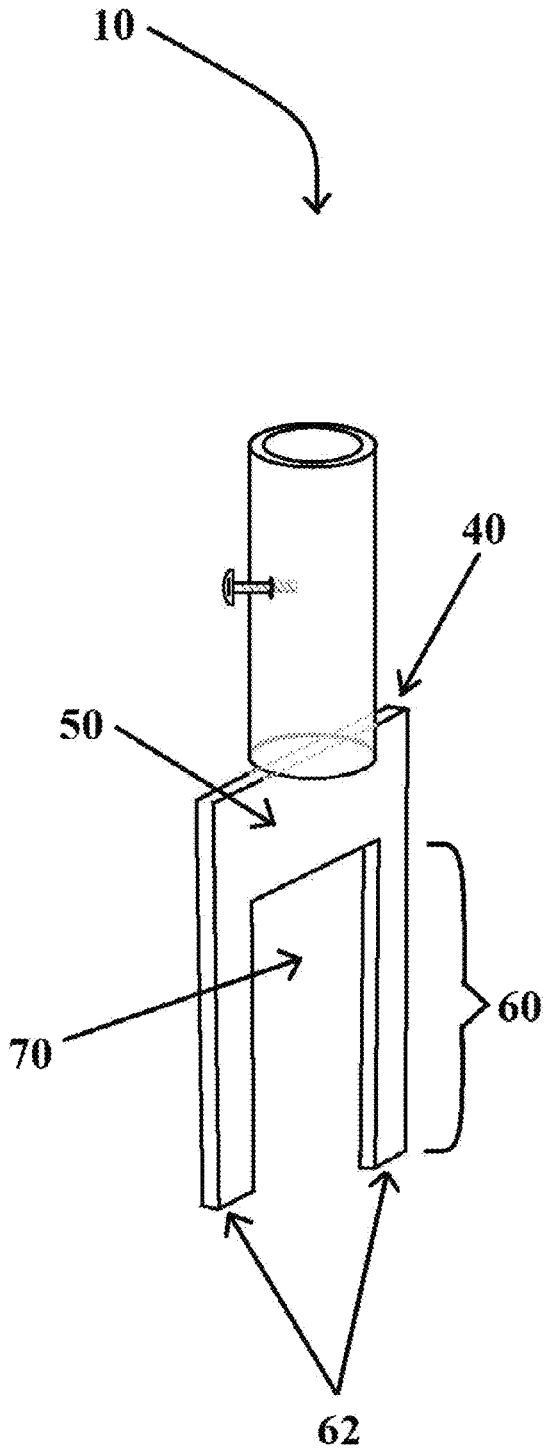
FIG. 8 is a three-dimensional perspective of the load distributing deck insert of FIG. 7, according to an embodiment of the disclosure.
Figure 9:
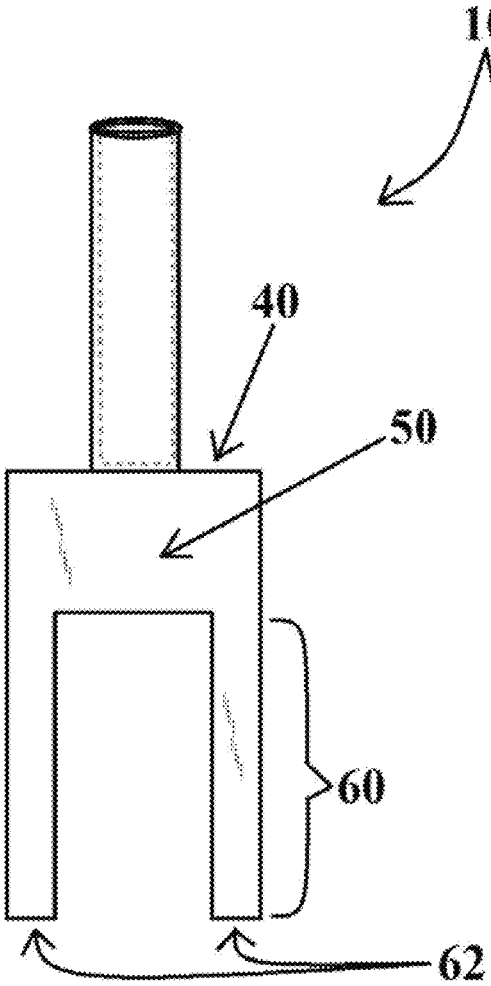
FIG. 9 is a front plan view of the load distributing deck insert of FIG. 7, according to an embodiment of the disclosure.
Figure 9A:
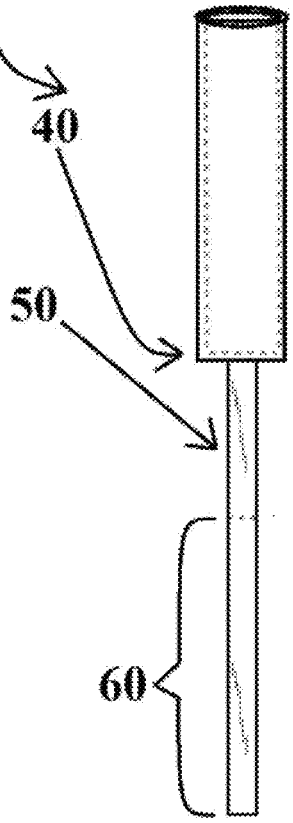
FIG. 9*a* is a side plan view of the load distributing deck insert of FIG. 9, according to an embodiment of the disclosure.
Figure 9B:
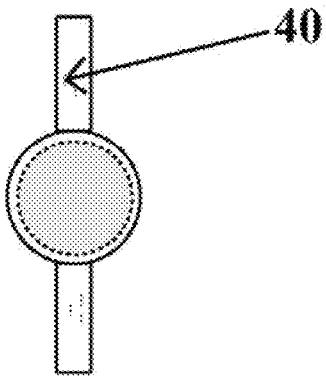
FIG. 9*b* is a bottom plan view of the load distributing deck insert of FIG. 9, according to an embodiment of the disclosure.
Figure 9C:
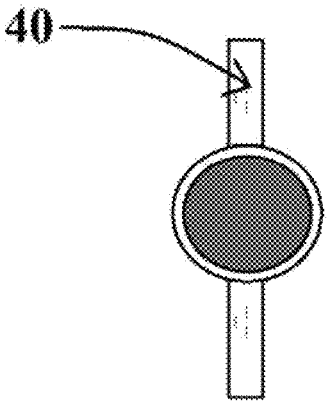
FIG. 9*c* is a top plan view of the load distributing deck insert of FIG. 9, according to an embodiment of the disclosure.
Figure 10A:
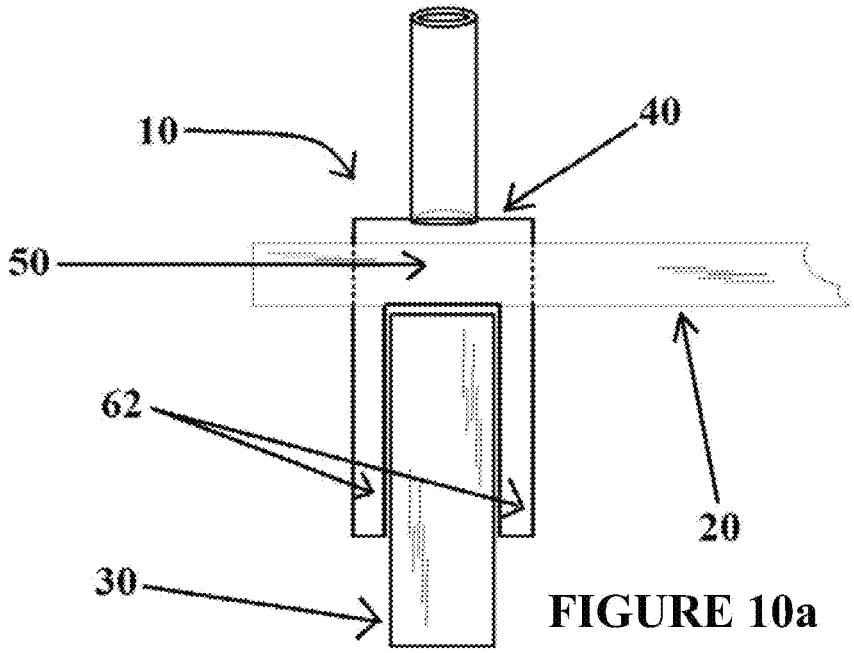
FIG. 10*a* is a front view of the load distributing deck insert of FIGS. 8-9 saddled onto a joist of a sectioned deck, according to an embodiment of the disclosure.
Figure 10B:
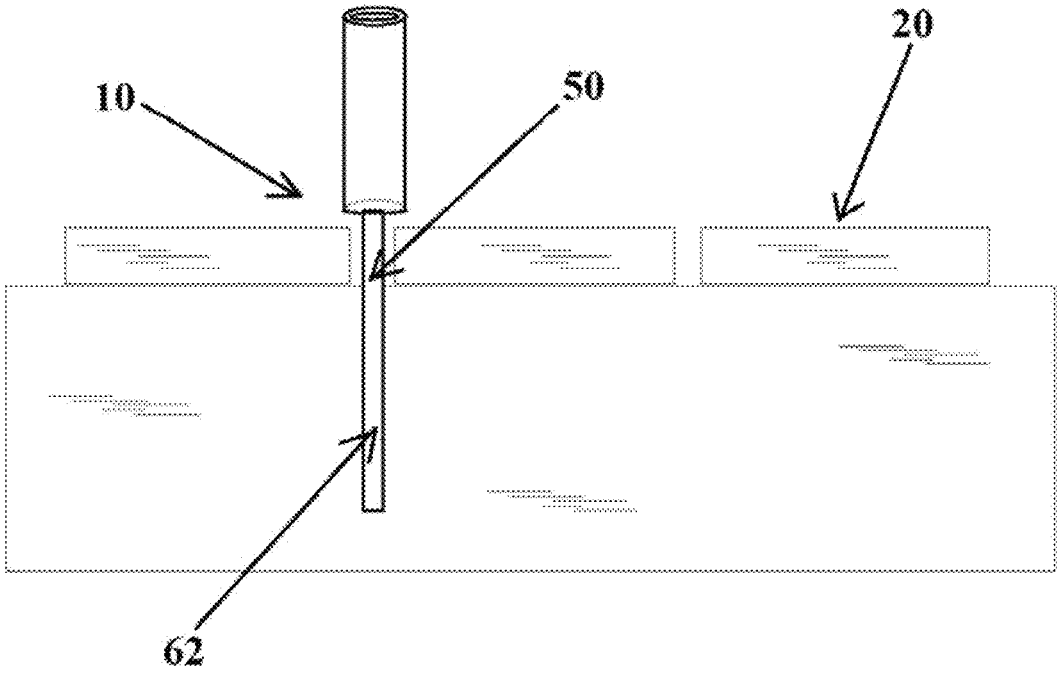
FIG. 10*b* is a side view of the load distributing deck insert of FIGS. 8-9 saddled onto a joist of a sectioned deck, according to an embodiment of the disclosure.
Figure 11A:
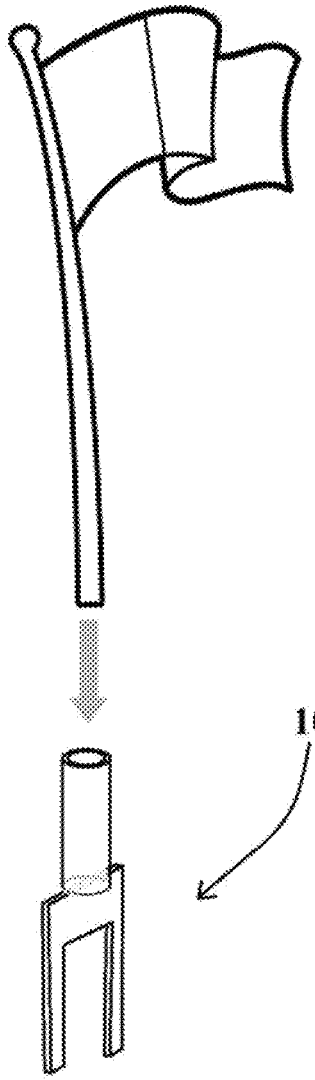
FIG. 11*a* is a perspective view of a load distributing deck inserting supporting a flag, according to an embodiment of the disclosure.
Figure 11B:
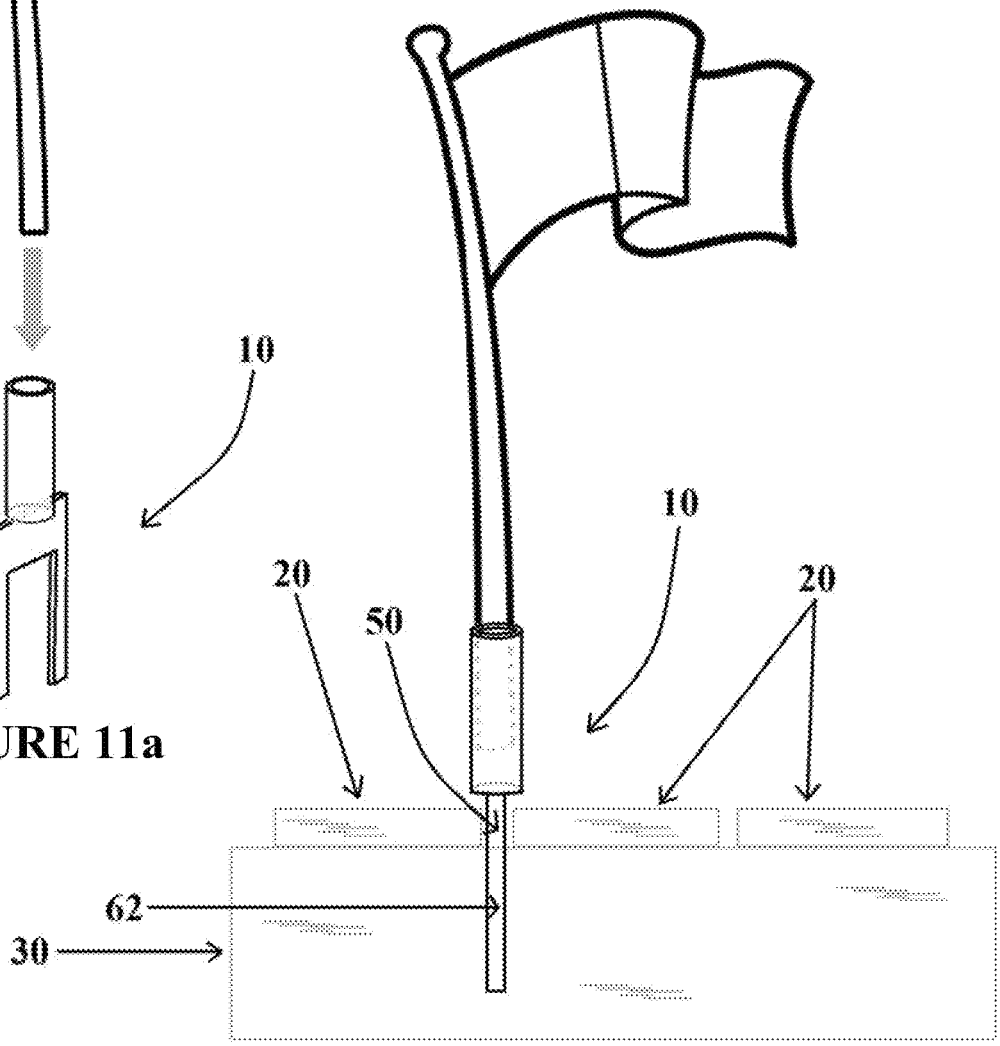
FIG. 11*b* is a side view of the load distributing deck insert of FIG. 11*a* saddled onto a joist of a sectioned deck and used to support a flag, according to an embodiment of the disclosure.
Figure 12:
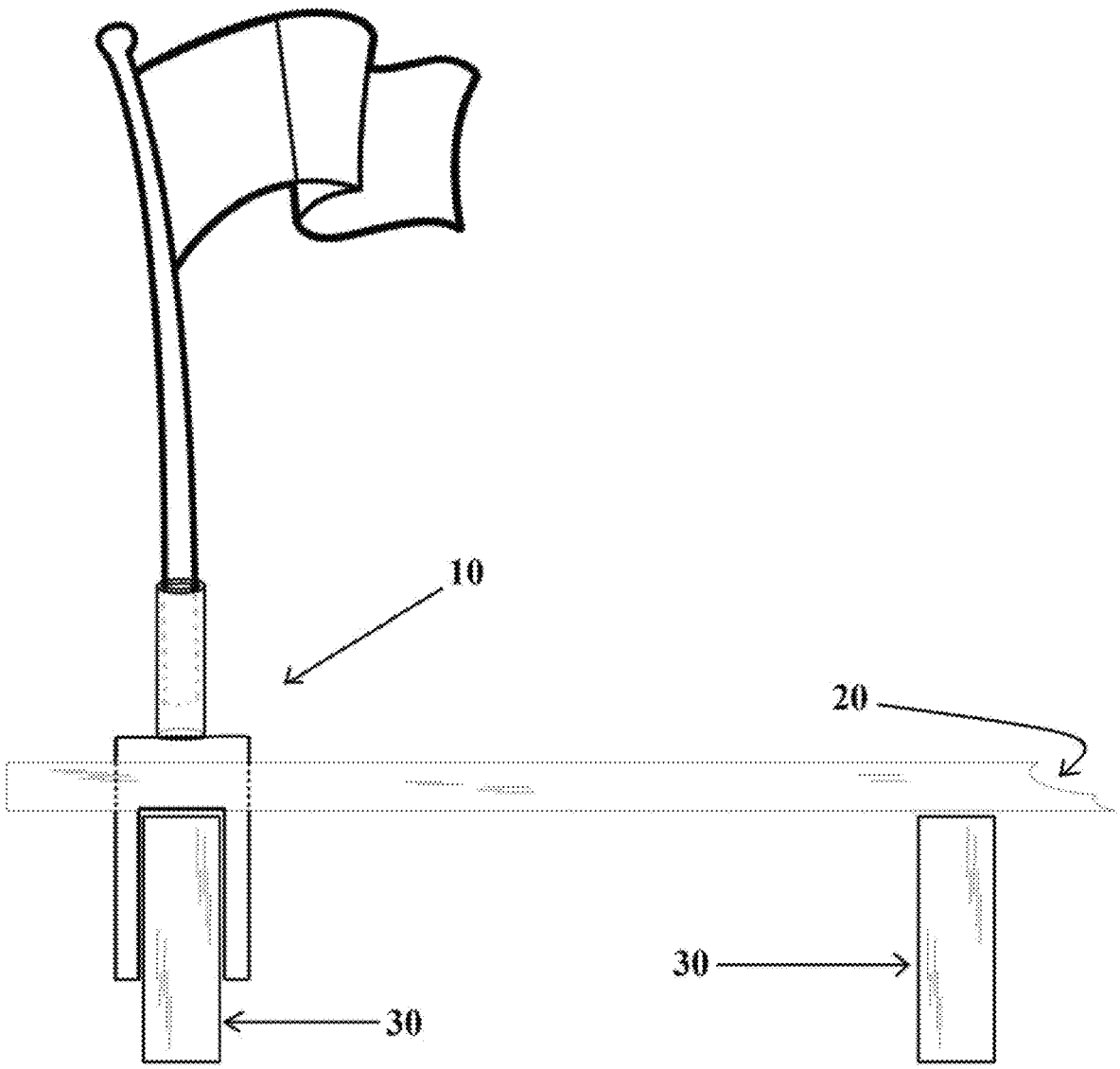
FIG. 12 is a front plan view of the load distributing deck insert of FIGS. 8-9 saddled onto a joist of a sectioned deck and used to support a flag, according to an embodiment of the disclosure.
Figure 13:
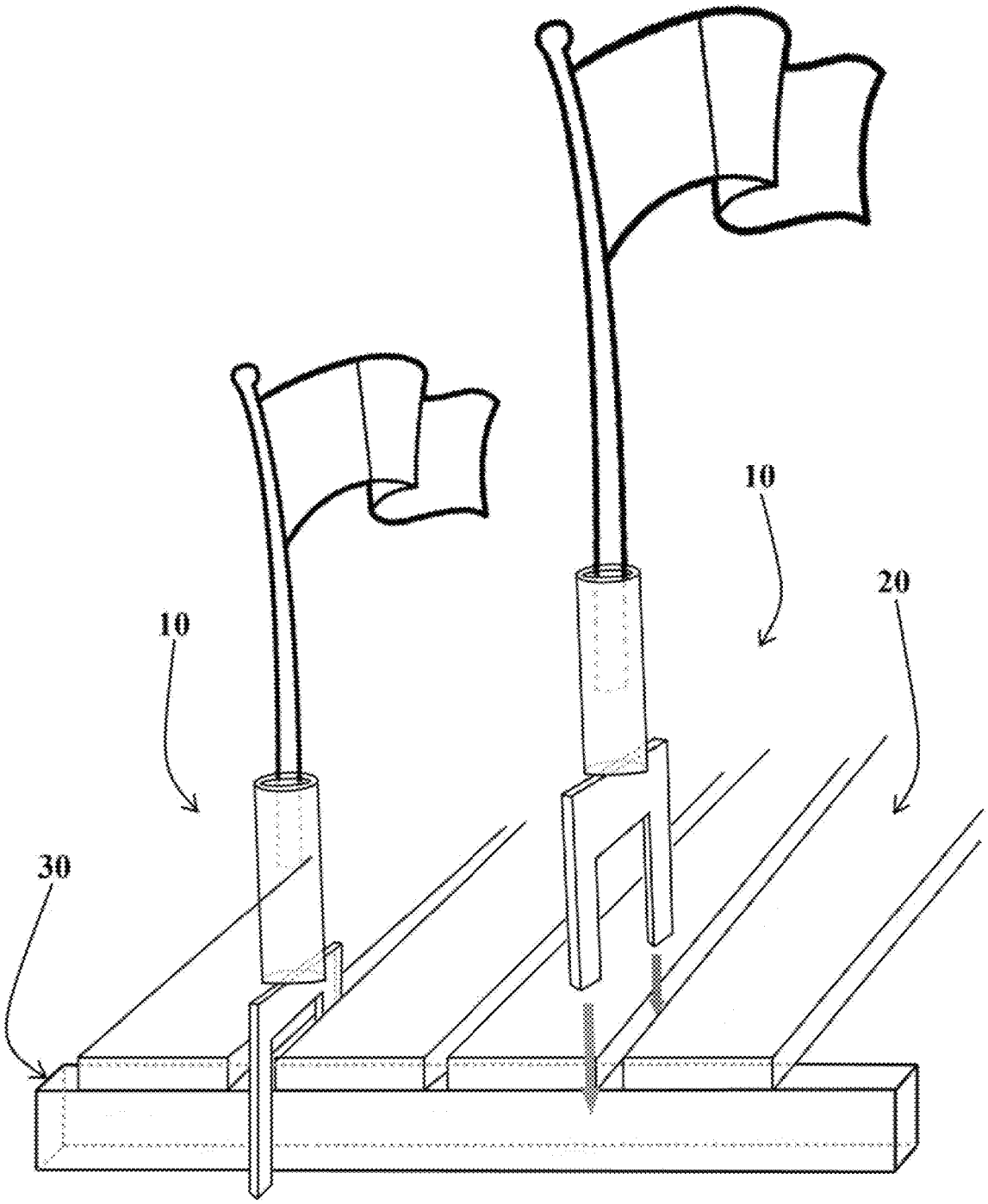
FIG. 13 consists of three-dimensional views of the load distributing deck insert of FIGS. 8-9 being saddled onto a joist of a sectioned deck and used to support a flag, according to an embodiment of the disclosure.
Figure 14:
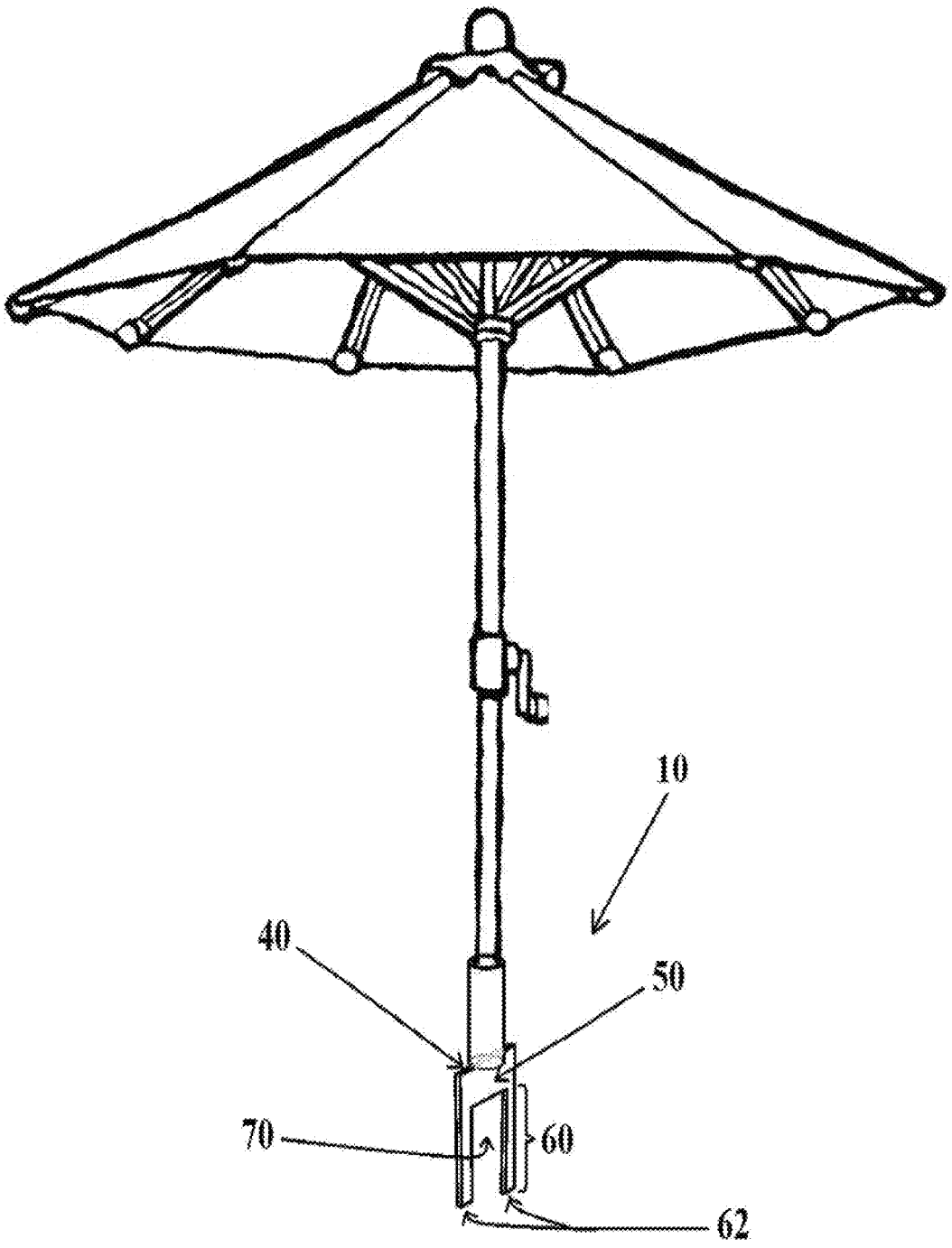
FIG. 14 is a three-dimensional view of a load distributing deck insert being used with a deck umbrella, according to an embodiment of the disclosure.
Figure 15:
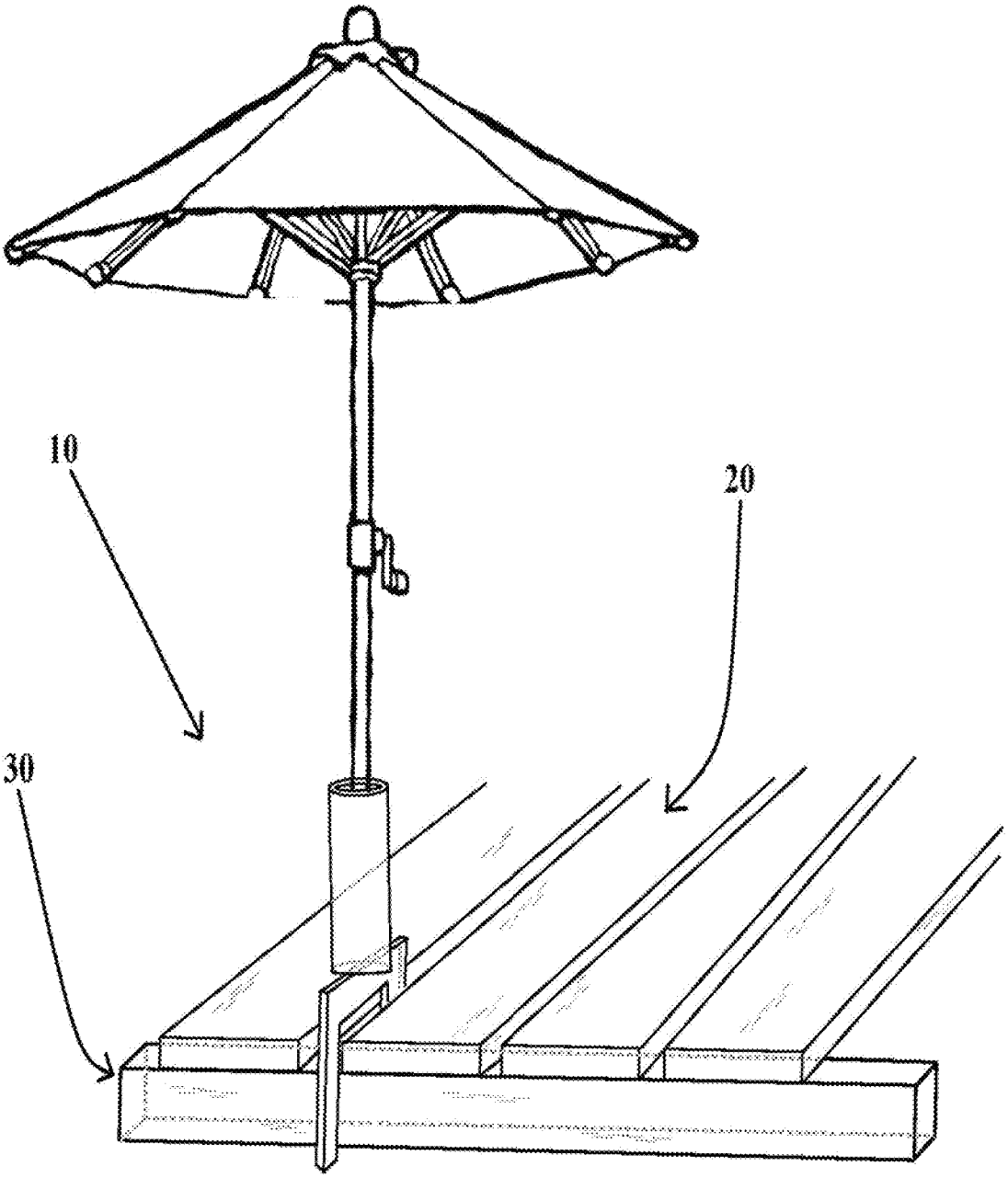
FIG. 15 is a three-dimensional view of the load distributing deck insert of FIG. 14 being used with a deck umbrella on a joist of a sectioned deck, according to an embodiment of the disclosure.

As is shown in FIGS. 4-6, the top load receiving section 40 may be outfitted with a flat platform-shaped receptacle such as a dish or a bowl capable of receiving for example, a flowerpot. See also FIG. 30. Alternatively, or additionally, as is shown in FIGS. 7-15, said load receiving section 40 can be provided with a long cylindrical receptacle having a partial bore and capable of acting as a support base for a flag or an umbrella. Use of the load distributing deck insert 10 may eliminate the need for a heavy umbrella base typically used to support an umbrella on a deck. Eliminating the heavy umbrella base may prevent the deck from getting stained, gouged, scratched or splintered, deteriorating, and/or degrading. Although shown with a single load receiving section 40, the deck insert 10 may be provided with more than one load receiving section 40. Where more than one load receiving section 40 is included, the shape and dimension of the load receiving section 40 may be the same or different. For example, the load receiving section 40 may include two flat receptacles such as shown in FIGS. 4-6. In an example, the load receiving section 40 may include a flat receptacle such as shown in FIGS. 4-6 and a cylindrical receptacle such as shown in FIGS. 7-15. Any number or combination of load receiving section shapes, sizes, dimensions, and/or orientations may be provided.

Figure 34A:
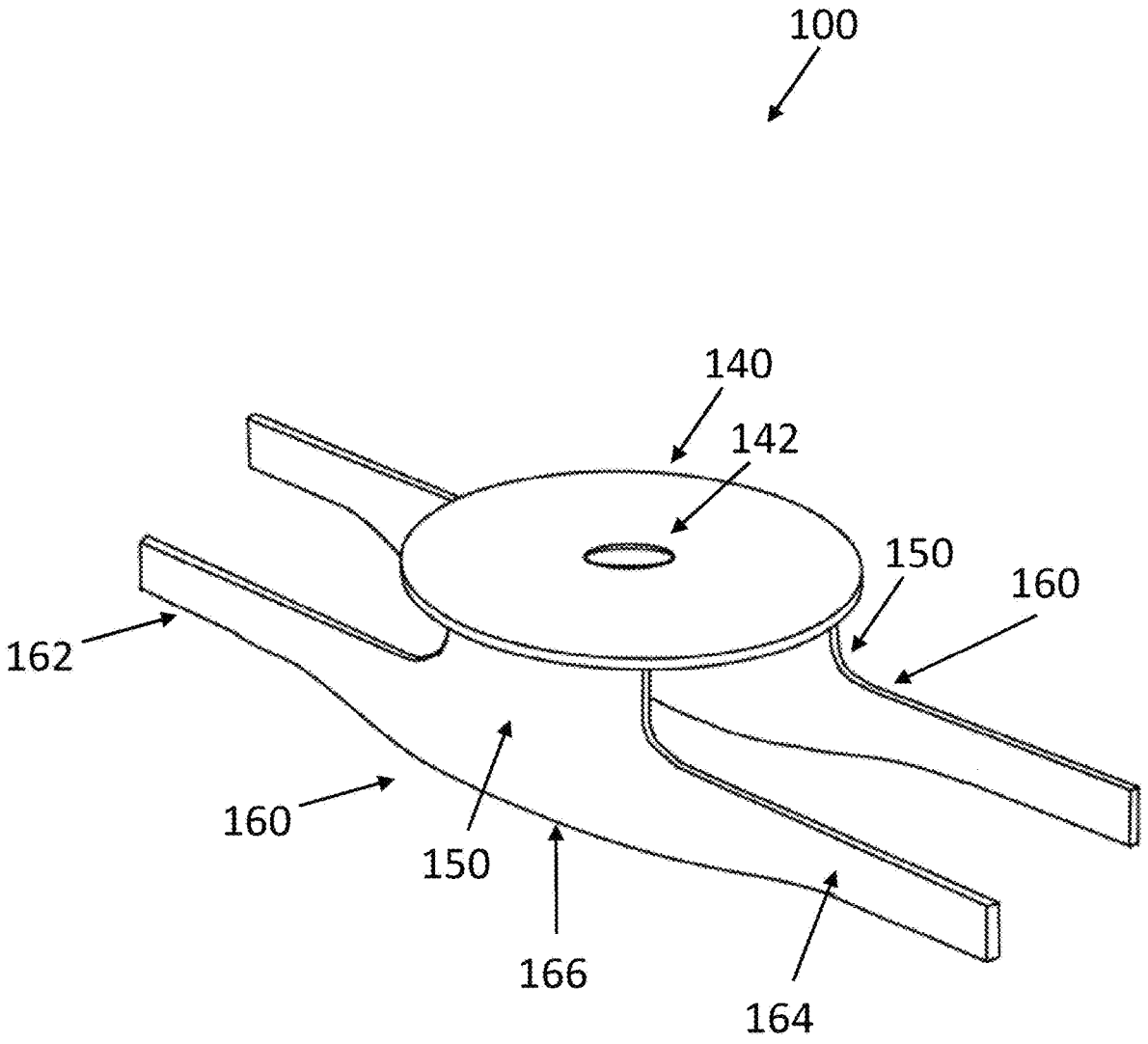
FIG. 34*a* is a perspective view of a load distributing deck insert, according to an embodiment of the disclosure.

As is shown in FIGS. 1-30, the deck insert 10 may include a center body section 50 and a bottom saddle section 60. The bottom saddle section may include two downwardly extending, spaced apart, vertical, parallel legs 62 and a lower edge. The lower edge of the center body section 50 and vertical parallel spaced-apart legs 62 ("saddle legs 62") extending therefrom, together define an arch 70, which arch together with the saddle legs 62 form the bottom saddle section 60. The arch 70 has a width sufficient to distribute the load force applied to said load receiving section 40 across multiple points along the width of the joist upon which the deck insert is saddled. Although two vertical parallel legs are shown, any number of legs may be provided. For example, the deck insert 10 may include three legs. Where three legs are provided, the deck insert 10 may be able to extend over three joists. For example, the deck insert 10 may include a single leg (e.g., FIG. 34*a*) that may extend between joists.

The arch 70 may or may not be curved. The arch 70 may contact one or both sides of a joist. The body 50 having legs 62 may be generally U-shaped, V-shaped, or other shapes that allow for the insert 10 to extend over a joist 30 as disclosed herein.

The process of saddling a joist 30 with the load distributing deck insert 10 comprises the following steps: a) orienting said bottom saddle section 60 between the edges of an end-long gap defined by the end-long deck floor boards 20 such that the horizontal plane defined by the bottom of said two saddle legs 62 runs parallel to the gap between the end-long deck floor boards 20; b) directing and inserting said bottom saddle section 60 into the gap between the end-long deck floor boards 20; and c) orienting the bottom saddle section 60 onto the joist 30.

When in place, the deck insert 10 may be frictionally mounted to the joist 30 such that each of said saddle legs 62 are frictionally but removably mounted on either side of the joist 30, which has been saddled by the deck insert 10. The joist 30 may be frictionally inserted between and partially encircled by the vertical saddle legs 62, which may be frictionally but removably attached on either side of said joist 30. The bottom saddle 60 may provide added stability to the deck insert 10. The bottom saddle may prevent any and all wobbling of the deck insert 10 thereby allowing for the support of any object (e.g., a deck accessory) above the surface of the deck. The load distributing deck insert 10 may allow the load receiving section 40 to extend above the top surface of the deck boards 20, thereby supporting any object the deck insert 10 receives without allowing the deck insert 10 to touch the deck. In an example, the deck insert 10 is secured to one or more joists 30. The deck insert 10 may be secured to one or more joists 30 frictionally and/or with a fastener.

Figure 16:
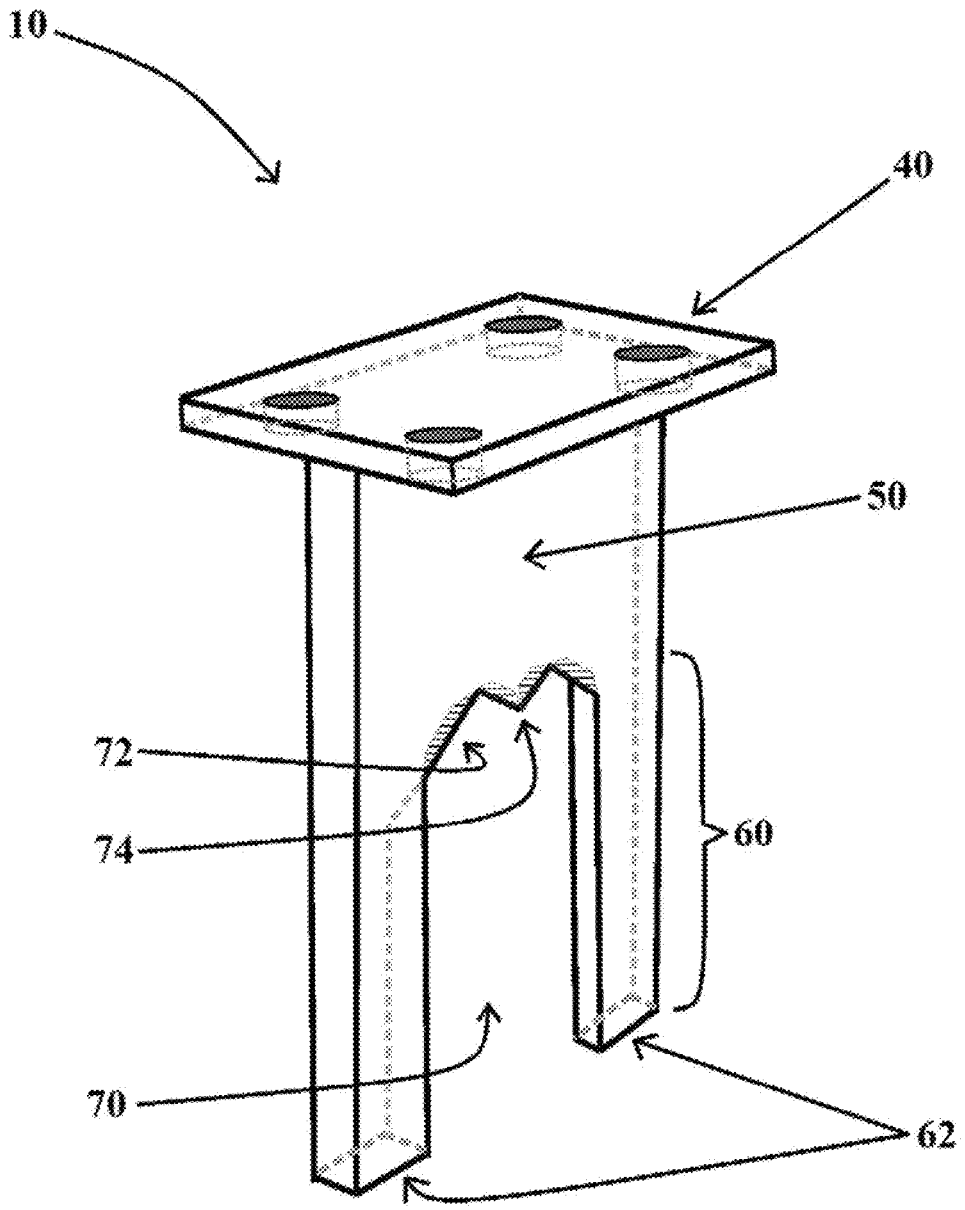
FIG. 16 is a three-dimensional perspective of a load distributing deck insert, according to an embodiment of the disclosure.
Figure 17:
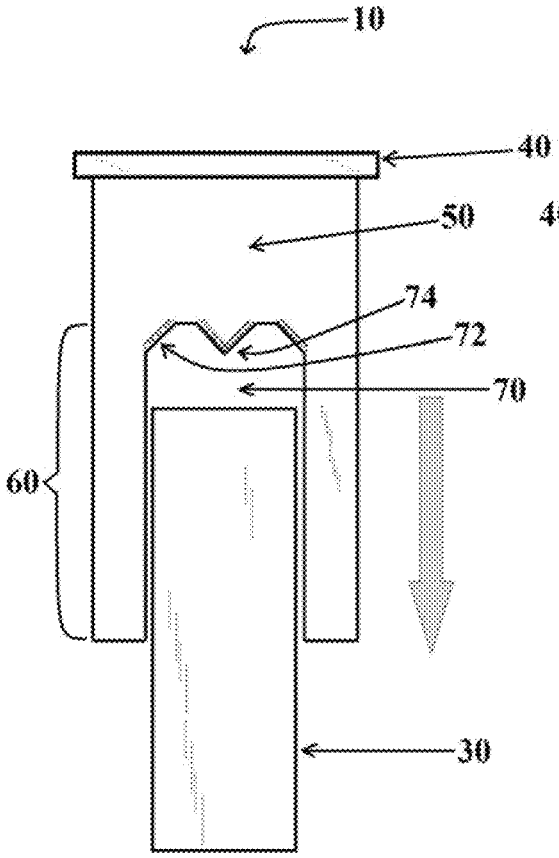
FIG. 17 is a front plan view of the load distributing deck insert of FIG. 16 partially mounted on a joist, according to an embodiment of the disclosure.
Figure 17A:
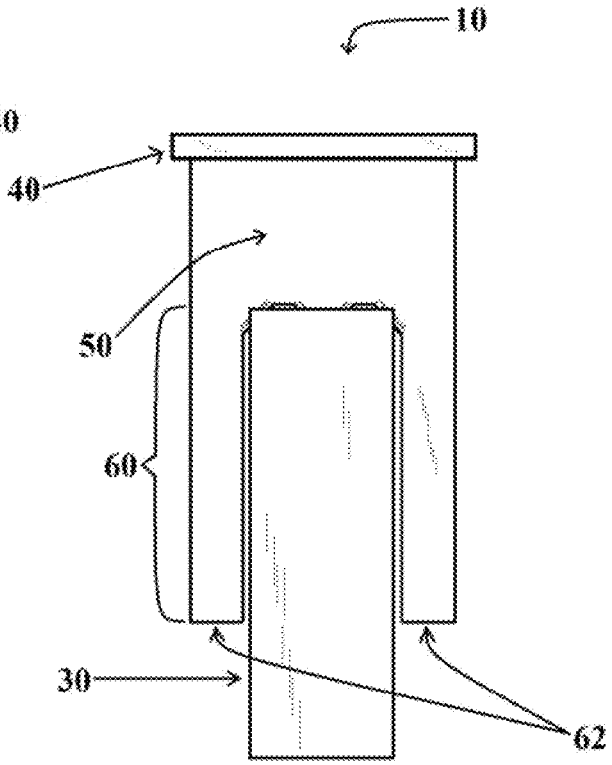
FIG. 17*a* is a front plan view of the load distributing deck insert of FIG. 17 fully mounted and anchored on said joist, according to an embodiment of the disclosure.
Figure 17B:
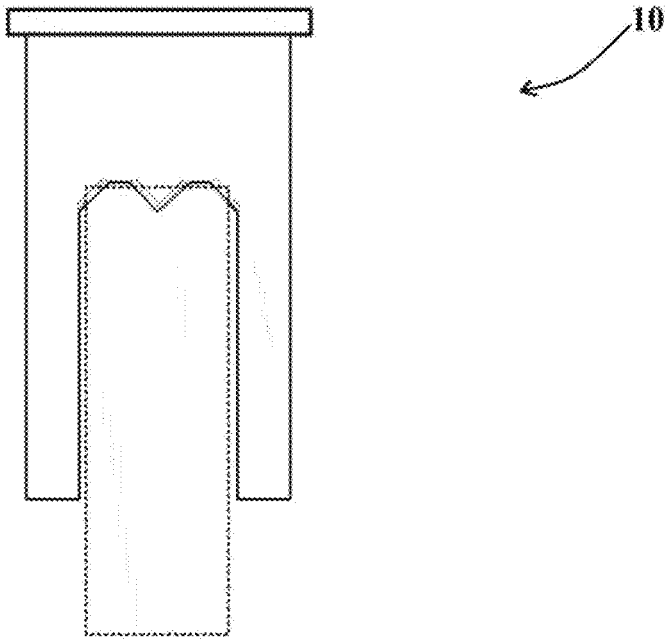
FIG. 17*b* is a rear plan view of the load distributing deck insert of FIG. 17 fully mounted and anchored on said joist, according to an embodiment of the disclosure.
Figure 18:
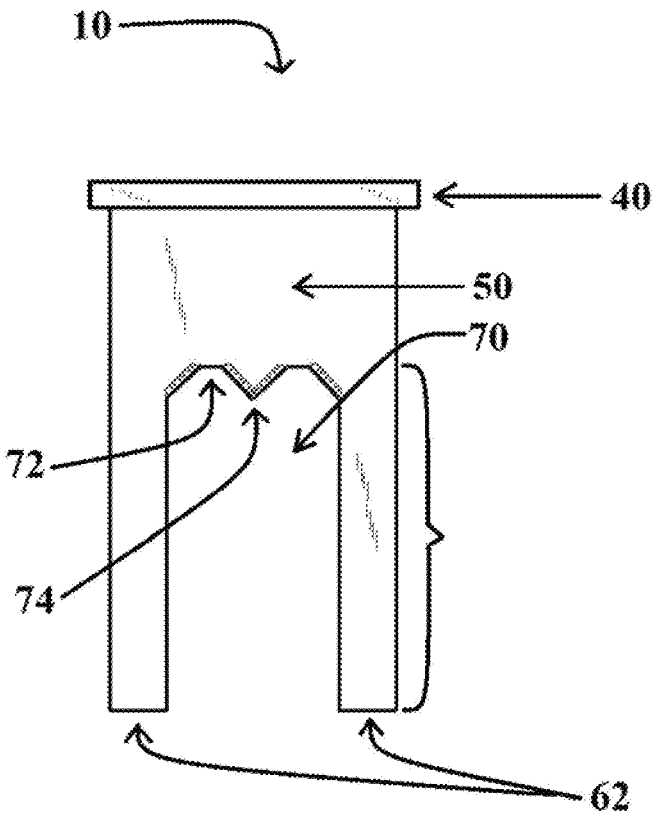
FIG. 18 is a front plan view of the load distributing deck insert of FIG. 16, according to an embodiment of the disclosure.
Figure 18A:
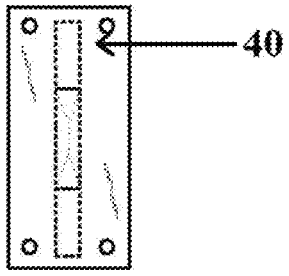
FIG. 18*a* is a top plan view of the load distributing deck insert of FIG. 16, according to an embodiment of the disclosure.
Figure 18B:
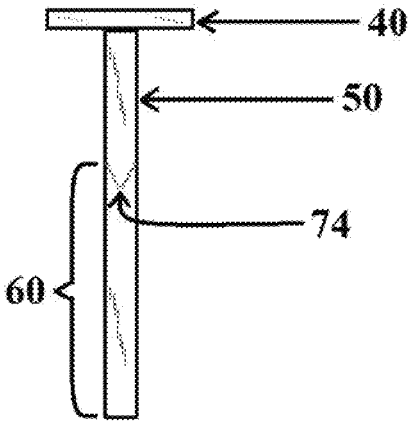
FIG. 18*b* is a side plan view of the load distributing deck insert of FIG. 16, according to an embodiment of the disclosure.
Figure 18C:
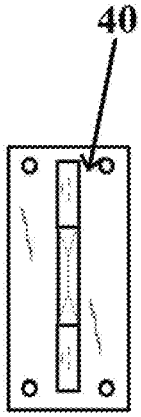
FIG. 18*c* is a bottom plan view of the load distributing deck insert of FIG. 16, according to an embodiment of the disclosure.
Figure 19:
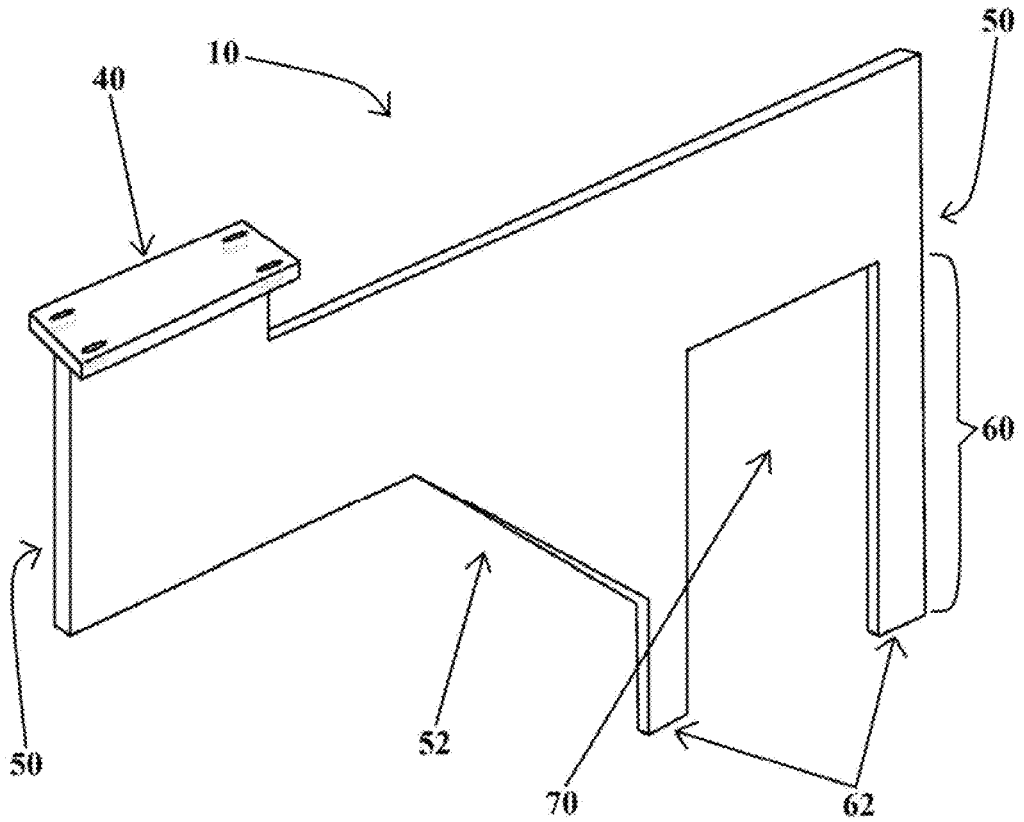
FIG. 19 is a three-dimensional perspective of load distributing deck insert, according to an embodiment of the disclosure.
Figure 20:
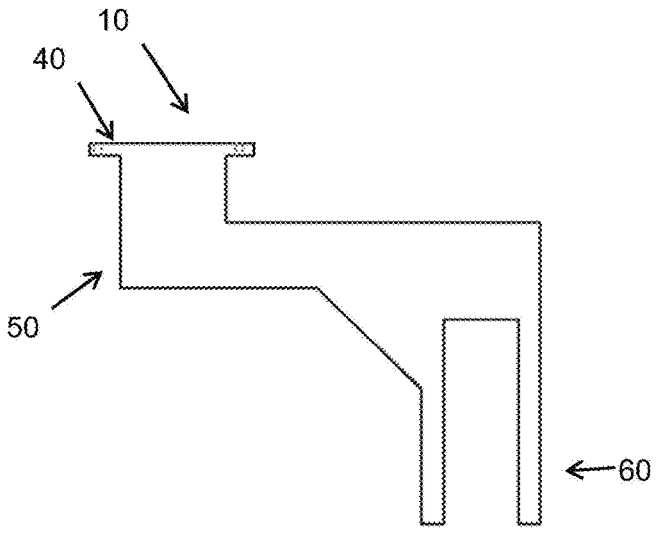
FIG. 20 is a front plan view of the load distributing deck insert of FIG. 19, according to an embodiment of the disclosure.
Figure 20B:
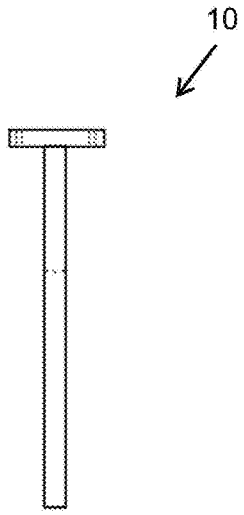
FIG. 20*b* is a side plan view of the load distributing deck insert of FIG. 20, according to an embodiment of the disclosure.
Figure 20A:
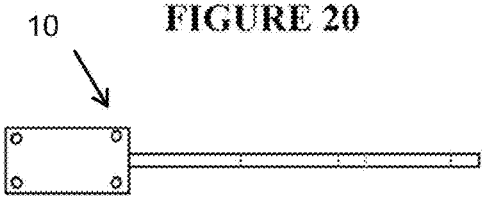
FIG. 20*a* is a top plan view of the load distributing deck insert of FIG. 20, according to an embodiment of the disclosure.
Figure 20C:
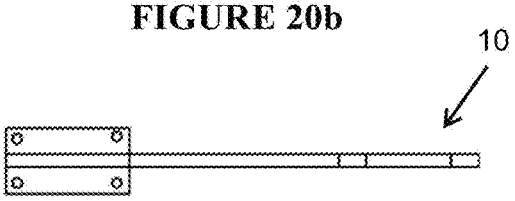
FIG. 20*c* is a bottom plan view of the load distributing deck insert of FIG. 20, according to an embodiment of the disclosure.
Figure 21:
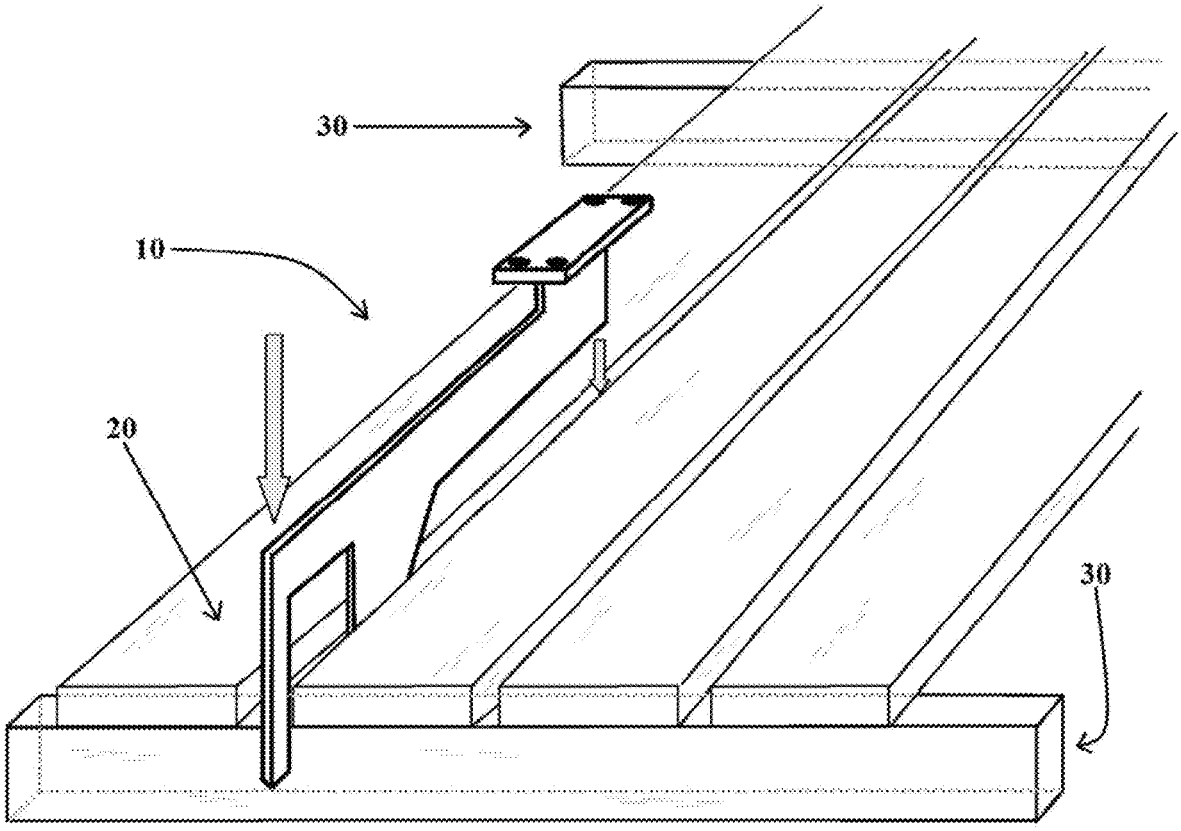
FIG. 21 is a three-dimensional view of the load distributing deck insert of FIG. 20 being saddled onto a joist of a sectioned deck, according to an embodiment of the disclosure.
Figure 22:
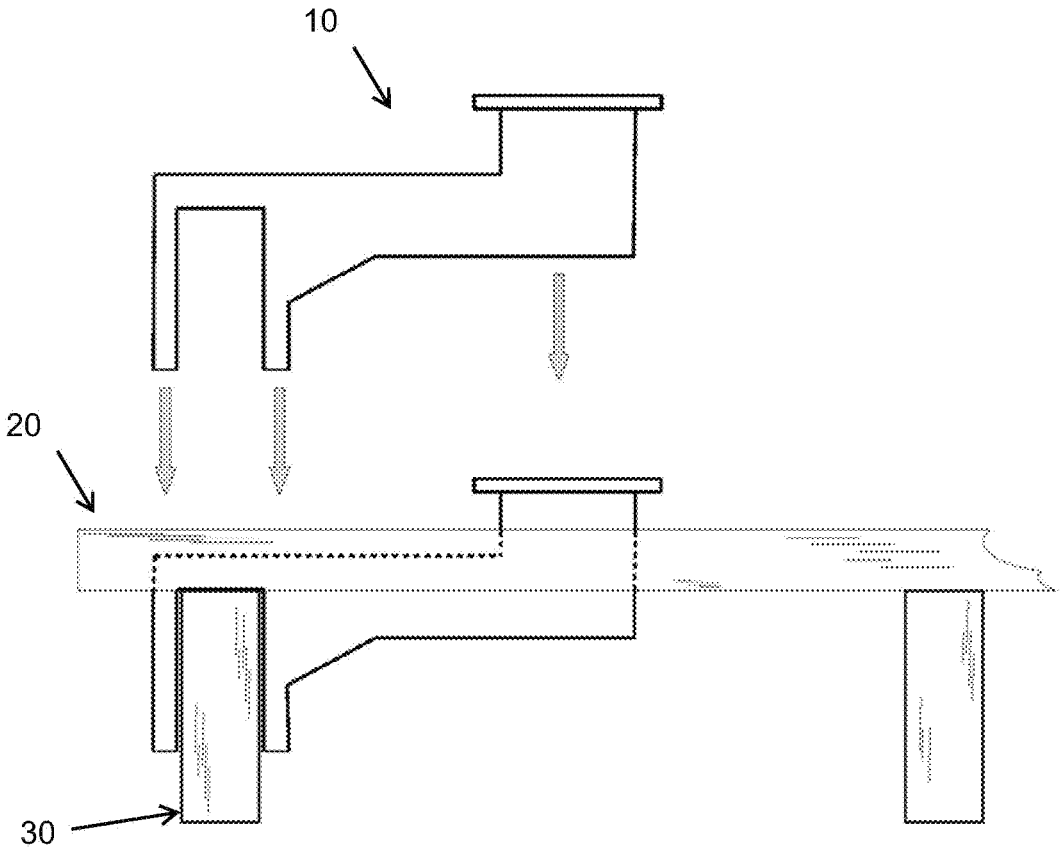
FIG. 22 is a front plan view of the load distributing deck insert of FIG. 20 being saddled onto a joist of a sectioned deck, according to an embodiment of the disclosure.
Figure 23:
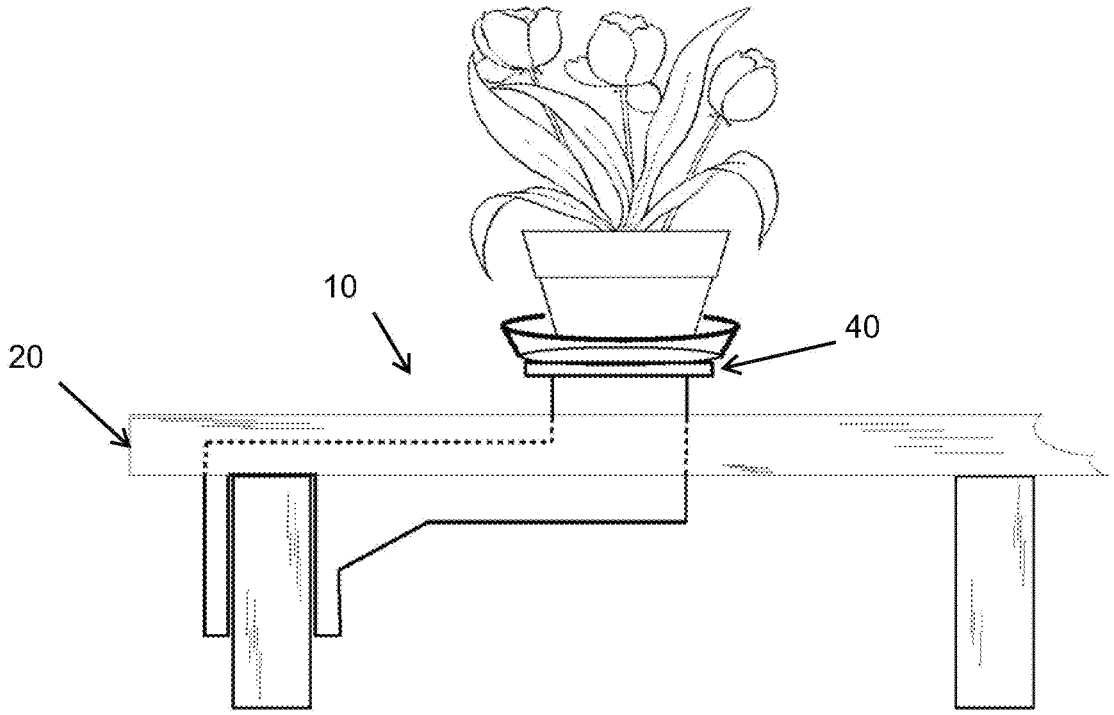
FIG. 23 is a front plan view of the load distributing deck insert of FIG. 20 being saddled onto a joist of a sectioned deck and provided with a loading force, according to an embodiment of the disclosure.
Figure 24:
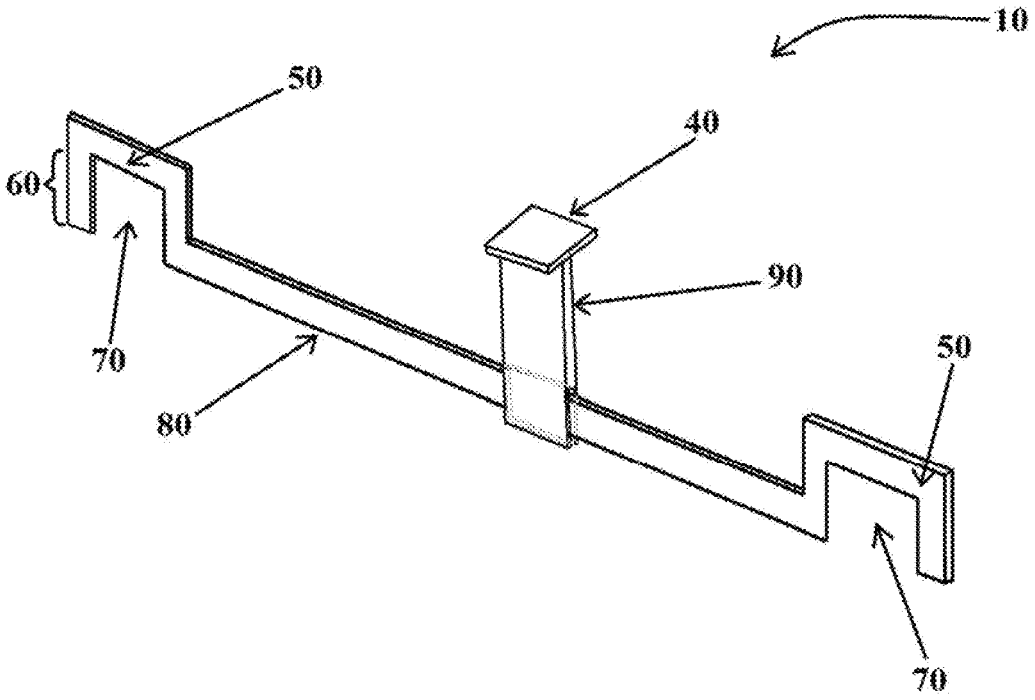
FIG. 24 is a three-dimensional perspective view of a load distributing deck insert, according to an embodiment of the disclosure.
Figure 25:
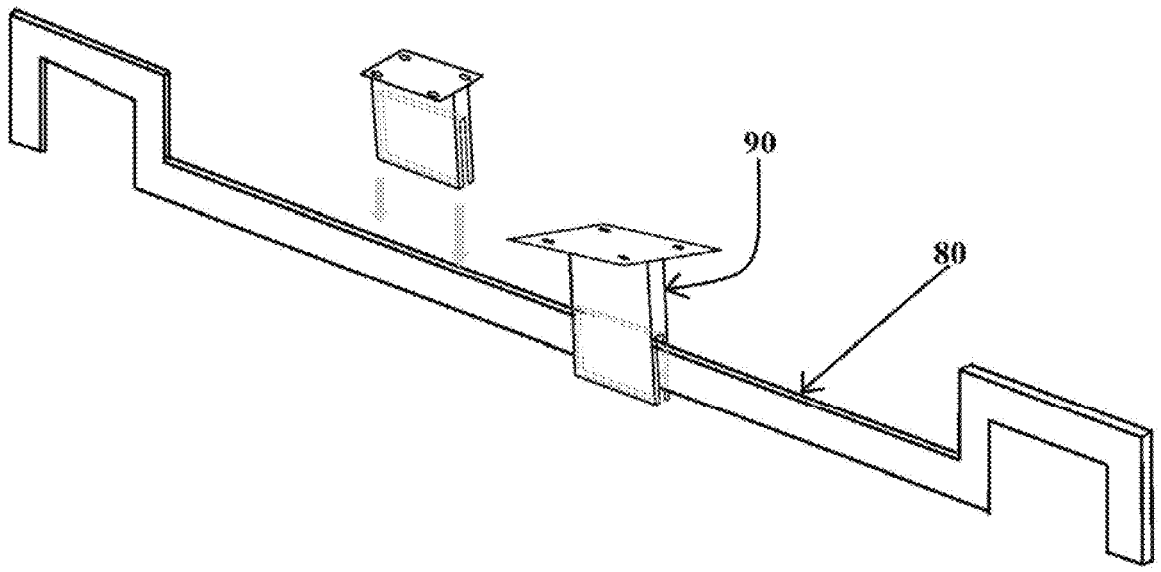
FIG. 25 is a three-dimensional perspective view of a load distributing deck insert, according to an embodiment of the disclosure.
Figure 26:
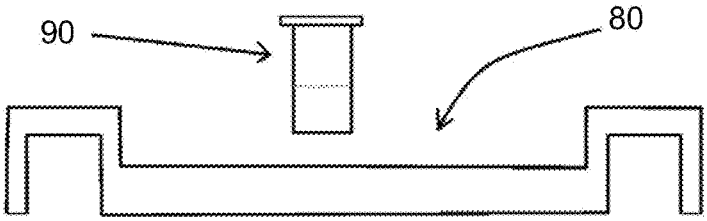
FIG. 26 is a front plan view of the load distributing deck insert of FIG. 24, according to an embodiment of the disclosure.
Figure 26B:
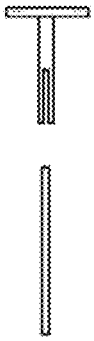
FIG. 26*b* is a side plan view of the load distributing deck insert of FIG. 24, according to an embodiment of the disclosure.
Figure 26A:
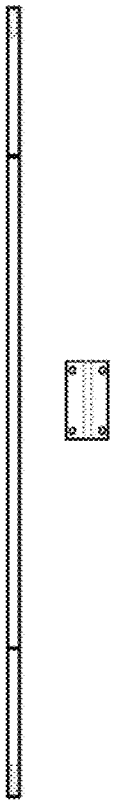
FIG. 26*a* is a top plan view of the load distributing deck insert of FIG. 24, according to an embodiment of the disclosure.
Figure 27:
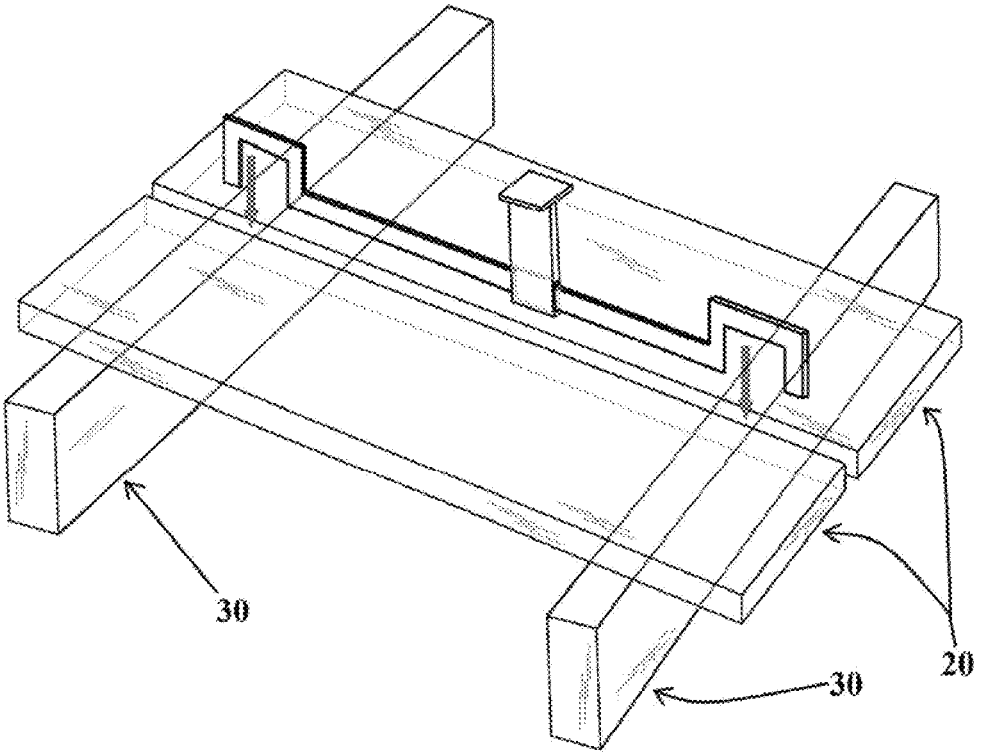
FIG. 27 is a three-dimensional view of the load distributing deck insert of FIG. 24 being saddled onto two joists of a sectioned deck, according to an embodiment of the disclosure.
Figure 28:
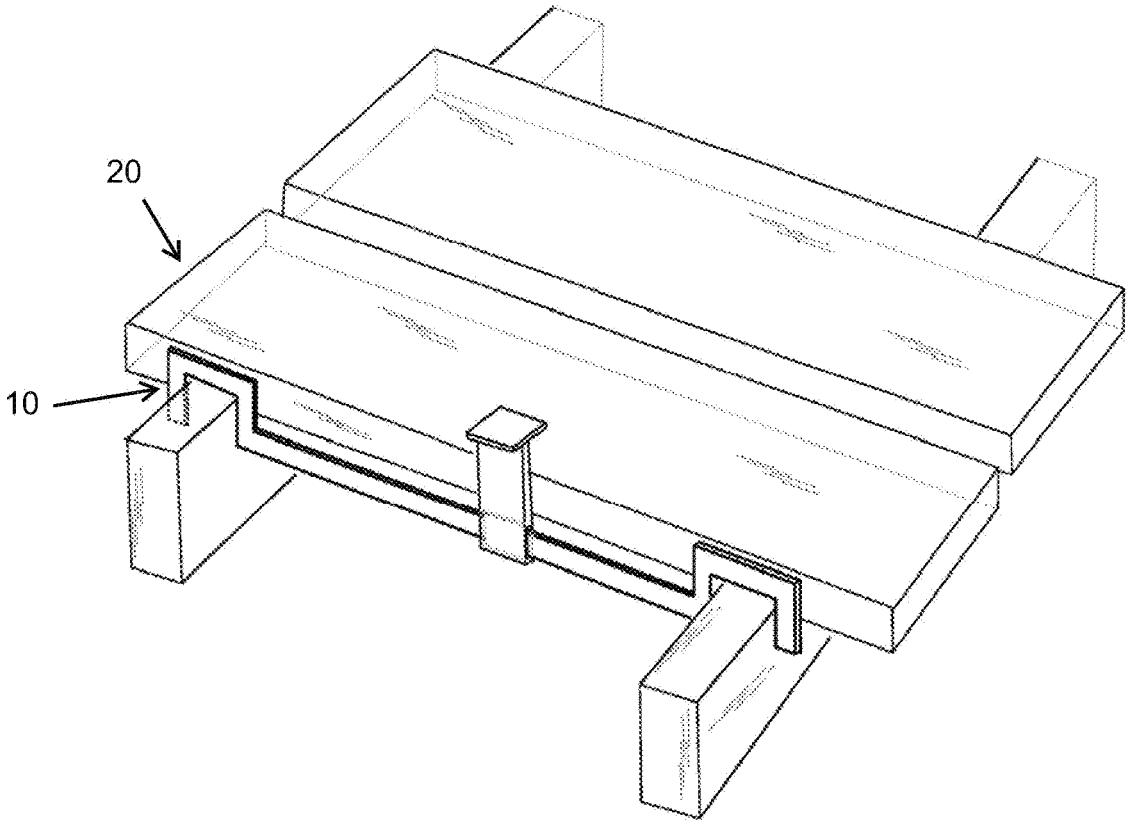
FIG. 28 is a three-dimensional view of the load distributing deck insert of FIG. 24 being saddled onto two joists of a sectioned deck, according to an embodiment of the disclosure.
Figure 29:
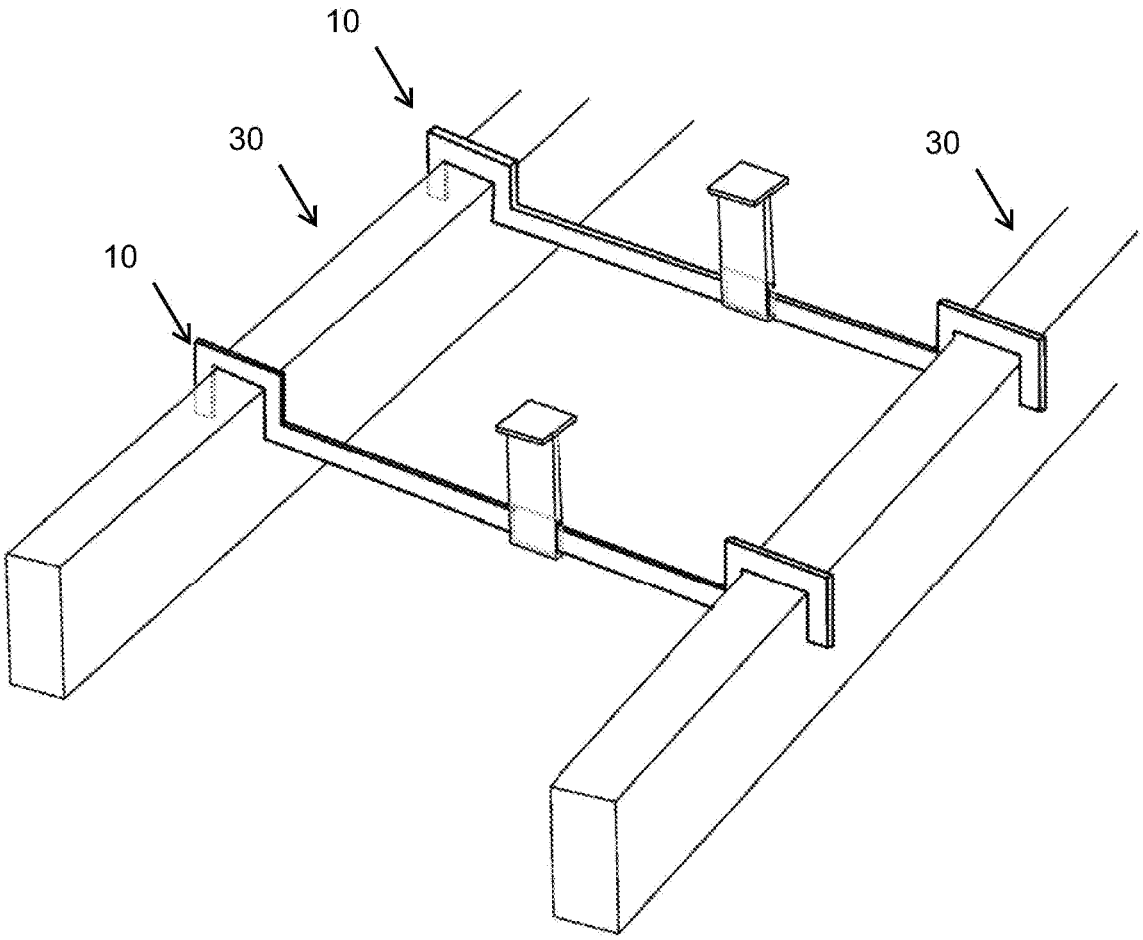
FIG. 29 is a three-dimensional view of two load distributing deck inserts of FIG. 24 being saddled onto two joists of a sectioned deck, according to an embodiment of the disclosure.
Figure 30:
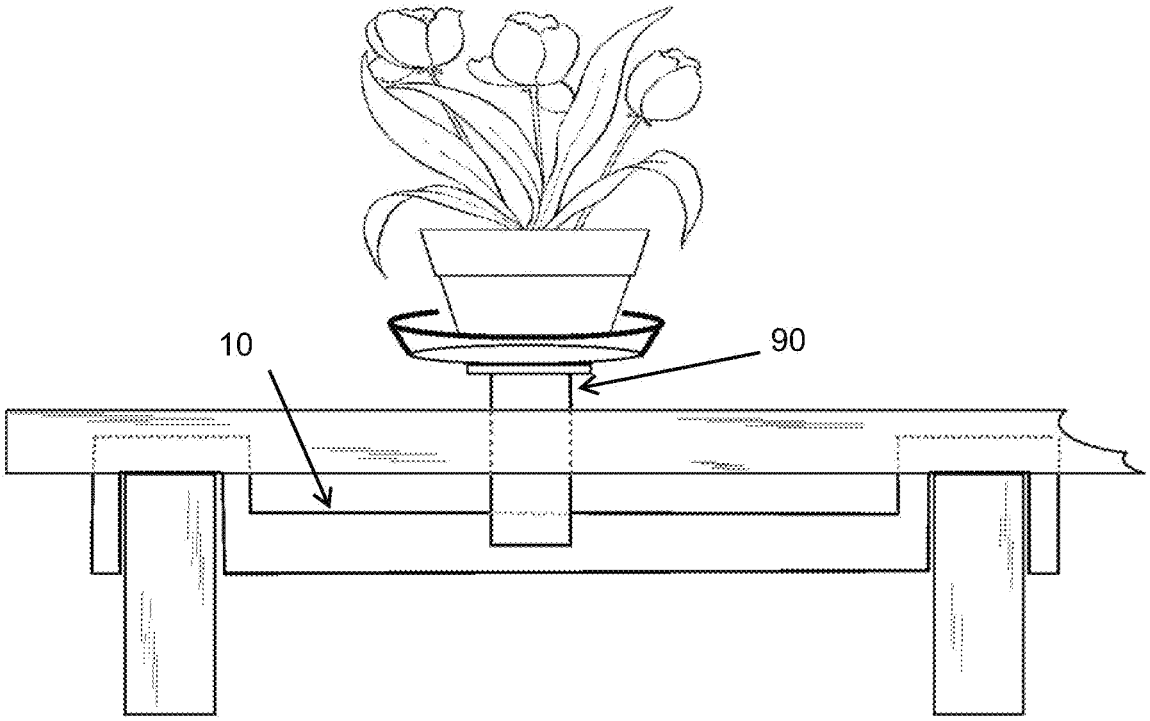
FIG. 30 consists of a front plan view of the load distributing deck insert of FIG. 24 being saddled onto two joists of a sectioned deck and provided with a loading force, according to an embodiment of the disclosure.

In an exemplary deck insert 10 shown in FIGS. 16-18, the lower edge of said center body 50, which forms the outer upper perimeter of said arch 70 may be sharpened to a cutting edge 72 and may be provided approximately at its midpoint mark with a sharp protrusion 74 similar to an arrow bead or an arch tooth. Upon saddling said load distributing deck insert 10 onto said joist 30, a blunt force can be applied upon said load receiving section 40 to push said arch edge 72 and said arch tooth 74 into the top surface of said joist 30 which due to their sharpness will pierce and travel into the joist wood to become easily anchored on the top surface of the joist. Such anchoring provides added stability and strength to the load distributing deck insert 10.

As discussed herein, the load receiving section 40, the center body section 50 and the bottom saddle section 60 may be arranged collinearly along their longitudinal y-axis. In an exemplary load distributing deck insert 10 shown in FIGS. 19-23, said top receiving section 10 may be offset from the central longitudinal y-axis of said load distributing deck insert 10. The offset may allow the installation of the insert over a joist that is along a railing that blocks the placement of an object on the deck against the railing. The offset load receiving section 40 takes care of any interference that the railing might present. An angled surface 52 may connect the center body section 50 to the bottom saddle section 60. The insert 10 shown in FIGS. 19-23, allows for the placement of objects anywhere on the deck floor, offset from the location of any joist.

In an exemplary deck insert 10 shown in FIGS. 24-30, said load receiving section 40 may be provided on at least one sliding member 90 mounted and traveling along a track 80 juxtaposed with and connecting two bottom saddle sections 60 ("connecting track 80"), each bottom saddle section 60 mounted respectively on one of two oppositely adjacent but distanced, parallel joists, said traveling track 80 spanning the distance between said two saddled joists. Each of said at least one sliding member 90 allows said load receiving section 40 located upon it, to travel along the length of said connecting track 80 for the positioning of the object placed on the deck to occur at any point between the saddled joists.

Figure 31:
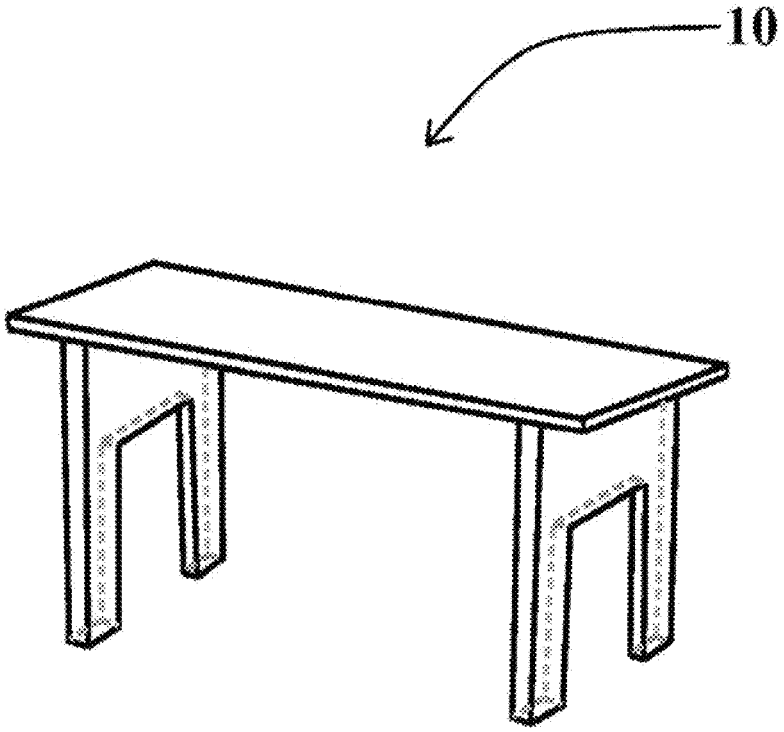
FIG. 31 is a perspective view of a load distributing deck insert, according to an embodiment of the disclosure.
Figure 32A:
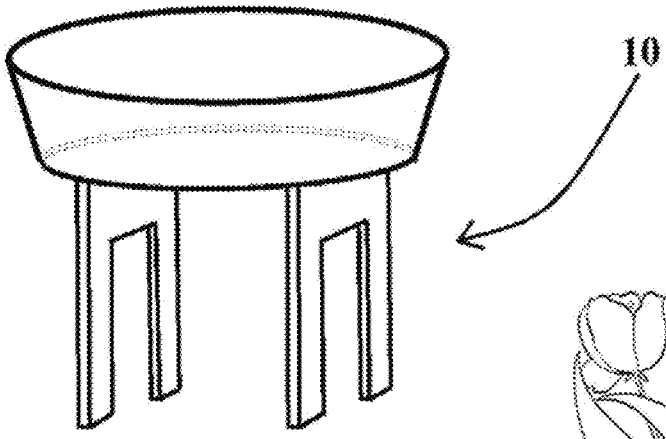
FIG. 32*a* is a perspective view of the load distributing deck insert of FIG. 31 showing a force being applied thereon, according to an embodiment of the disclosure.
Figure 32B:
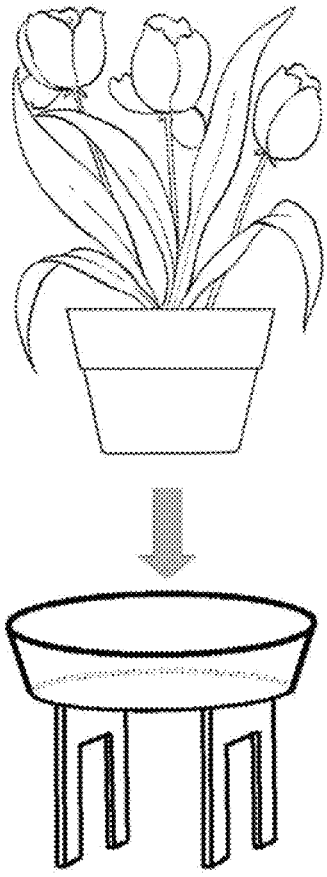
FIG. 32*b* is a perspective view of the load distributing deck insert of FIG. 31 showing a force being applied thereon, according to an embodiment of the disclosure.
Figure 33:
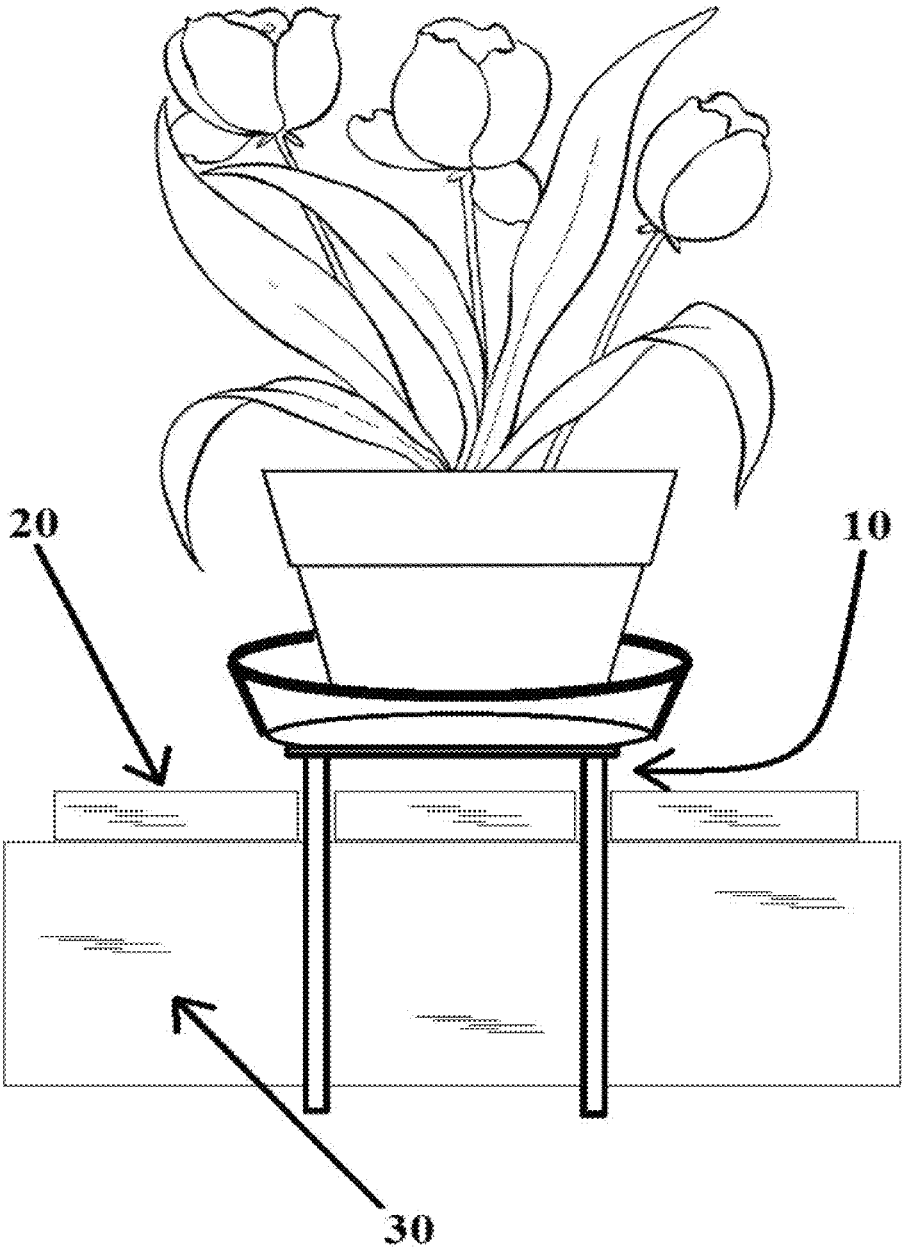
FIG. 33 is a plan side view of the load distributing deck insert of FIGS. 31 and 32 saddled on a joist over a single deck floorboard, according to an embodiment of the disclosure.

In an exemplary deck insert 10 shown in FIGS. 31-33, a top load receiving section 40, at least two parallel bottom saddle sections 60, and at least 2 center body sections 50. The two bottom saddle sections are collinearly arranged along the load distributing deck insert's z-axis at a distance equivalent the width of a deck floorboard 20.

The process of saddling a joist 30 with the load distributing deck insert 10 having two bottom saddle sections comprises the following steps: a) orienting said two bottom saddle sections 60 between the edges of two end-long gaps running along either side of at least one end-long deck floor board 20 such that each of the horizontal plane defined by the bottom of said 2 saddle legs 62 of each bottom saddle section 60 runs parallel to each of the two end-long gaps running along either side of the at least one end-long deck floor board 20; b) directing and inserting said bottom saddle sections 60 into the gaps running along the end-long deck floor board 20; and c) orienting said bottom saddle sections 60 on the same joist 30 at either side of the end-long deck floorboard. In an example, the deck insert 10 may be frictionally mounted to the joist 30, such that each of said saddle legs 62 are frictionally but removably mounted on either side of the joist 30, which has been saddled by the deck insert 10. As shown in FIG. 33, although the deck insert 10 extends over the top or upper surface of the deck board 20, the deck insert 10 may avoid contact with the top or upper surface of the deck board 20.

Figure 36:
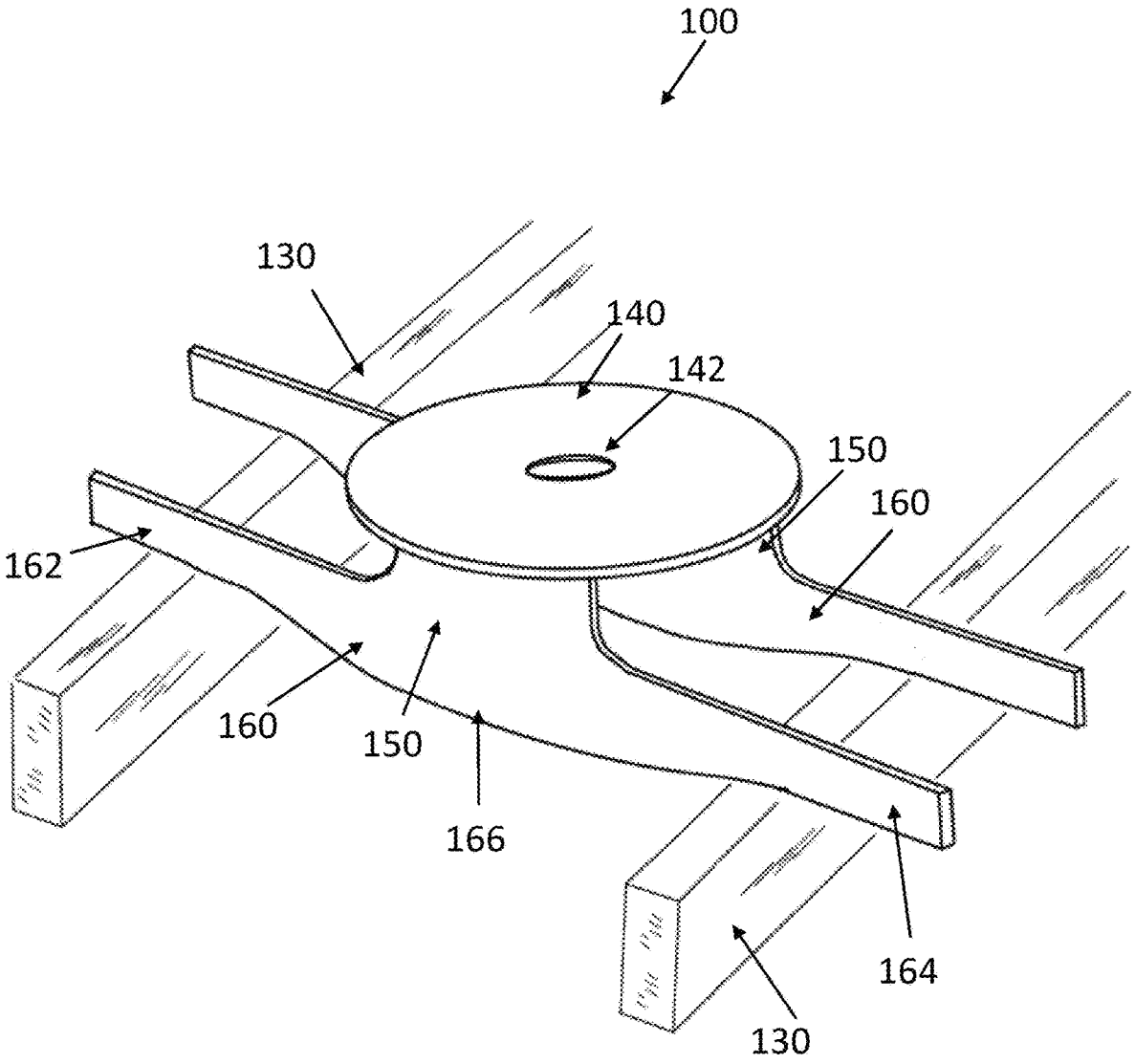
FIG. 36 is a perspective view of a load distributing deck insert being saddled onto joists of a sectioned deck, according to an embodiment of the disclosure, according to an embodiment.

FIGS. 34*a* and 34*b* and FIGS. 35*a*-35*d* show an exemplary deck insert 100. The deck insert 100 may be the same or similar to any of the deck inserts described herein and may be combined with, have the features of, and/or have the same installation and/or operation of, any of the deck inserts described herein. The deck insert 100 may include a body 150 and a saddle 160. The deck insert 100 may include two bodies 150 and two saddles 160 as shown, however more or fewer are contemplated. The saddle 160 may be an elongate member. The saddle 160 may include a first end 162 and a second end 164. The first end 162 may be connected to the second end 164 by a middle section 166. As shown in FIG. 36, the first end 162 and the second end 164 may be configured to rest on respective joists 130. The middle section 166 may extend between the joists. The middle section 166 may include a curve.

Figure 34B:
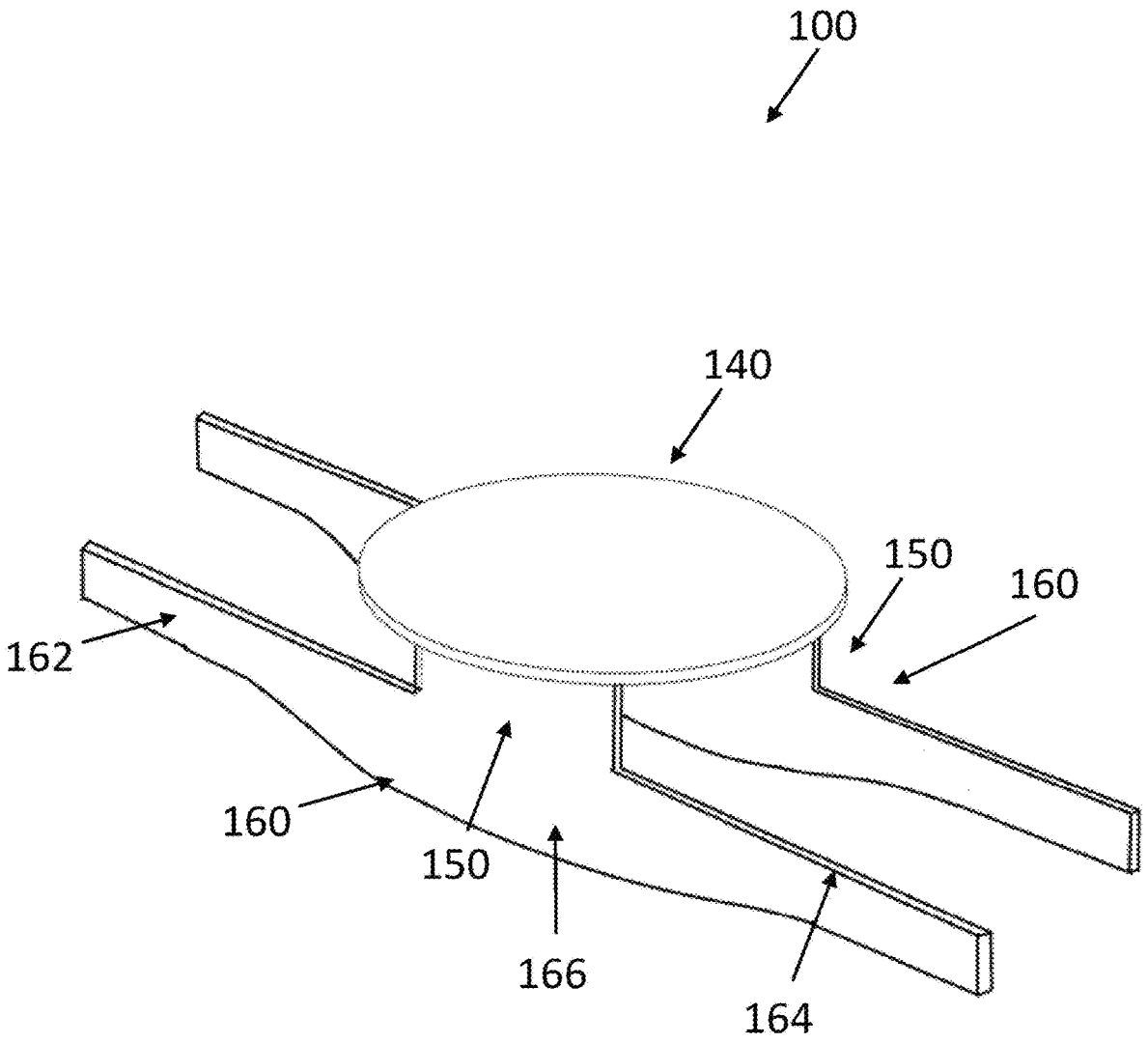
FIG. 34*b* is a perspective view of a load distributing deck insert, according to an embodiment of the disclosure.
Figure 35A:
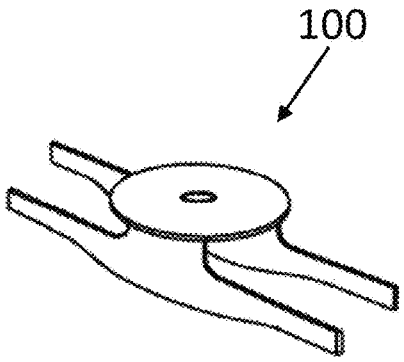
FIG. 35*a* is a perspective view of the load distributing deck insert of FIG. 35*a*, according to an embodiment.
Figure 35B:
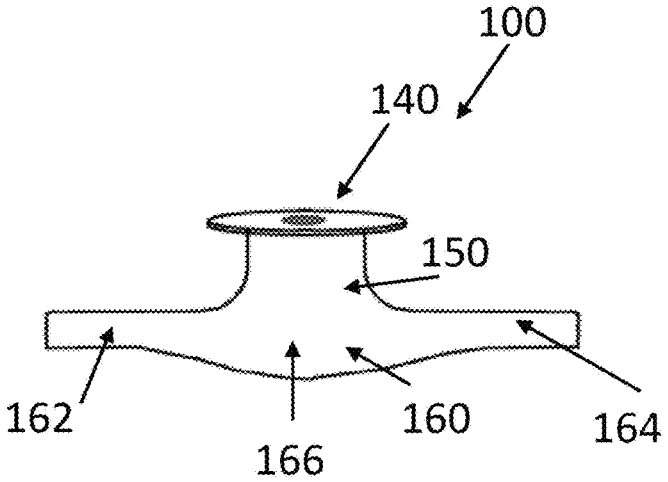
FIG. 35*b* is a plan side view of the load distributing deck insert of FIG. 35*a*, according to an embodiment.
Figure 35C:
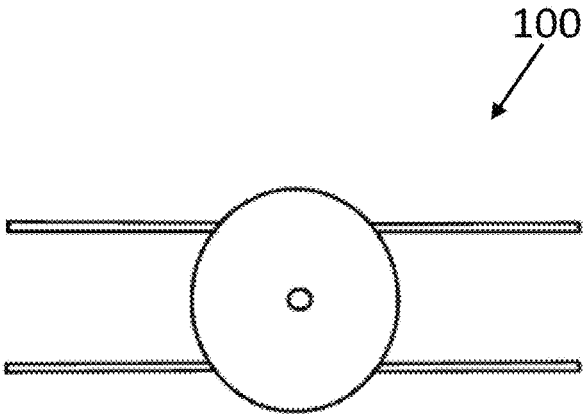
FIG. 35*c* is a top plan view of the load distributing deck insert of FIG. 35*a*, according to an embodiment.
Figure 35D:
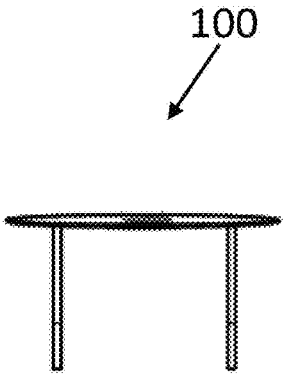
FIG. 35*d* is a front plan view of the load distributing deck insert of FIG. 35*a*, according to an embodiment.

With continued reference to FIGS. 34*a* and 34*b* and FIGS. 35*a*-35*d*, the deck insert 100 may include a load receiving section 140. The load receiving section 140 may be a flat surface with an opening 142 therein. The load receiving section 140 may take any form described herein. As discussed, more than one load receiving section 140 may be provided of the same or different form. As shown in FIG. 34*b*, the load receiving section 140 may not include the opening 142. The load receiving section 140 may be flat, bowl shaped, cylindrical, pot shaped, or any combination thereof.

Figure 37A:
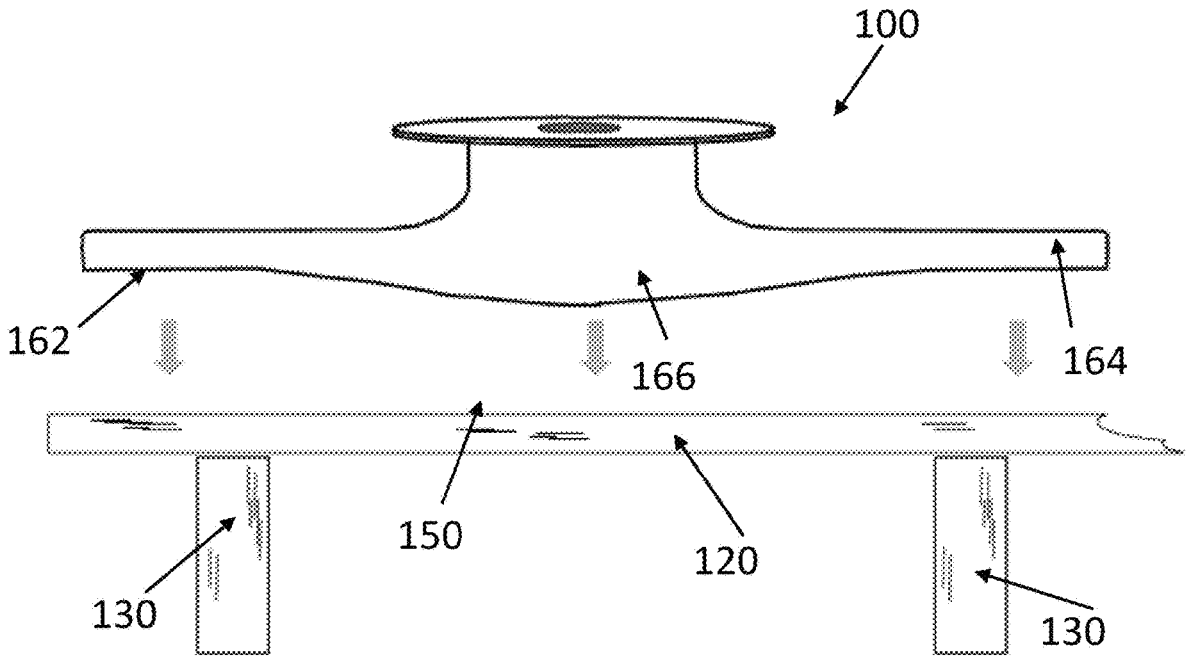
FIG. 37*a* is a front plan view of a load distributing deck insert being saddled onto joists of a sectioned deck, according to an embodiment of the disclosure.
Figure 37B:
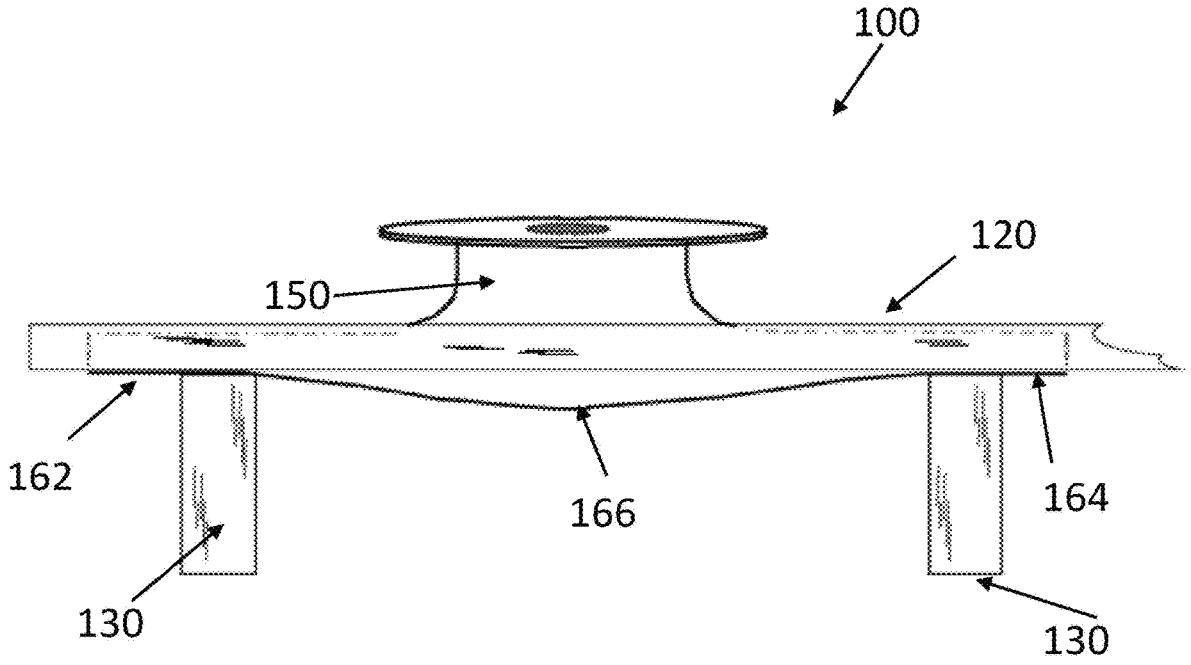
FIG. 37*b* is a front plan view of a load distributing deck insert saddled onto joists of a sectioned deck, according to an embodiment of the disclosure.
Figure 38:
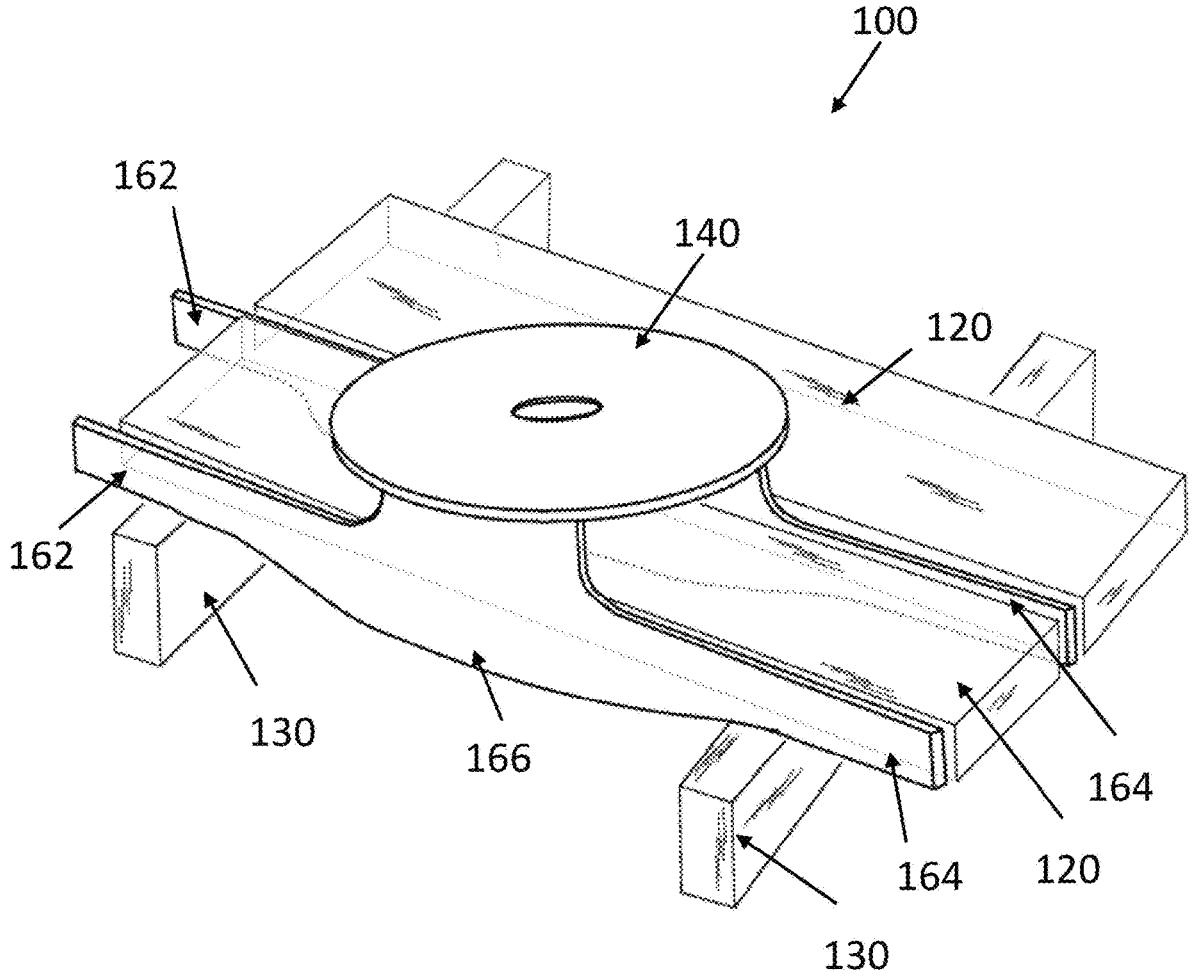
FIG. 38 is a perspective view of a load distributing deck insert saddled onto joists of a sectioned deck, according to an embodiment of the disclosure.

Referring to FIGS. 37*a* and 37*b* and FIG. 38, the process of saddling a joist 130 with the load distributing deck insert 100 having two bottom saddle sections 160 is shown. In an exemplary method of installing the deck insert 100 over the joists 130 (e.g., saddling the joist 130) the method may include: a) orienting the two saddle sections 160 between the edges of two end-long gaps running along either side of at least one end-long deck floorboard 120 (and perpendicularly to the joists 130) such that each of the ends 162 and 164 runs parallel to each of the two end-long gaps running along either side of the at least one end-long deck floorboard 120 and perpendicular to the joists 130; b) directing and inserting the saddles 160 into the gaps running along the end-long deck floorboard 120; c) orienting the saddles 160 across two joists 130; and d) resting the ends 162 and 164 on the top surfaces of the joists 130. As shown, the deck insert 100 may avoid touching or contacting the top surface of the deck boards 120.

Figure 39:
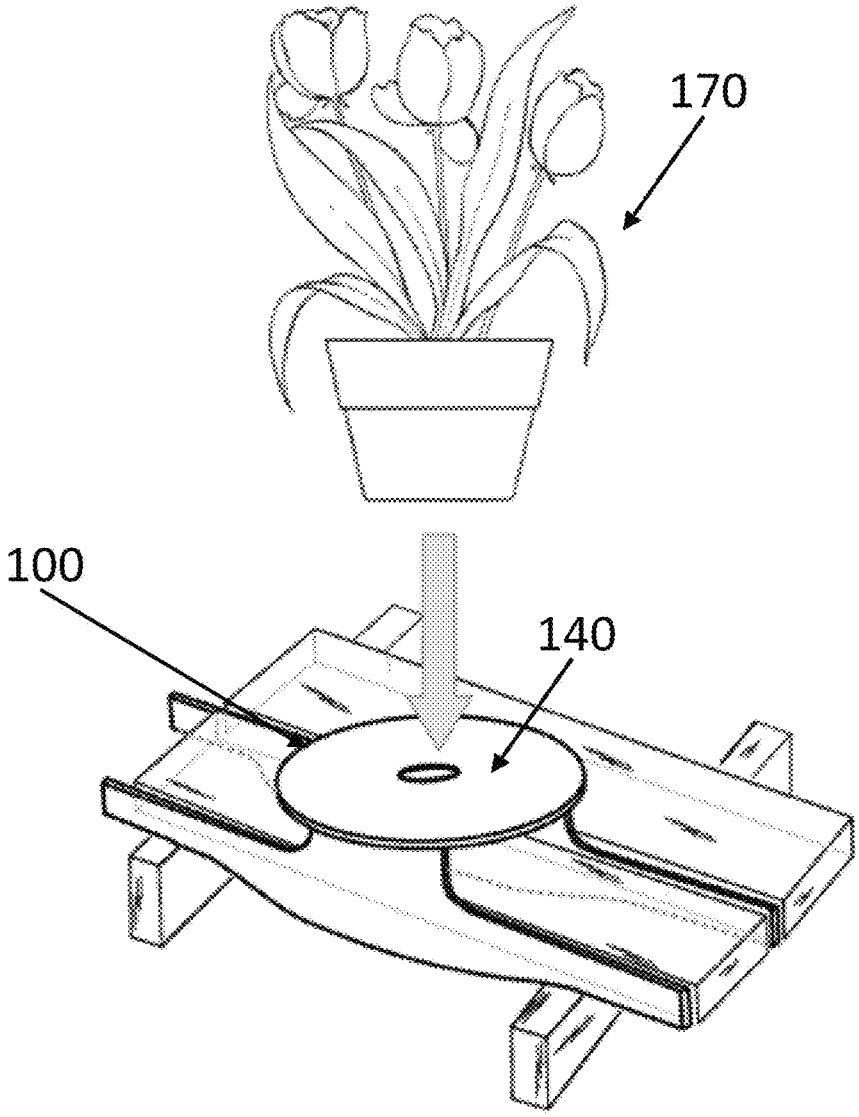
FIG. 39 is a perspective view of a load distributing deck insert saddled onto joists of a sectioned deck and receiving a load force, according to an embodiment of the disclosure.
Figure 40A:
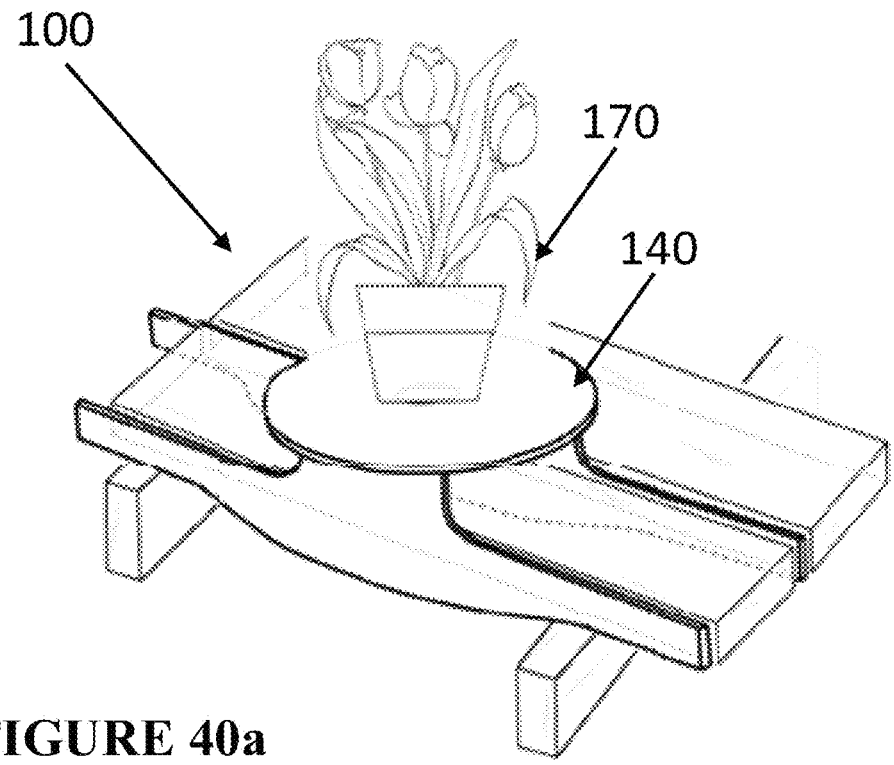
FIG. 40*a* is a perspective view of a load distributing deck insert saddled onto joists of a sectioned deck and receiving a load force, according to an embodiment of the disclosure.
Figure 40B:
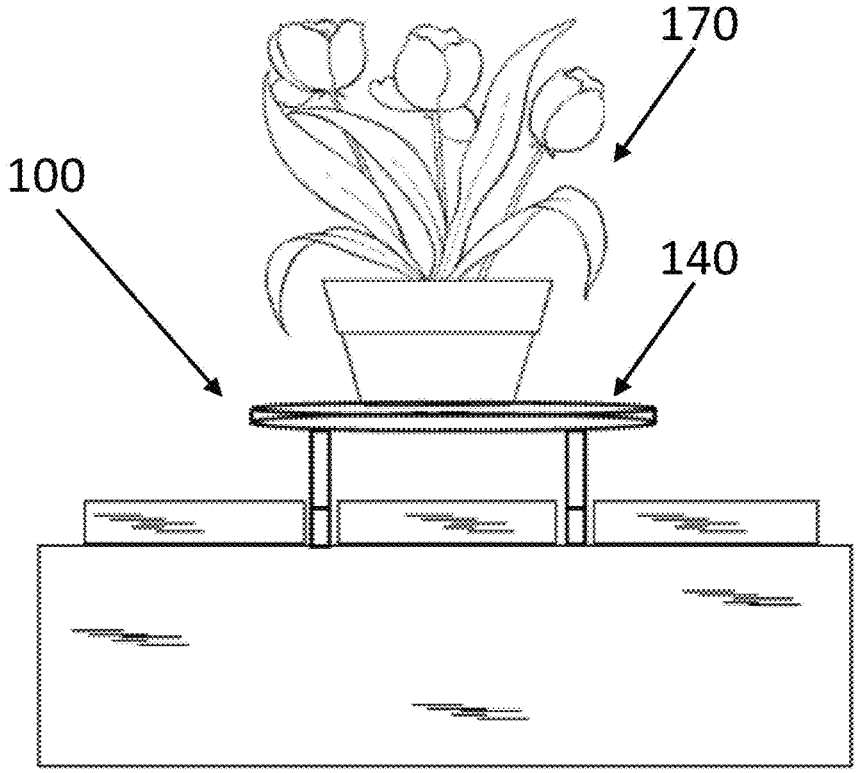
FIG. 40*b* is a perspective view of a load distributing deck insert saddled onto joists of a sectioned deck and receiving a load force, according to an embodiment of the disclosure.
Figure 41:
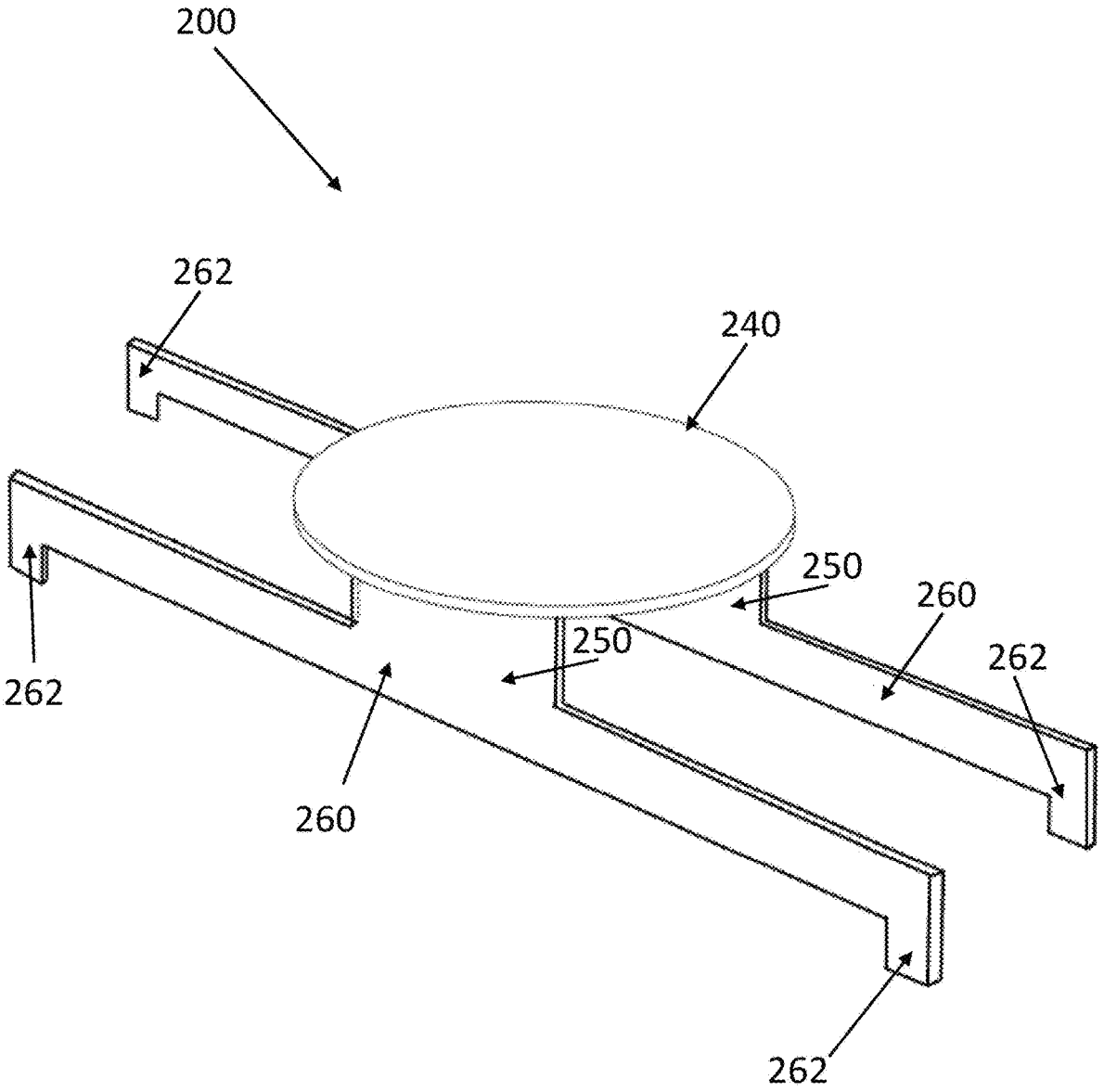
FIG. 41 is a perspective view of a load distributing deck insert, according to an embodiment of the disclosure.
Figure 42A:
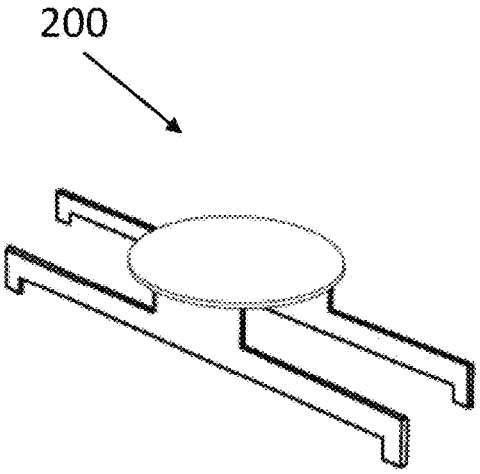
FIG. 42*a* is a perspective view of a load distributing deck insert, according to an embodiment.
Figure 42B:
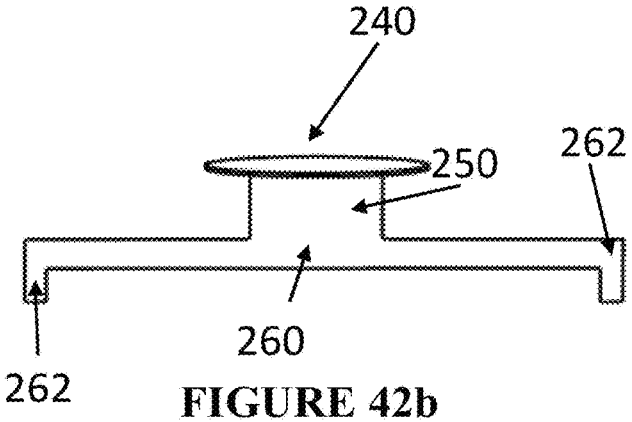
FIG. 42*b* is a plan side view of the load distributing deck insert of FIG. 42*a*, according to an embodiment.
Figure 42C:
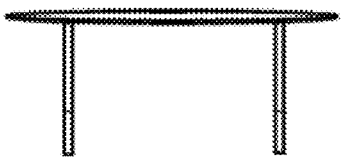
FIG. 42*c* is a top plan view of the load distributing deck insert of FIG. 42*a*, according to an embodiment.
Figure 42D:
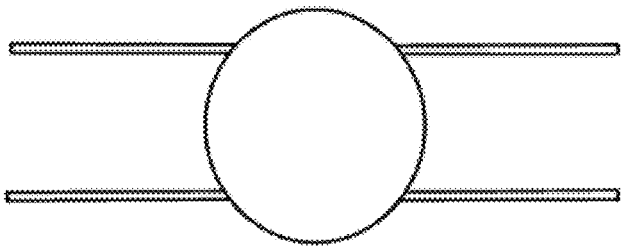
FIG. 42*d* is a front plan view of the load distributing deck insert of FIG. 42*a*, according to an embodiment.
Figure 43:
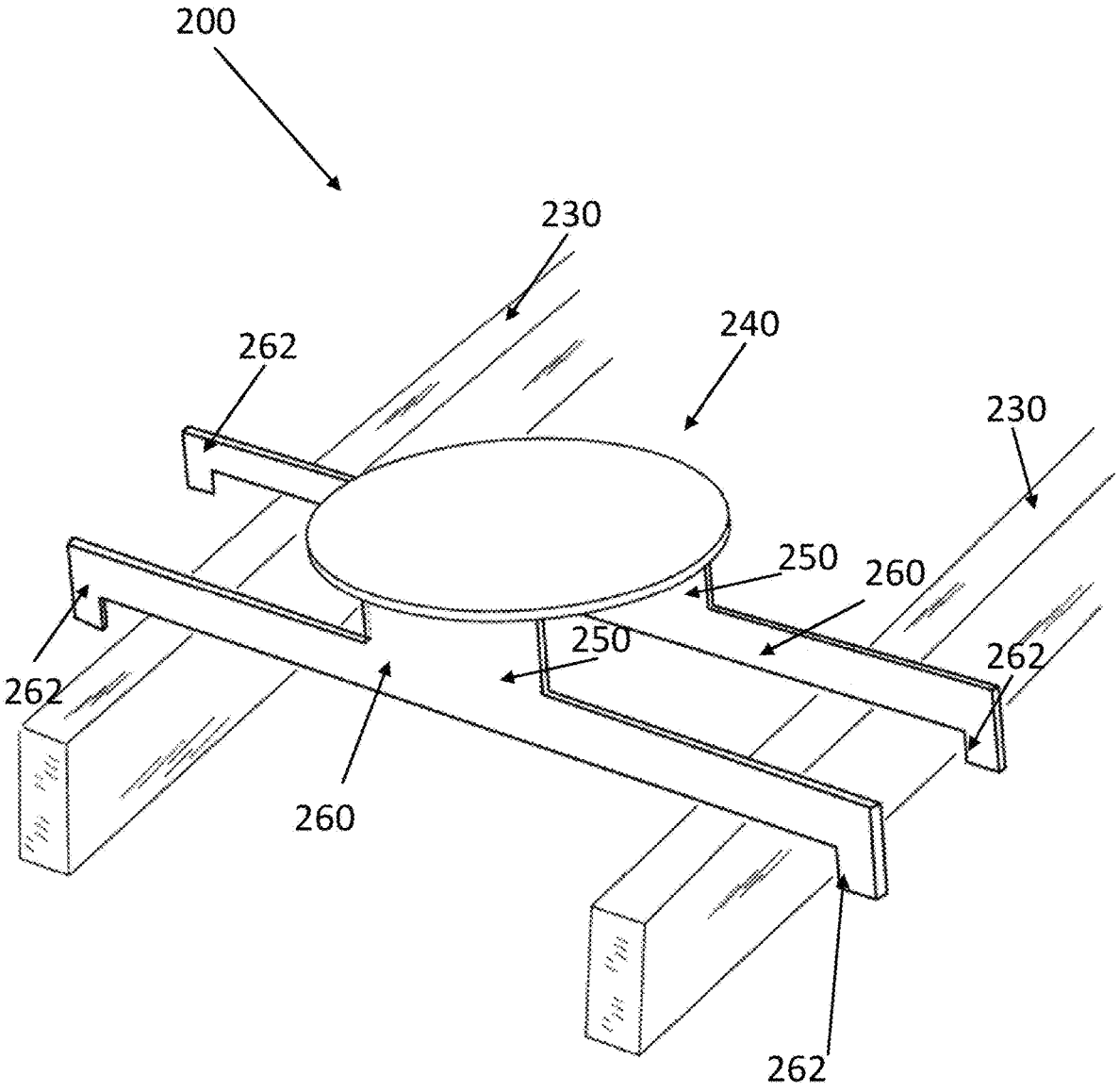
FIG. 43 is a perspective view of a load distributing deck insert saddled onto joists of a sectioned deck, according to an embodiment of the disclosure.

Referring to FIG. 39 and FIGS. 40*a* and 40*b*, once the deck insert 100 is installed, a deck accessory 170, such as, but not limited to, a potted plant, may be placed on the load receiving section 140. The insert may or may not be secured to the joist or deck board with a fastener.

Figure 2:
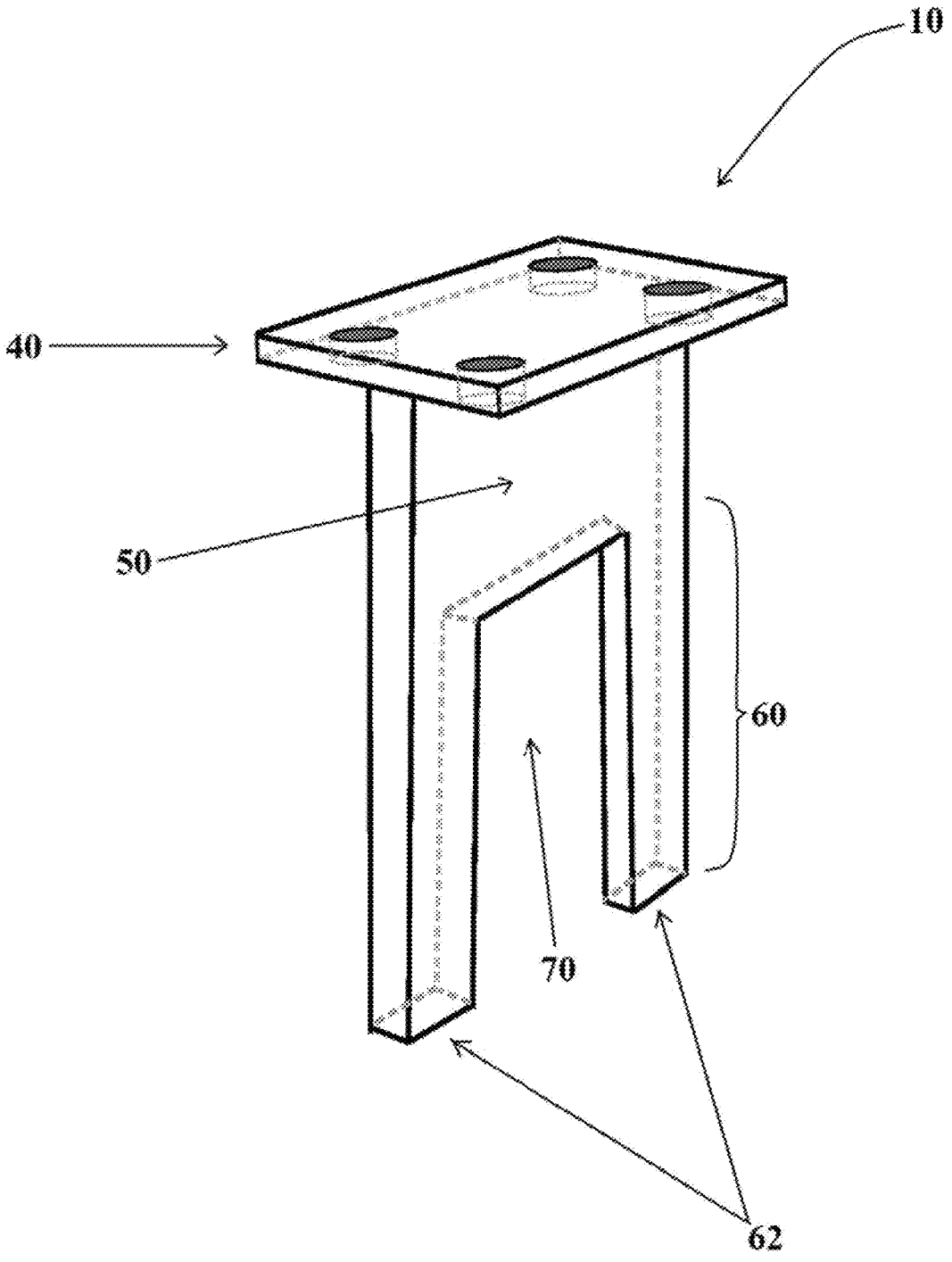
FIG. 2 is a three-dimensional perspective of the load distributing deck insert of FIG. 1, according to an embodiment of the disclosure.
Figure 3:
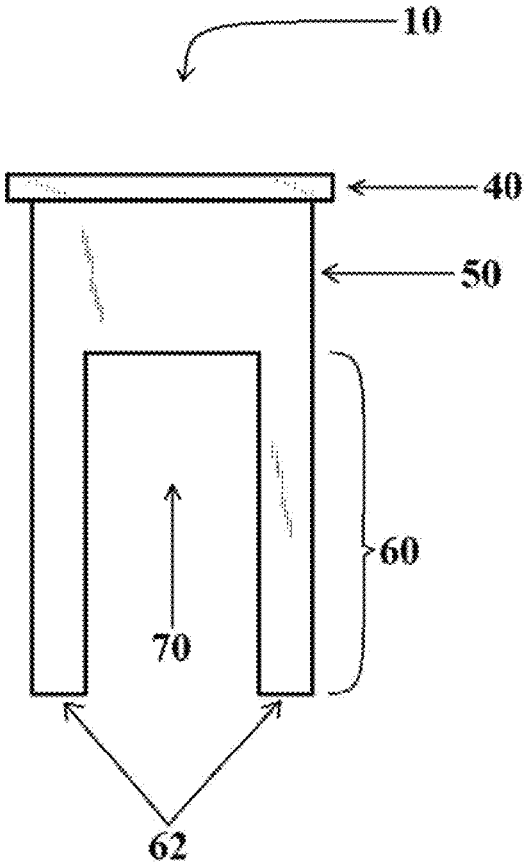
FIG. 3 is a front plan view of the load distributing deck insert of FIG. 1, according to an embodiment of the disclosure.
Figure 3A:
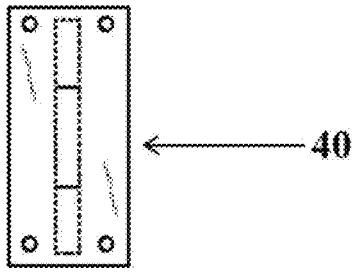
FIG. 3*a* is a top plan view of the load distributing deck insert of FIG. 3, according to an embodiment of the disclosure.
Figure 3B:
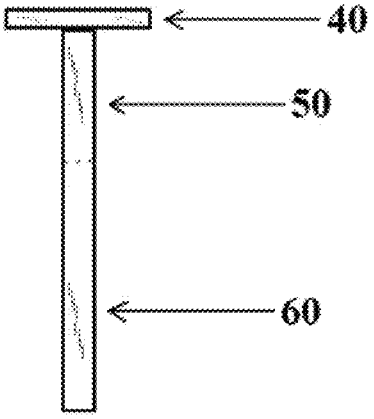
FIG. 3*b* is a side plan view of the load distributing deck insert of FIG. 3, according to an embodiment of the disclosure.
Figure 3C:
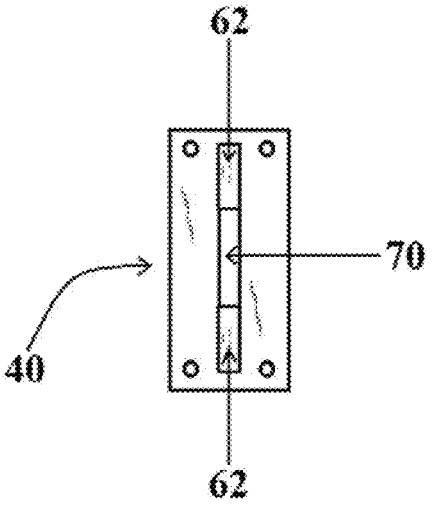
FIG. 3*c* is a bottom plan view of the load distributing deck insert of FIG. 3, according to an embodiment of the disclosure.

Turning now to FIGS. 41-44, an exemplary deck insert 200 is shown. The deck insert 200 may include a body 250 and a saddle 260. The saddle may include two legs 262. The body 250 and saddle 260 may be the same as the body 50 and saddle 60 as shown in FIGS. 1-3. The insert 200 may be dimensioned and shaped to extend over two joists 230. That is, the exemplary insert 10 of FIGS. 1-3 may extend over a single joist while the exemplary insert 200 of FIGS. 41-44 may be the same as insert 10, but may extend over two joists. Although embodiments extending over one and two joists are shown, inserts extending over more joists (e.g., three joists, four joists, etc.) are contemplated. It may be understood that in such larger spanning inserts (e.g., inserts that extend over two or more joists), the structure may be the same as the insert 10 of FIGS. 1-3, but the saddle 260 may be elongated such that the legs 262 are spaced farther apart than the legs 62 to accommodate the increased length over which the insert extends. The exemplary deck insert 200 includes a circular load receiving section 240. However, as described previously, the shape and dimension of the load receiving section may be one or more of any of the load receiving sections described herein.

Figure 44A:
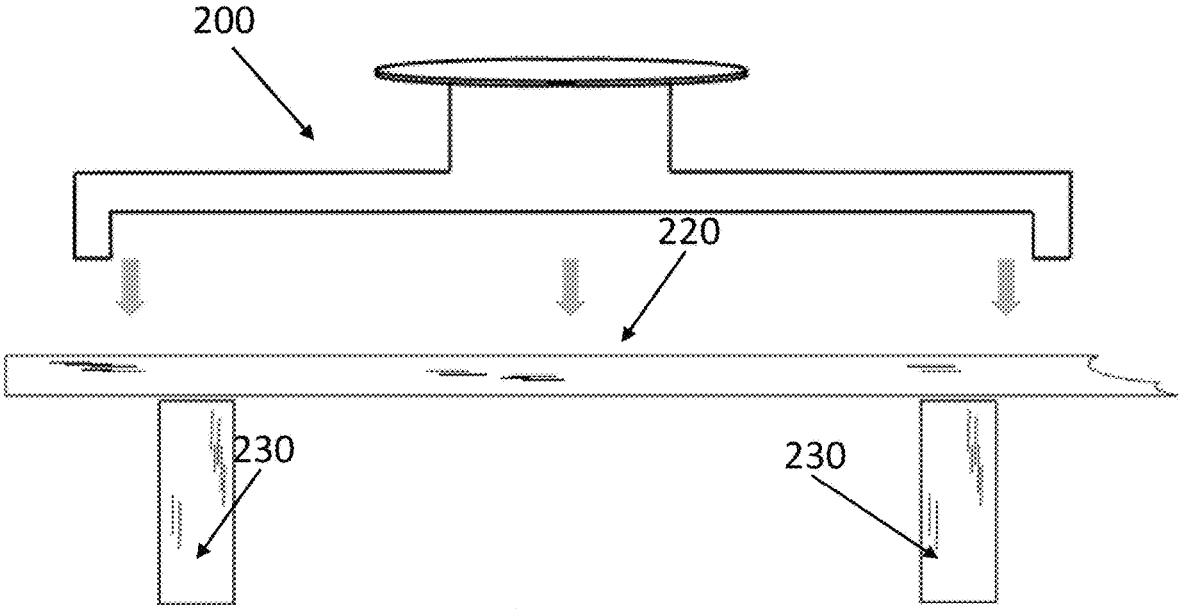
FIG. 44*a* is a front view of a load distributing deck insert being saddled onto joists of a sectioned deck, according to an embodiment of the disclosure.
Figure 44B:
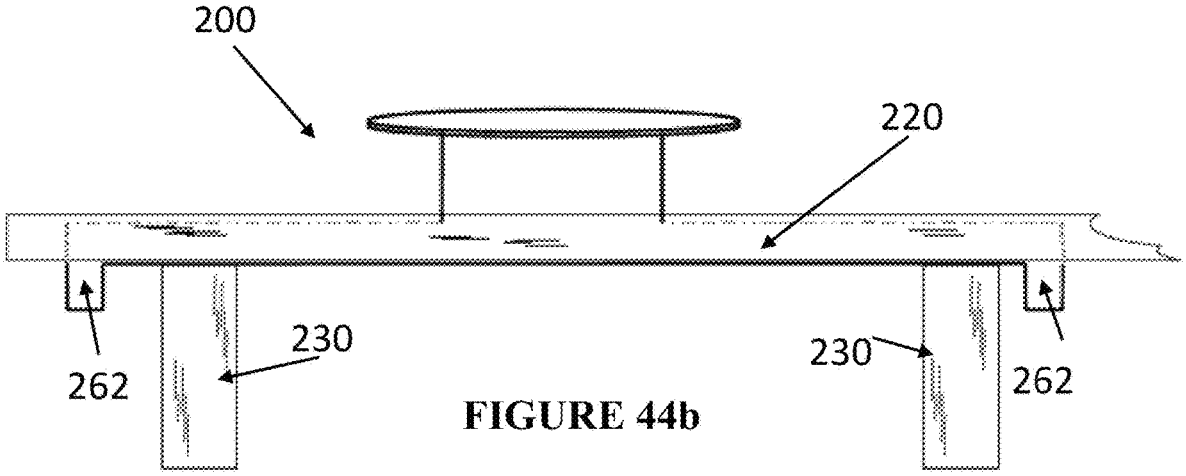
FIG. 44*b* is a front view of a load distributing deck insert saddled onto joists of a sectioned deck, according to an embodiment of the disclosure.
Figure 44C:
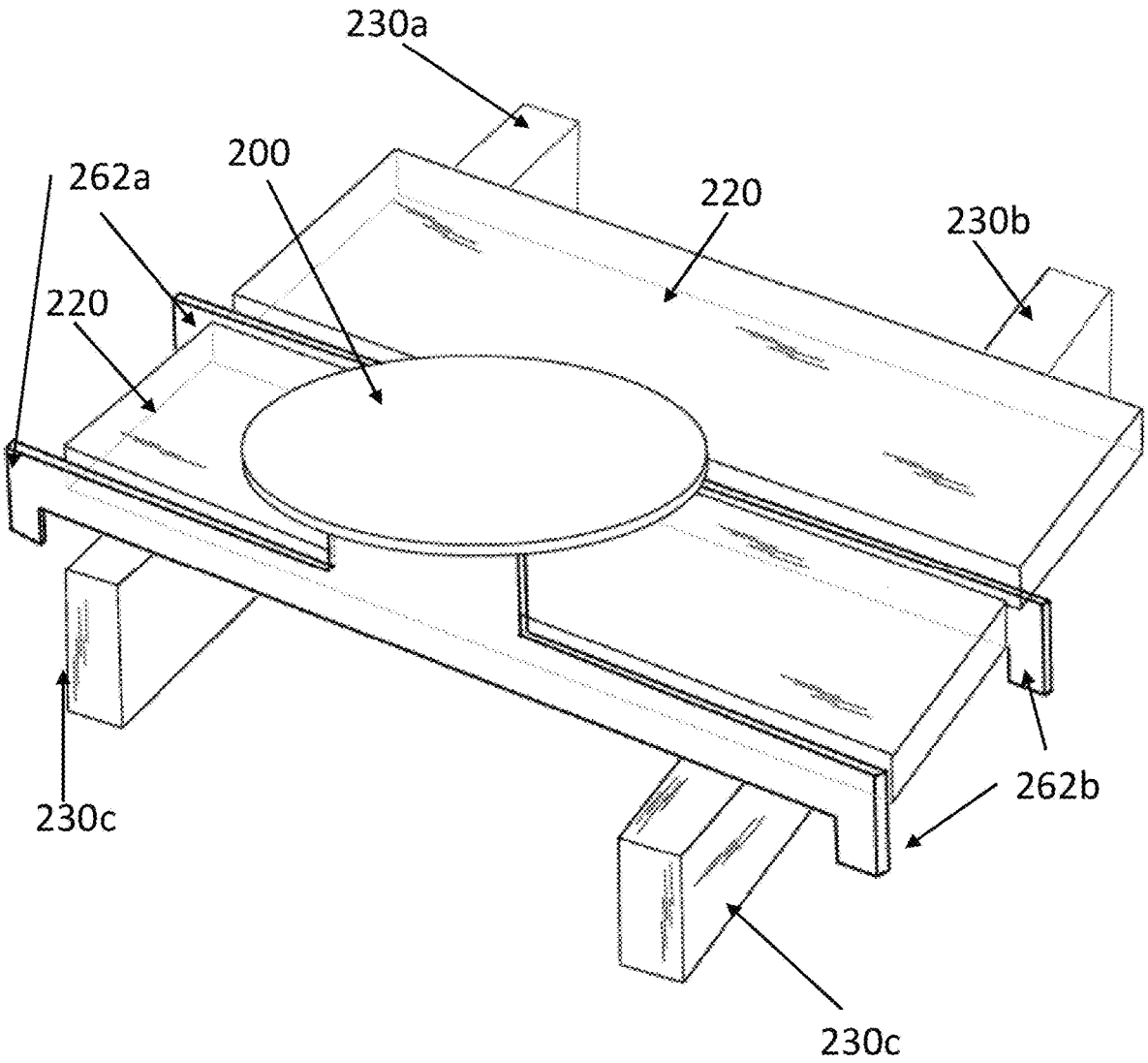
FIG. 44*c* is a perspective view of a load distributing deck insert saddled onto joists of a sectioned deck, according to an embodiment of the disclosure.
Figure 45A:
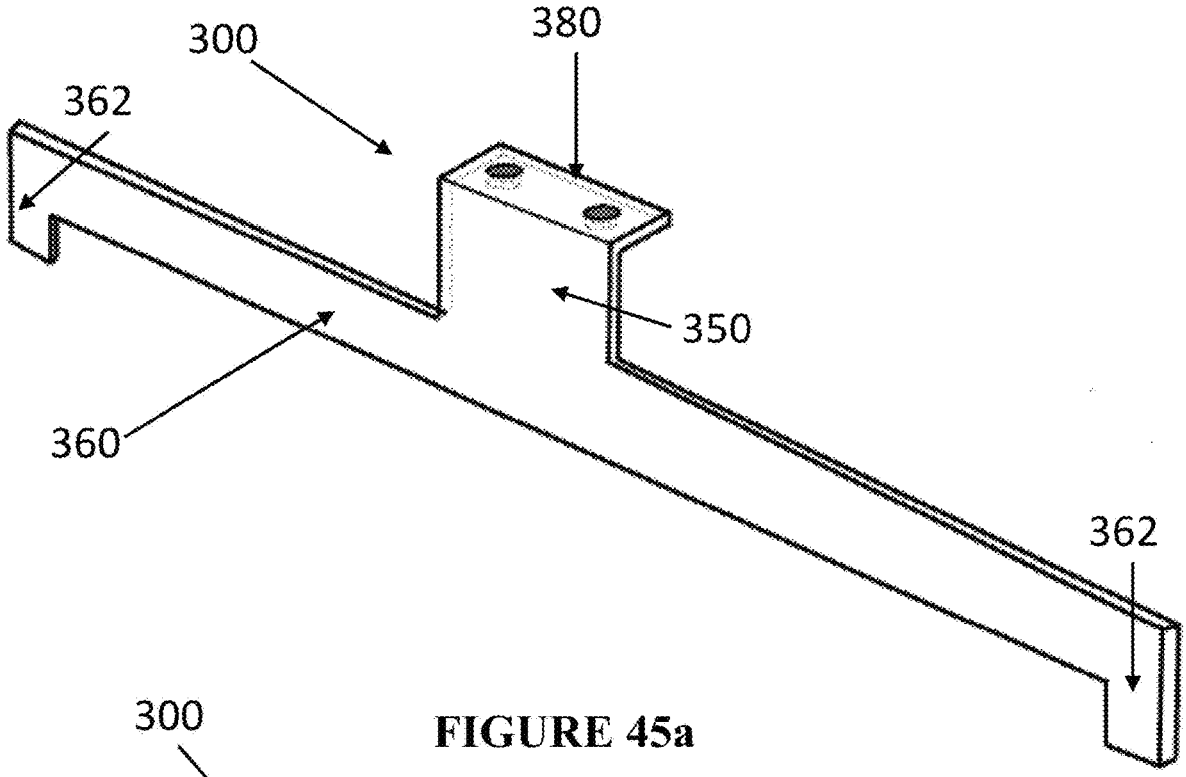
FIGS. 45*a*-45*d* are perspective views of a load distributing deck insert, according to an embodiment of the disclosure.
Figure 45B:
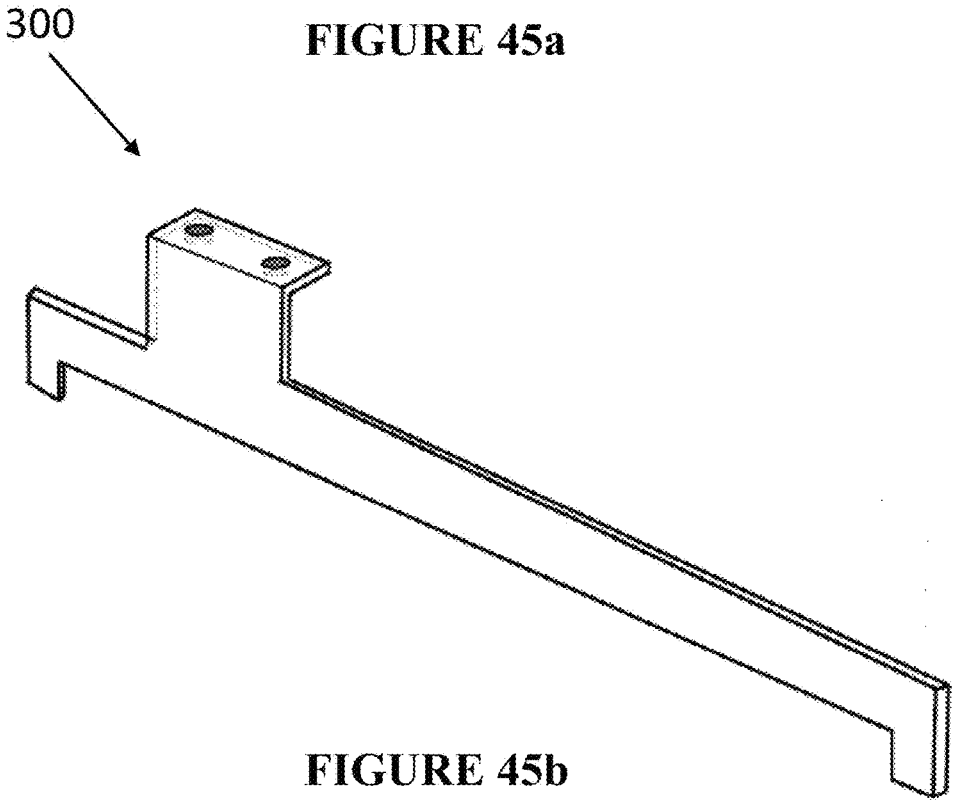
Figure 45C:
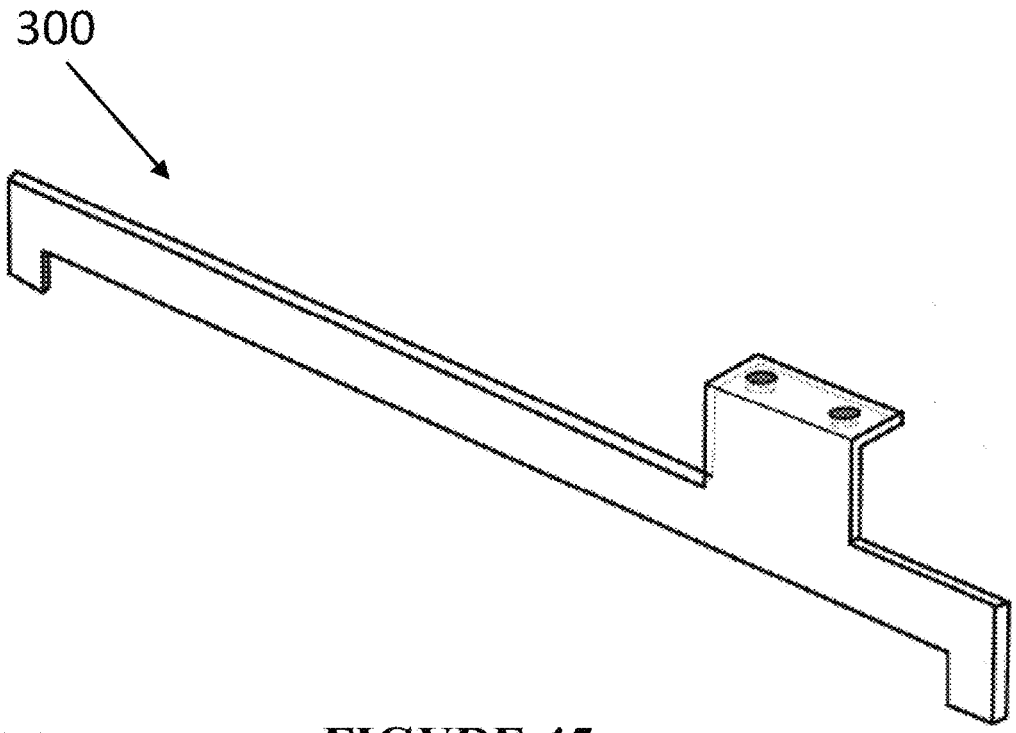
Figure 45D:
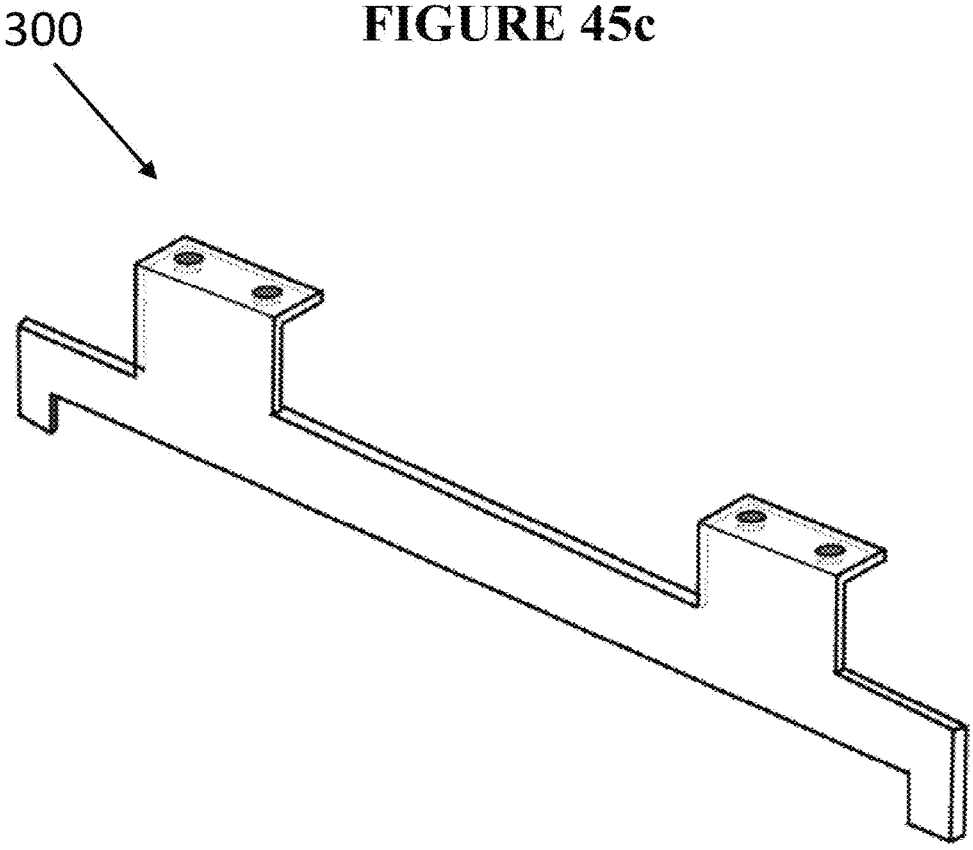

The process of saddling joists 230 with the load distributing deck insert 200 having two bottom saddle sections 260 comprises the following steps: a) orienting said two bottom saddle sections 260 between the edges of two end-long gaps running along either side of at least one end-long deck floorboard 220 such that each of the horizontal plane defined by the bottom of said two saddle legs 262 of each bottom saddle section 260 runs parallel to each of the two end-long gaps running along either side of the at least one end-long deck floorboard 220; b) directing and inserting said bottom saddle sections 260 into the gaps running along the end-long deck floorboard 220; and c) orienting each end of said bottom saddle sections 260 on the same joist 230 at either side of the end-long deck floorboard (e.g., in FIG. 44*c*, orienting end 262*a* on joist 230*a* and orienting end 262*b* on joist 230*b*). In an example, the deck insert 200 may be frictionally mounted to the joists 230, such that the legs 262 are tightly fit, but removable, to the outer surfaces 230*c* of each of the joists 230, although such frictional fit is not required. As shown in FIG. 44*c*, although the deck insert 200 extends over the top or upper surface of the deck board 220, the deck insert 200 may avoid contact with the top or upper surface of the deck board 220.

Figure 46:
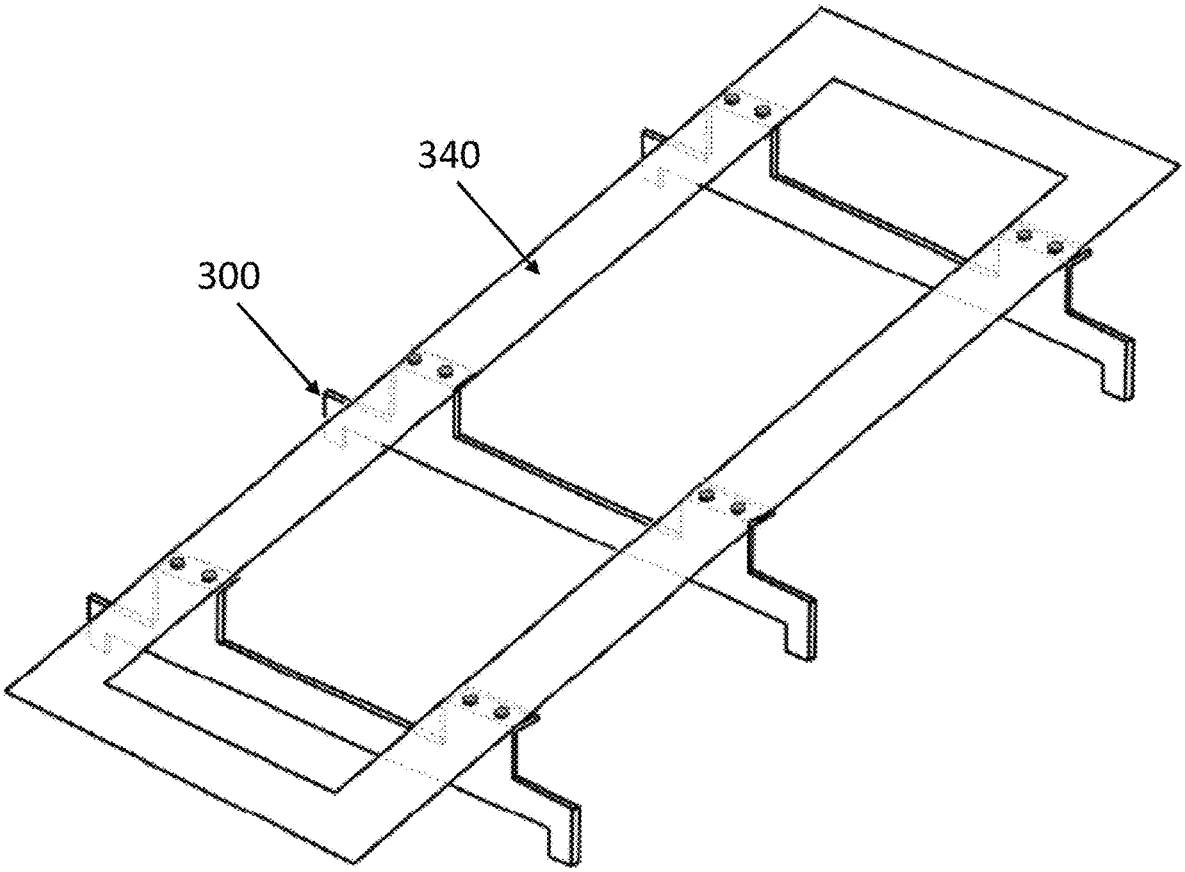
FIG. 46 are perspective views of a load distributing deck insert, according to an embodiment of the disclosure.
Figure 47:
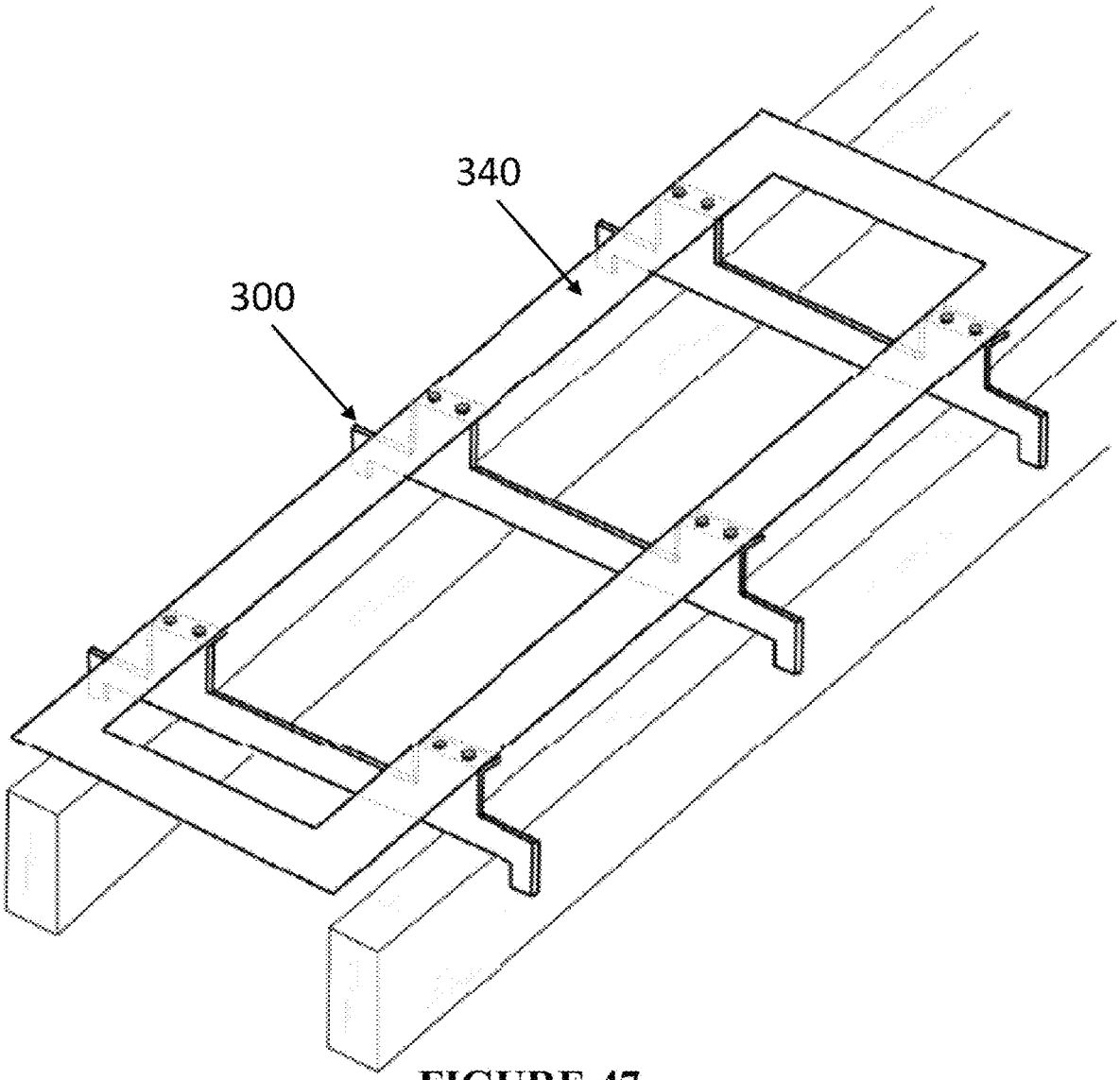
FIG. 47 is a perspective view of a load distributing deck insert saddled onto joists of a sectioned deck, according to an embodiment of the disclosure.
Figure 48:
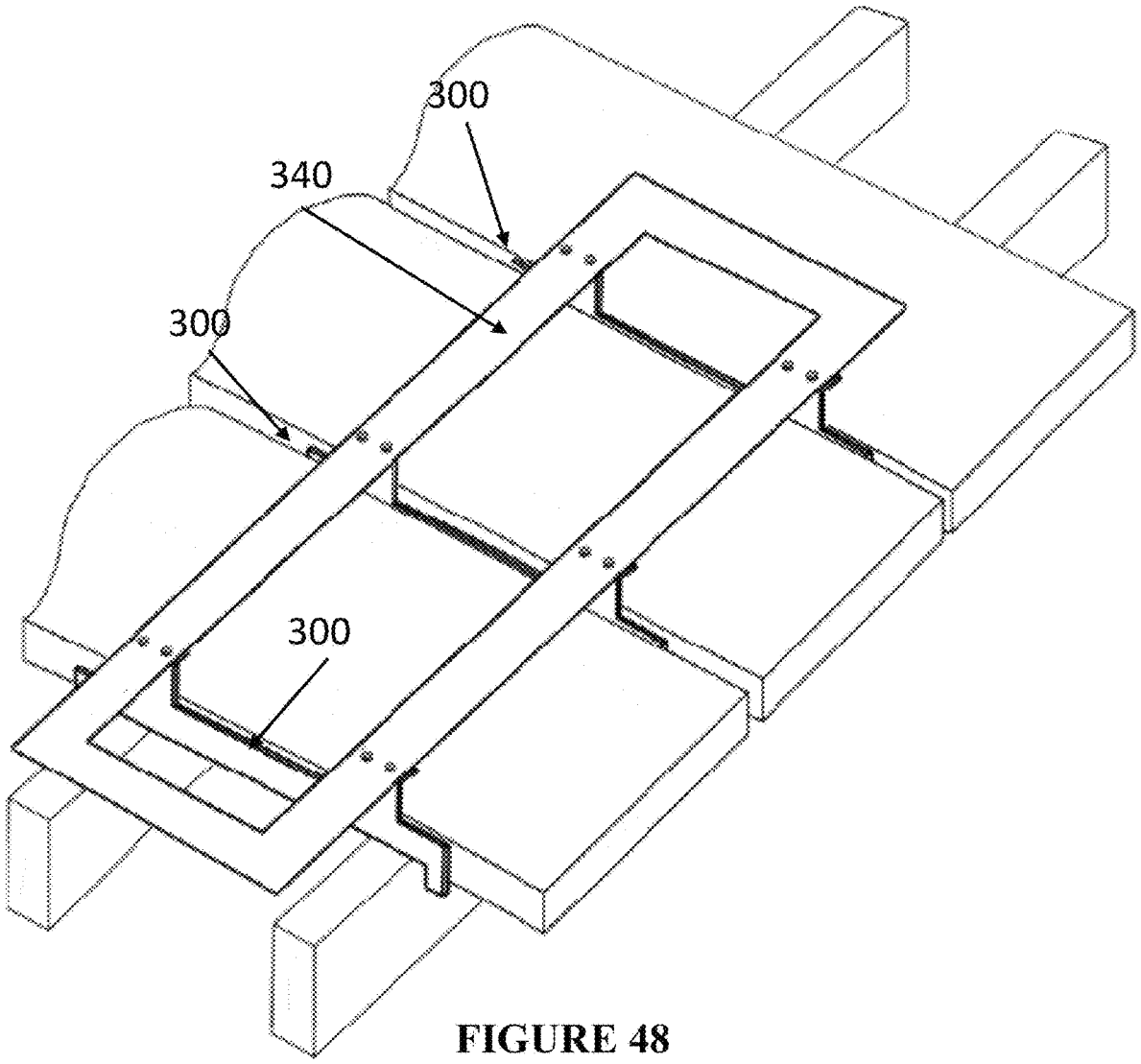
FIG. 48 is a perspective view of a load distributing deck insert saddled onto joists of a sectioned deck, according to an embodiment of the disclosure.

Referring to FIGS. 45-48, an exemplary insert 300 is shown. In each of the exemplary deck inserts 300 shown in FIGS. 45*a*, 45*b*, 45*c*, and 45*d*, a body 350, saddle 360, and legs 362 are shown. The deck inserts 300 may also include an upper portion 380. The upper portion 380 may be secured to a load receiving section 340 (FIG. 46). The upper portion 380 may extend perpendicularly from the body 350. Multiple of the inserts 300 may be coupled to the load receiving section 340 such that the load receiving section 340 extends over multiple deck boards 320. For example, as shown in FIG. 48, the deck insert 300 extends over more than two deck boards. Additional deck inserts 300 may be provided with a larger load receiving section 340 to extending over more deck boards. The deck inserts 300 may be secured to the load receiving section 340 with fasteners or may be integrally formed therewith. The different examples shown in FIGS. 45*a*-45*d* indicate that the body 350 and upper portion 380 may be located at different positions along the length of the saddle 360. The location may be selected based on the load to be supported. As shown in FIG. 46, the deck insert 300 may include two bodies 350 and two upper surfaces 380. The number and location of the bodies 350 may be selected based on the load to be supported. The insert 300 may be installed in ten same or similar manner are described herein.

Accordingly, it is an object of the present invention to prevent or retard the accumulation of debris, moisture, mildew, mold, dirt or grime under objects that are placed on decks. It is a further object of the present invention to prevent objects from staining the decks that they are placed on. It is yet a further object of the present invention to provide for the easy cleaning, scrubbing and power washing of decks without having to remove all objects from the decks. It is still another object of the present invention to prevent moisture forming on bottoms of plant containers or trays that causes discoloration, or deterioration of the deck's surface. Finally, it is an object of the present invention to provide a deck inserting device that will be secure, stable, strong and versatile to use with any object desired to be placed on a deck, without touching the deck floorboards' upper surface thereby without staining, damaging, and/or defacing the deck in anyway.

In accordance with the present invention there is provided a load distributing deck insert comprising a top receiving section upon which a load force can be applied, a center body section, and a bottom saddle section defined by two vertical parallel legs extending downwardly for said center body section. The downwardly extending parallel legs and said center body section define an arch between them, said arch having sufficient width to distribute the load force applied to said top receiving section across the width of the joist saddled by the deck insert, when it is fixedly but removably slipped into the space between two deck flooring boards. The joist frictionally inserted between the vertical legs provides added stability. It prevents any and all wobbling thereby allowing for the support of any object above the surface of the deck. The top receiving section extends above the top surface of the deck thereby supporting any object it receives without allowing it to touch the deck.

The deck inserts of the present disclosure may be employed in residential decks, commercial applications, waterside docks, marinas, construction sites, resorts, boardwalks, restaurants, spas, etc., or any place a deck or deck-like surface is desired. The deck inserts of the present disclosure may be provided with conventional wood decking provided with typical installation dimensions, spacing, and orientation. Additionally, the deck inserts may be provided with composite or PVC decking, may be provided with alternative sized decking (e.g., wide plank, closer or farther spaced joists, skinny plank, etc.). The dimensions of the deck insert of the present disclosure may be sized for the particular deck in which they are employed and the particular load they are bearing. The deck inserts of the present disclosure may carry any load desired, such as, for example, but not limited to, umbrellas, plants, pots, platforms for grills, or any other deck accessory or object desired to be placed on or near a deck.

As described herein, the deck inserts of the present disclosure allow for objects to be placed above a deck upper surface such that the object does not affect the quality of the deck. Furthermore, the deck insert itself may not touch or contact the upper surface of the deck. The deck insert of the present disclosure requires no underneath access of the deck as the insert may be installed from the top of a finished deck. The deck insert of the present disclosure may prevent or prohibit the deterioration and/or degradation of the deck. In some examples of the present disclosure, the deck insert of the present disclosure may not be frictionally attached to the joists and may be functionally attached by the body resting on a top surface of the joist.

It is without question that the inventive load distributing deck insert described herein above accomplishes all of its objectives. It provides for the stable support of objects above a deck while at the same time preventing staining and damage.

While particular embodiments of the invention are illustrated, and descriptions of details provided herein, they are included by way of illustration only and shall not be construed to limit the invention. Since certain revisions may be made with deviations from the scope of the present invention, it is the intent of all matter contained in the above description, or as depicted in the accompanying drawings be interpreted as illustrative and not in the literal sense. Practitioners of the art will realize the sequence of steps and embodiments as depicted in the figures can be revised without deviating from the intent of the present invention and the illustrations contained herein are singular examples of a multitude of possible depictions of the present invention.

The invention claimed is:

1. A load distributing deck system comprising:

a deck board; and a load distributing deck insert having:

a body;

a single piece saddle at a lower end of the body, the single piece saddle comprising a first end and a second end opposite the first end, the single piece saddle having a length extending from the first end to the second end; and a load receiving section at an upper end of the body, wherein the body has a length that is less than the length of the single piece saddle, and wherein the body is located at the middle of the length of the single piece saddle, wherein a lower surface of the first end of the single piece saddle is configured to rest on an upper surface of a first joist simultaneously with a lower surface of the second end of the single piece saddle that is configured to rest on an upper surface of a second joist, wherein the body and the single piece saddle are configured to be installed in a space adjacent the deck board, wherein the body, the single piece saddle, and the load receiving section are arranged such that the body, the single piece saddle, and the load receiving section avoid contacting an upper surface of the deck board, and wherein the load receiving section is configured to support an object above the upper surface of the deck board.

2. The load distributing deck system of claim 1, the single piece saddle further comprising a curved middle section connecting the first end to the second end.

3. The load distributing deck system of claim 1, further comprising a second single piece saddle at a lower end of a second body, the second single piece saddle comprising a third end and a fourth end opposite the third end, wherein an upper surface of the body and the second body are connected to a lower surface of the load receiving section.

4. The load distributing deck system of claim 3, the single piece saddle further comprising a first curved middle section connecting the first end to the second end and the second single piece saddle comprising a second curved middle section connecting the third end to the fourth end.

5. The load distributing deck system of claim 3, wherein the first end and the third end are configured to rest on the upper surface of the first joist and the second end and the fourth end are configured to rest on the upper surface of the second joist, and wherein the second body and the second single piece saddle are configured to be placed adjacent the deck board.

6. The load distributing deck system of claim 1, wherein the load receiving section is a planar member.

7. The load distributing deck system of claim 6, wherein the load receiving section comprises an opening configured to receive the object.

8. The load distributing deck system of claim 1, further comprising:

an upper portion extending perpendicular from the body; and the load receiving section coupled to the upper portion such that the upper portion and the load receiving section are parallel, wherein the upper portion has a length that is equal to the length of the body.

9. A load distributing deck system comprising:

a first deck board;

a second deck board, adjacent to the first deck board; and a load distributing deck insert located between the first deck board and the second deck board, the load distributing deck insert having:

a body;

a saddle extending downward from a lower end of the body, the saddle comprising a first end and a second end opposite the first end; and a load receiving section extending from an upper surface of the body, wherein the saddle is configured to be frictionally mounted to one or more joists, wherein the body and the saddle are configured to be located in a space between the first deck board and the second deck board, wherein the load distributing deck insert is arranged such that the load distributing deck insert avoids contacting an upper surface of the first deck board and the second deck board, and wherein the load receiving section is configured to support an object above the upper surface of the first deck board and the second deck board.

10. The load distributing deck system of claim 9, wherein the first end comprises a first leg and the second end comprises a second leg, the first leg and the second leg configured to extend around opposing sides of the one or more joists.

11. The load distributing deck system of claim 10, wherein the first leg and the second leg are vertically extending downward from the body and wherein the first leg and the second leg are configured to frictionally engage a first joist.

12. The load distributing deck system of claim 11, further comprising a second body and a second saddle, the second saddle including a third leg and a fourth leg, the third leg and the fourth leg extending vertically downward from the second body.

13. The load distributing deck system of claim 12, wherein the body and the second body are located on opposing sides of the load receiving section and are coupled to a lower surface of the load receiving section.

14. The load distributing deck system of claim 13, wherein the saddle and the second saddle are configured to extend over two joists.

15. The load distributing deck system of claim 9, wherein the load receiving section comprises a cylindrical tube configured to hold a pole.

16. The load distributing deck system of claim 9, wherein the saddle comprises an arch.

17. The load distributing deck system of claim 9, wherein the saddle comprises an arch having at least one tooth protruding therefrom.

18. The load distributing deck system of claim 9, wherein the saddle is offset from the load receiving section.

19. The load distributing deck system of claim 9, wherein the first deck board is spaced apart from the second deck board by a distance of about 3/16 inches, and wherein the body and the saddle each have a thickness less than the distance.

20. The loading distributing deck system of claim 9, wherein the body and the saddle have a uniform thickness.

21. A load distributing deck insert comprising:

a body;

a saddle extending downward from a lower end of the body, the saddle comprising a first end and a second end opposite the first end, the saddle having a length extending from the first end to the second end;

an upper portion extending perpendicularly from an upper end of the body;

a second body;

a second saddle extending downward from a lower end of the second body, the second saddle comprising a first end and a second end opposite the first end;

a second upper portion extending perpendicularly from an upper end of the second body; and a load receiving section coupled to the upper portion, wherein the body and the saddle have a uniform thickness and the body has a length that is less than the length of the saddle, wherein the body and the saddle are configured to be installed in a space between adjacent deck boards and the second body and the second saddle are configured to be installed in a space between a second set of adjacent deck boards, wherein the upper portion and the load receiving section are configured to extend over the adjacent deck boards in a manner that avoids contacting an upper surface of the adjacent deck boards, and wherein the body and the saddle share a coplanar forward surface, and wherein the load receiving section is coupled to the upper portion and the second upper portion.

22. The load distributing deck insert of claim 21, wherein a lower surface of a first end of the saddle is configured to rest on an upper surface of a first joist simultaneously with a lower surface of a second end of the saddle that is configured to rest on an upper surface of a second joist.

23. A load distributing deck system comprising:

a first joist;

a second joist;

two or more deck boards; and a load distributing deck insert having:

a body;

a saddle at a lower end of the body, the saddle comprising a first end and a second end opposite the first end; and a load receiving section at an upper end of the body, wherein a lower surface of the first end of the saddle rests on an upper surface of the first joist and a lower surface of the second end of the saddle simultaneously rests on an upper surface of the second joist, wherein the body and the saddle are configured to be installed in a space between adjacent deck boards of the two or more deck boards, wherein the load distributing deck insert avoids contacting an upper surface and a lower surface of each of the adjacent deck boards, and wherein the load receiving section is configured to support an object above the upper surface of the adjacent deck boards.

24. The load distributing deck system of claim 23, wherein the first joist is separated a distance from the second joist.

25. The load distributing deck system of claim 23, further comprising:

an upper portion extending perpendicularly from an upper end of the body, wherein the load receiving section is coupled to the upper portion.

* * * * *